US005314797A

United States Patent [19]

Yoshioka et al.

[11] Patent Number: 5,314,797

[45] Date of Patent: May 24, 1994

[54] SILVER HALIDE COLOR PHOTOGRAPHIC MATERIAL CONTAINING AT LEAST ONE ACYLACETAMIDE YELLOW DYE-FORMING COUPLER

[75] Inventors: Yasuhiro Yoshioka; Yoshio Shimura; Hidetoshi Kobayashi, all of Minami-ashigara, Japan

[73] Assignee: Fuji Photo Film Co., Ltd., Kanagawa, Japan

[21] Appl. No.: 743,780

[22] Filed: Aug. 12, 1991

[30] Foreign Application Priority Data

Aug. 13, 1990 [JP] Japan ..... 2-214060

[51] Int. Cl.[5] ..... G03C 7/36; G03C 7/388

[52] U.S. Cl. ..... 430/546; 430/544; 430/556; 430/557; 430/558; 430/957

[58] Field of Search ..... 430/556, 557, 558, 544, 430/957, 546

[56] References Cited

U.S. PATENT DOCUMENTS

| | | | |
|---|---|---|---|
| Re. 27,848 | 12/1973 | Weissberger | 548/311 |
| 4,022,620 | 5/1977 | Okumura et al. | 430/389 |
| 4,146,396 | 3/1979 | Yakota et al. | 518/311 |
| 4,268,591 | 5/1981 | Tschopp | 430/557 |
| 4,289,847 | 9/1981 | Ishikawa et al. | 430/557 |
| 4,404,274 | 9/1983 | Arai et al. | 430/389 |
| 4,927,743 | 5/1990 | Tamoto | 430/556 |
| 5,118,599 | 6/1992 | Lau et al. | 430/557 |

FOREIGN PATENT DOCUMENTS

| | | |
|---|---|---|
| 2213461 | 11/1972 | Fed. Rep. of Germany . |
| 4726133 | 4/1972 | Japan . |
| 0161543 | 12/1981 | Japan . |
| 0164343 | 12/1981 | Japan . |

OTHER PUBLICATIONS

Chemical Abstracts, vol. 115, No. 3, Abstracts 22252 and 22253 (1991).

Chemical Abstracts, vol. 115, 1991 115:22252d, 115:22252e.

*Primary Examiner*—Lee C. Wright

*Attorney, Agent, or Firm*—Birch, Stewart, Kolasch & Birch

[57] ABSTRACT

There is disclosed a silver halide color photographic material comprising a photosensitive silver halide emulsion layer that contains an acylacetamide yellow dye-forming coupler whose acyl group is represented by formula (I) and a high-boiling organic solvent, wherein the weight ratio of the high-boiling solvent to the coupler contained in said layer is 0.3 or below.

Formula (I)

wherein $R_1$ represents a monovalent group, Q represents a group of nonmetallic atoms required to form together with C a 3- to 5-membered hydrocarbon ring or a 3- to 5-membered heterocyclic ring that contains a hetero atom selected from the group consisting of N, O, S, and P, provided that $R_1$ is not a hydrogen atom and it does not bond to Q to form a ring.

20 Claims, No Drawings

SILVER HALIDE COLOR PHOTOGRAPHIC MATERIAL CONTAINING AT LEAST ONE ACYLACETAMIDE YELLOW DYE-FORMING COUPLER

FIELD OF THE INVENTION

The present invention to silver halide color photographic materials, and more particularly to a silver halide color photographic material improved in image quality and particularly sharpness, as well as remarkably improved in fastness of the color image to fading during storage in darkness (resistance to dark-fading).

BACKGROUND OF THE INVENTION

Generally, silver halide color photographic materials contain three types of couplers that couple with the oxidized product of an aromatic primary amine color-developing agent to form yellow, magenta, and cyan dyes.

Of these, yellow couplers that are generally used are acylacetamide couplers, typically benzoylacetanilide couplers and pivaloylacetanilide couplers. Benzoylacetamide couplers have excellent characteristics that the coupling activity thereof to an oxidized product of aromatic primary amine developing agents at the time of development is generally high and the molecular extinction coefficient of the produced yellow dye is large, while they have a defect that the color image fastness during storage in darkness is low. Although pivaloylacetamide couplers are excellent in color image fastness, since the coupling reactivity at the time of development is low and the molecular extinction coefficient is small, a larger amount of the color-forming coupler must be used to obtain an adequate color image density, which is disadvantageous in view of the image quality and cost.

Consequently, development of a yellow coupler having the merits of both, that is, both high color-forming properties (a high coupling activity of the coupler and a high molecular extinction coefficient of the produced dye) and color image fastness is desired.

From the above point of view, acyl groups of acylacetamide couplers have been studied. For example, U.S. Pat. Re No. 27,848 discloses a coupler having a 7,7-dimethylnobornane-1-carbonyl group or a 1-methylcyclohexane-1-carbonyl group as a modification of a pivaloyl group. However, the coupling activity of these couplers is low and the molecular extinction coefficient of the formed dye is small. Further, JP-A ("JP-A" means unexamined published Japanese patent application) No. 26133/1972 discloses a coupler having a cyclopropane-1-carbonyl group or a cyclohexane-1-carbonyl group. However, the fastness of the dye formed from these couplers is low and unsatisfactory.

On the other hand, in color photographic materials, it is considered important to reduce the thickness of the dried coating layer of photographic materials in view of the improvement of image quality, and in particular sharpness. Since, out of photosensitive silver halide layers of photographing materials, particularly the blue-sensitive silver halide layer that uses a yellow coupler constitutes the uppermost layer in many cases, it is considered that the blue-sensitive layer influences greatly the improvement of sharpness of the green-sensitive layer and the red-sensitive layer that underlie the blue-sensitive layer.

Generally, since a coupler is dissolved in a high-boiling organic solvent, is emulsified to disperse it, and is applied on a base, reduction of the amount of the high-boiling solvent employed can be an effective means of making the layer thinner. However, if high-color-forming benzoylacetamide yellow couplers that are conventionally utilized are used, the activity lowers extremely when the amount of a high-boiling organic solvent to be used is decreased, and therefore there is a limit making the layer thinner by this technique.

Pivaloyl acetoaminde couplers low in coupling activity and with low molecular extinction coefficients have by themselves a limit to the thinning of the layer.

To make the layer thin by only lowering the amount of gelatin without decreasing a high-boiling organic solvent is not practical because it greatly deteriorates the layer quality. Generally, the layer quality is greatly influenced by the ratio of oil-soluble substance, including coupler and the high-boiling organic solvent, to gelatin. Consequently, if it is established that the layer quality is to be kept constant, decreasing the oil-soluble substance means that the gelatin can also be decreased at the same time.

Therefore, it follows that the decrease of a high-boiling organic solvent constituting a considerable part of oil-soluble substance is quite effective in making the layer thin.

For the above reasons, development of couplers that give an adequate color density even when the amount of a high-boiling organic solvent to be used is decreased is desired.

SUMMARY OF THE INVENTION

Therefore, the first object of the present invention is to provide a silver halide color photographic material that shows adequate color-forming property even when a high-boiling organic solvent present together with a yellow coupler is decreased.

The second object of the present invention is to provide a color photographic material excellent in color image stability.

Other and further objects, features, and advantages of the invention will appear more fully from the following description.

DETAILED DESCRIPTION OF THE INVENTION

The objects of the present invention have been accomplished by the following silver halide color photographic material. That is, the objects have been achieved by a silver halide color photographic material having at least one photosensitive silver halide emulsion layer on a base, characterized in that at least one of said photosensitive silver halide emulsion layers contains at least one acylacetamide yellow dye-forming coupler whose acyl group is represented by the following formula (I):

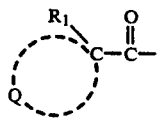

Formula (I)

wherein $R^1$ represents a monovalent group, Q represents a group of non-metallic atoms required to form together with the C a 3- to 5-membered cyclic hydrocarbon group or a 3- to 5-membered heterocyclic group having in the group at least one hetero atom selected from the group consisting of N, O, S, and P, provided that $R_1$ is not a hydrogen atom and it does not bond to Q to form a ring, and the weight ratio of the high-boiling organic solvent to the dye-forming coupler contained in said layer is 0.3 or below, preferably 0.1 or below.

Preferably, the acylacetamide yellow coupler of the present invention is represented by the following formula (Y):

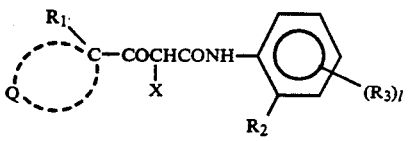

Formula (Y)

wherein $R_1$ represents a monovalent substituent other than hydrogen; Q represents a group of non-metallic atoms required to form together with the C a substituted or unsubstituted 3- to 5-membered cyclic hydrocarbon group or a substituted or unsubstituted 3- to 5-membered heterocyclic group having in the group at least one hetero atom selected from a group consisting of N, O, S, and P; $R_2$ represents a hydrogen atom, a halogen atom (e.g., F, Cl, Br, and I, which is applied hereinafter to the description of formula (Y)), an alkoxy group, an aryloxy group, an alkyl group, or an amino group; $R_3$ represents a group capable of substitution onto a benzene ring; X represents a hydrogen atom, or a group capable of being released upon coupling reaction with the oxidized product of an aromatic primary amine developing; l is an integer of 0 to 4, and when l is 2 or more, the $R_3$ groups may be the same or different.

When any of the substituents in formula (Y) is an alkyl group or contains an alkyl group, unless otherwise specified the alkyl group is a straight-chain or branched chain or cyclic alkyl group that may be substituted and may contain an unsaturated bond such as methyl, isopropyl, t-butyl, cyclopentyl, t-pentyl, cyclohexyl, 2-ethylhexyl, 1,1,3,3-tetramethylbutyl, dodecyl, hexadecyl, allyl, 3-cyclohexenyl, oleyl, benzyl, trifluoromethyl, hydroxymethylmethoxyethyl, ethoxycarbonylmethyl, and phenoxyethyl. Moreover, unless otherwise specified the alkyl group contains 1 to 30 carbon atoms (exclusive of any substituents).

When any of the substituent in formula (Y) is an aryl group or contains an aryl group, unless otherwise specified the aryl group is a monocyclic or condensed ring aryl group containing 3 to 8 ring members selected from carbon, oxygen, nitrogen and sulfur. The aryl groups may be further substituted and include aryl groups such as phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-t-pentylphenyl, p-methanesulfonamidophenyl, and 3,4-dichlorophenyl.

When the substituent in formula (Y) is a heterocyclic group or contains a heterocyclic ring, unless otherwise specified the heterocyclic ring group is a 3- to 8-membered monocyclic or condensed ring heterocyclic group that contains at least one hetero atom selected from the group consisting of O, N, S, P, Se, and Te, and contains from 2 to 36 carbon atoms and may be substituted such as 2-furyl, 2-pyridyl, 4-pyridyl, 1-pyrazolyl, 1-imidazolyl, 1-benzotriazolyl, 2-benzotriazolyl, succinimido, phthalimido, and 1-benzyl-2,4-imidazolidinedione-3-yl.

Substituents preferably used in formula (Y) will now be described below.

$R_1$ in formula (Y) preferably represents a halogen atom, a cyano group, a monovalent aliphatic-type group that may be substituted and has a total number of carbon atoms (hereinafter, abbreviated as a total C-number) of 1 to 30 such as an alkyl group and an alkoxy group, or a monovalent aryl-type group that may be substituted and has a total C-number of 6 to 30 such as an aryl group and an aryloxy group, and examples of substituents therefor are a halogen atom, an alkyl group (straight, branched or cyclic), an alkoxy group, a nitro group, an amino group, a carbonamido group, a sulfonamido group, and an acyl group.

Preferably Q in formula (Y) represents a group of non-metallic atoms which forms together with the C (carbon atom), substituted or unsubstituted, a 3- to 5-membered hydrocarbon ring having a total C-number of 3 to 30, or a 3-5-membered heterocyclic groups substituted or unsubstituted, having a total C-number of 2 to 30 and having in the ring at least one hetero atom selected from the group consisting of N, O, S, and P, and preferably containing from 1 to 3 hetero atom ring members. The ring formed by Q together with the C may have an unsaturated bond in the ring. As examples of the ring formed by Q together with the C are a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thiethane ring, a thiolane ring, and a pyrrolidine ring. Examples of substituent for the rings include a halogen atom, a hydroxyl group, an alkyl group, an aryl group, an acyl group, an alkoxy group, an aryloxy group, a cyano group, an alkoxycarbonyl group, an alkylthio group, and an arylthio group.

$R_2$ in formula (Y) preferably represents a halogen atom, an alkoxy group that may be substituted and has a total C-number of 1 to 30, an aryloxy group that may be substituted and has a total C-number of 6 to 30, an alkyl group that may be substituted and has a total C-number of 1 to 30, or an amino group that may be substituted and has a total C-number of 0 to 30 and the substituent is, for example, a halogen atom, an alkyl group, an alkoxy group, or an aryloxy group.

Preferably, $R_3$ in formula (Y) is a halogen atom, an alkyl group (as defined above), an aryl group (as defined above), an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a arylsulfonyl group, a ureido group, a sulfamoylamino group, an alkoxycarbonylamino group, an alkoxysulfonyl group, a nitro group, a heterocyclic group (as defined above), a cyano group, an acyl group, an acyloxy group, an alkylsulfonyloxy group, and an arylsulfonyloxy group, and examples of the coupling split-off group are a heterocyclic group (as defined above) bonded to the coupling active site through the nitrogen atom, an aryloxy group, an arylthio group, an acyloxy group, an alkylsulfonyloxy group, an arylsulfonyloxy group, a heterocyclic oxy group (wherein heterocyclic is as defined above), and a halogen atom.

$R_3$ in formula (Y) preferably represents a halogen atom, an alkyl group that may be substituted and has a total C-number of 1 to 30, more preferably 1 to 18, an aryl group that may be substituted and has a total C-number of 6 to 30, more preferably 6 to 24, an alkoxy group that may be substituted and has a total C-number of 1 to 30, more preferably 1 to 18, an aryloxy group that may be substituted and has a total C-number 6 to 30, more preferably 6 to 24, an alkoxycarbonyl group that may be substituted and has a total C-number of 2 to 30, more preferably 2 to 19, an aryloxycarbonyl group that may be substituted and has a total C-number of 7 to 30, more preferably 7 to 24, a carbonamido group that may be substituted and has a total C-number of 1 to 30, more preferably 1 to 20, a sulfonamido group that may be substituted and has a total C-number of 1 to 30, more preferably 1 to 24, a carbamoyl group that may be substituted and has a total C-number of 1 to 30, more preferably 1 to 20, a sulfamoyl group that may be substituted and has a total C-number of 0 to 30, more preferably 1 to 24, an alkylsulfonyl group that may be substituted and has a total C-number of 1 to 30, more preferably 1 to 20, an arylsulfonyl group that may be substituted and has a total C-number of 6 to 30, more preferably 6 to 24, a ureido group that may be substituted and has a total C-number of 1 to 30, more preferably 1 to 20, a sulfamoylamino group that may be substituted and has a total C-number of 0 to 30, preferably 0 to 20, an alkoxycarbonylamino group that may be substituted and has a total C-number of 2 to 30, preferably 2 to 20, a heterocyclic group (as defined above) that may be substituted and has a total C-number of 1 to 30, preferably 1 to 20, an acyl group that may be substituted and has a total C-number of 1 to 30, preferably 1 to 20, an alkylsulfonyloxy group that may be substituted and has a total C-number of 1 to 30, preferably 1 to 20, or an arylsulfonyloxy group that may be substituted and has a total C-number of 6 to 30, preferably 6 to 24; and examples of the substituents for these $R_3$ moieties include a halogen atom, an alkyl group, an aryl group, a heterocyclic group (as defined above), an alkoxy group, an aryloxy group, a heterocyclic oxy group (wherein heterocyclic is as defined above), an alkylthio group, an arylthio group, a heterocyclic thio group (wherein heterocyclic is as defined above), an alkylsulfonyl group, an arylsulfonyl group, an acyl group, a carbonamido group, a sulfonamido group, a carbamoyl group, a sulfamoyl group, an alkoxycarbonylamino group, a sulfamoylamino group, a ureido group, a cyano group, a nitro group, an acyloxy group, an alkoxycarbonyl group, an aryloxycarbonyl group, an alkylsulfonyloxy group, and an arylsulfonyloxy group.

In formula (Y), preferably l is an integer of 1 or 2 and the position of the substitution of $R_3$ is preferably the meta-position or ortho-position relative to

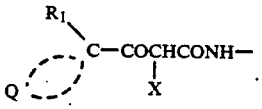

In formula (Y), preferably X represents a heterocyclic group (as defined above) bonded to the coupling active site through a nitrogen atom or an aryloxy group.

When X represents a heterocyclic group, X is most preferably a heterocyclic group (as defined above) comprising a 5- to 7-membered monocyclic group or condensed ring group that may be substituted. Exemplary of such groups are succinimido, maleinimido, phthalimido, diglycolimido, pyrrole, pyrazole, imidazole, 1,2,4-triazole, tetrazole, indole, indazole, benzimidazole, benztriazole, imidazolidin-2,4-dione, oxazolidin-2,4-dione, thiazolidin-2,4-dione, imidazolidin-2-one, oxazolidin-2-one, thiazolidin-2-one, benzimidazolin-2-one, benzoxazolidin-2-one, benzothiazolin-2-one, 2-pyrrolin-5-one, 2-imidazolin-5-one, indolin-2,3-dione, 2,6-dioxypurine, parabanic acid, 1,2,4-triazolidin-3,5-dione, 2-pyridone, 4-pyridone, 2-pyrimidone, 6-pyridazone-2-pyrazone, 2-amino-1,3,4-thiazolidine, 2-imino-1,3,4-thiazolidin-4-one and the like, any of which heterocyclic ring groups may be substituted. Examples of the substituent of these heterocyclic rings include a halogen atom, a hydroxyl group, a nitro group, a cyano group, a carboxyl group, a sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamido group, a sulfonamido group, a carbamoyl group, a sulfamoyl group, a ureido group, an alkoxycarbonylamino group, and a sulfamoylamino group. When X represents an aryloxy group, preferably X represents an aryloxy group having a total C-number of 6 to 30 which may be substituted by a substituent selected from the group consisting of the substituents mentioned above for the heterocyclic ring represented by X. Most preferably, the substituent of the aryloxy group is a halogen atom, a cyano group, a nitro group, a carboxyl group, a trifluoromethyl group, an alkoxycarbonyl group, a carbonamido group, a sulfonamido group, a carbamoyl group, a sulfamoyl group, an alkylsulfonyl group, an arylsulfonyl group, or a cyano group.

Particularly preferable substituents used in formula (Y) will now be described.

Particularly preferably $R_1$ is a halogen atom or an alkyl group (as defined above) and most preferably a methyl group.

Particularly preferably Q represents a group of non-metallic atoms required to form together with the C a 3- to 5- membered hydrocarbon ring, for example,

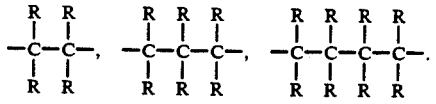

R represents a halogen atom, a hydrogen atom, or an alkyl group (as defined above). The groups R may be the same or different. Most preferably Q forms together with the C a 3-membered ring, that is, represented by

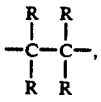

wherein R is as defined above.

Particularly preferably $R_2$ represents a chlorine atom, a fluorine atom, a substituted or unsubstituted alkyl group having a C-number of 1 to 6 (e.g., halogen substituted $C_{1-6}$ alkyl, methyl, trifluoromethyl, ethyl, isopropyl, and t-butyl) exclusive of its substituents, an alkoxy group having a C-number of 1 to 8 (e.g., methoxy, ethoxy, methoxyethoxy, and butoxy), or an aryloxy group having C-number of 6 to 24 (e.g., phenoxy, p-tolyloxy, and p-methoxyphenoxy); with a chlorine atom, a methoxy group, or a trifluoromethyl group most preferred.

Particularly preferably $R_3$ represents a halogen atom, an alkoxy group, an alkoxycarbonyl group, an aryloxycarbonyl group, a carbonamido group, a sulfonamido group, a carbamoyl group, or a sulfamoyl group, with an alkoxy group, an alkoxycarbonyl group, a carbonamido group, or a sulfonamido group most preferred.

Particularly preferably X is a group represented by the following formula (Y-1), (Y-2), or (Y-3):

Formula (Y-1)

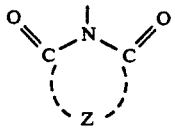

In formula (Y-1), Z represents

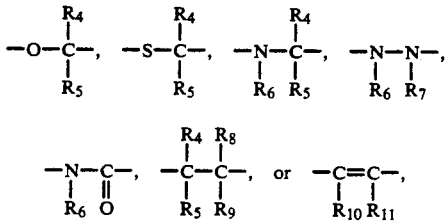

wherein $R_4$, $R_5$, $R_8$ and $R_9$, same or different, each represent a hydrogen atom, an alkyl group (as defined above), an aryl group (as defined above), an alkoxy group having C-number of 1 to 24, an aryloxy group having C-number of 6 to 24, an alkylthio group having C-number of 1 to 24, an arylthio group having C-number of 6 to 24, an alkylsulfonyl group having C-number of 1 to 24, an arylsulfonyl group having C-number of 6 t 24, or an amino group, any of which may be substituted (except hydrogen); $R_6$ and $R_7$ each represent a hydrogen atom, an alkyl group (as defined above), an aryl group (as defined above), an alkylsulfonyl group having C-number of 1 to 24, an arylsulfonyl group having C-number of 6 to 24, or an alkoxycarbonyl group having C-number of 1 to 24, any of which may be substituted (except hydrogen); $R_{10}$ and $R_{11}$ each represent a hydrogen atom, an alkyl group (as defined above), or an aryl group (as defined above), $R_{10}$ and $R_{11}$ may bond together to form a benzene ring, and $R_4$ and $R_5$, $R_5$ and $R_6$, $R_6$ and $R_7$, or $R_4$ and $R_8$ may bond together to form a 3 to 8 membered heterocyclic or hydrocarbon ring (e.g., cyclobutane, cyclohexane, cycloheptane, cyclohexene, pyrrolidine, and piperidine), any of which groups may be substituted (except hydrogen).

Among the heterocyclic groups represented by formula (Y-1), particularly preferable ones are heterocyclic groups wherein Z represent

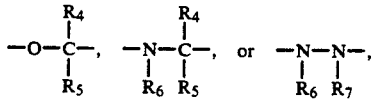

and $R_4$, $R_5$, $R_6$ and $R_7$, same or different are as defined above.

The total number of carbon atoms of the heterocyclic group represented by formula (Y-1) is 2 to 30, preferably 4 to 20, and more preferably 5 to 16.

Formula (Y-2)

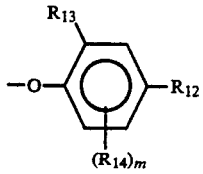

In formula (Y-2), at least one of $R_{12}$ and $R_{13}$ represents a group selected from a halogen atom, a cyano group, a nitro group, a trifluoromethyl, a carboxyl group, or one of the following groups, any of which may be substituted (except hydrogen), an alkoxycarbonyl group having C-number of 2 to 24, a carbonamido group having C-number of 1 to 24, a sulfonamido group having C-number of 1 to 24, a carbamoyl group having C-number of 1 to 24, a sulfamoyl group having C-number of 0 to 24, an alkylsulfonyl group having C-number of 1 to 24, an arylsulfonyl group having C-number of 6 to 24, and an acyl group having C-number of 1 to 24 and the other is a hydrogen atom, an alkyl group (as defined above), or an alkoxy group having C-number of 1 to 24; $R_{14}$ has the same meaning as that of $R_{12}$ or $R_{13}$; and m is an integer of 0 to 2. The total number of carbon atoms of the aryloxy group represented by formula (Y-2) is 6 to 30, preferably 6 to 24, and more preferably 6 to 15.

Formula (Y-3):

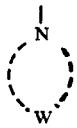

wherein W together with N represents a group of nonmetallic atoms required to form a a pyrrole ring, a pyrazole ring, an imidazole ring, or a triazole ring and the ring represented by

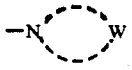

may be substituted (examples of the substituent are preferably a halogen atom, a nitro group, a cyano group, an alkoxycarbonyl group, an alkyl group, an aryl group, an amino group, an alkoxy group, an aryloxy group, and a carbamoyl group). The total C-number of the heterocyclic group represented by formula (Y-3) is 2 to 30, preferably 2 to 24, and more preferably 2 to 16.

Most preferably X is a group represented by formula (Y-1).

The coupler represented by formula (Y) may form a dimer or more higher polymer by bonding through a divalent or higher valent group at the substituent $R_1$, Q, X, or

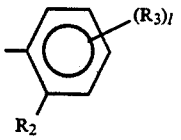

In that case, the total C-number may fall outside the range of the total C-number stated in each of the above substituents.

Specific examples of each substituent in formula (Y) are shown below: (1) Examples of the group

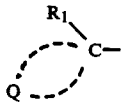

formed by $R_1$ together with Q and C are shown below:

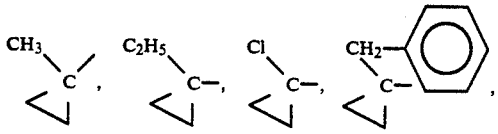

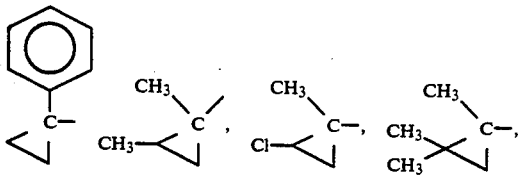

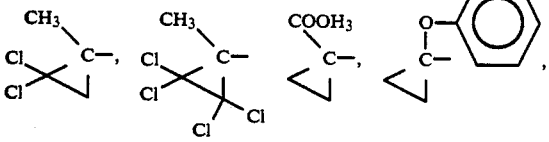

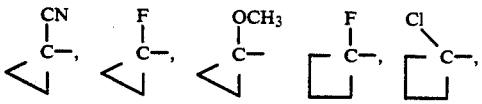

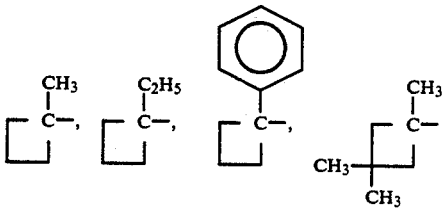

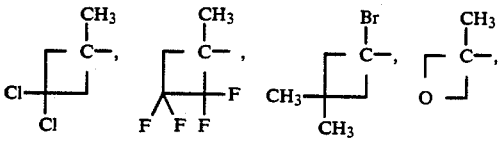

-continued

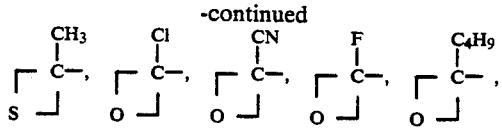

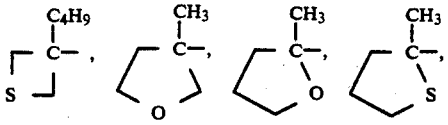

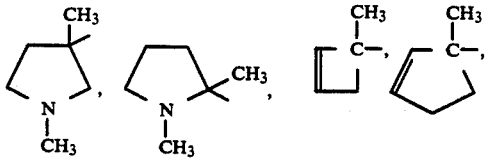

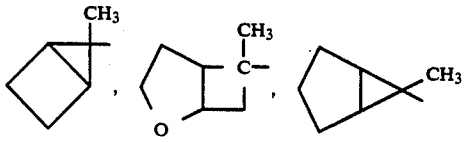

(2) Examples of $R_2$

F, Cl, Br, I, $CH_3O$—, 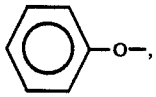

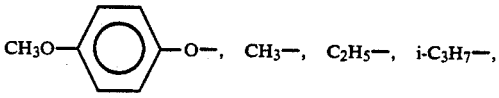

$CH_3$—, $C_2H_5$—, i-$C_3H_7$—, t-$C_4H_9$—, $CH_3OCH_2CH_2O$—, $CF_3$—, $(CH_3)_2N$—,

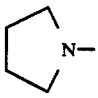

n-$C_4H_9O$—, n-$C_{14}H_{29}O$—, n-$C_{16}H_{33}O$—,

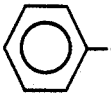

$CH_2O$—, n-$C_{12}H_{25}O$—

(3) Examples of $R_3$

F, Cl, Br, I, $CH_3O$—, $C_2H_6O$—, n-$C_{12}H_{25}O$—, $CH_3$, t-$C_4H_9$—, —$COOCH_3$, $COOC_2H_5$, —$COOC_4H_9$-$^n$,

—$COOC_{12}H_{25}$-$^n$, —$OCH_2CHC_8H_{17}$-$^n$ ($C_6H_{13}$-$^n$) —$COOCHCOOC_{12}H_{25}$-$^n$ ($CH_3$),

—$COOCHCOOC_{12}H_{29}$-$^n$ ($C_4H_9$-$^n$), —COO— 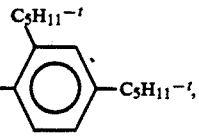

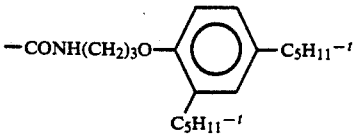

-continued
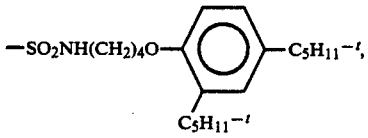
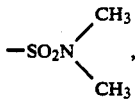
$-SO_2NHCOC_2H_5$, $-SO_2NHC_{16}H_{33}-^n$,
$-NHCOC_{13}H_{27}-^n$, $-NHCOC_{15}H_{31}-^n$, $-NHCOC_{17}H_{35}-^n$
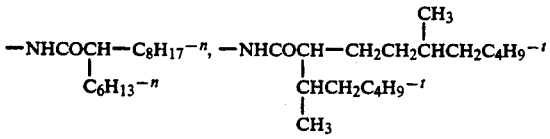
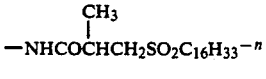
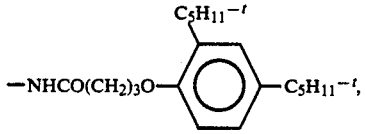
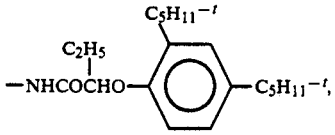
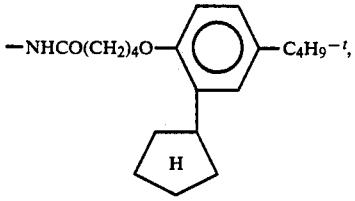
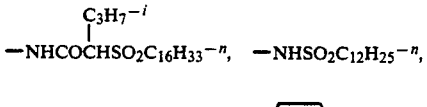
$-NHSO_2C_{16}H_{33}-^n$, $-NHSO_2$
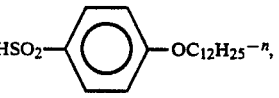
$-OC_{12}H_{25}-^n$,
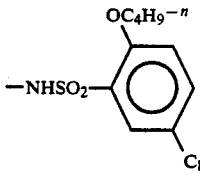
$-SO_2NHCH_3$,
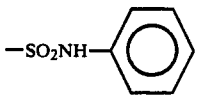
$-OCOC_{11}H_{23}-^n$,
$-OSO_2C_{12}H_{25}-^n$, $-NHCOOC_{12}H_{25}-^n$,
(4) Examples of X
-continued
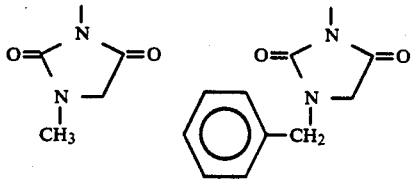
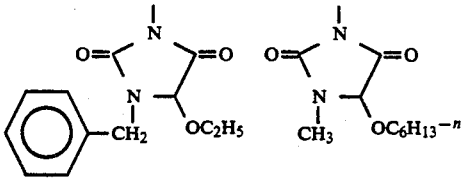
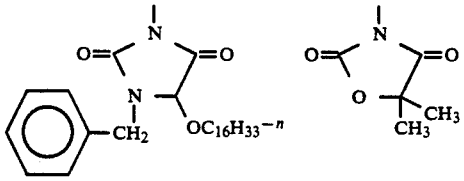
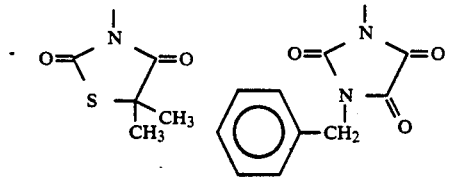
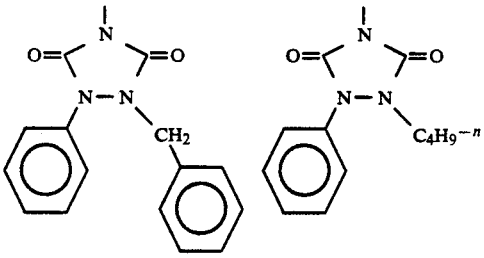
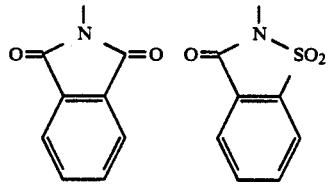
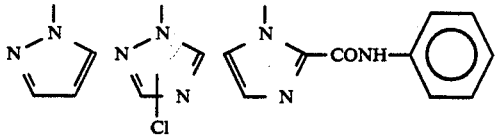
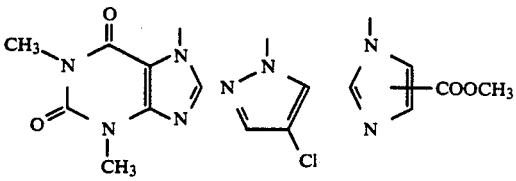

-continued
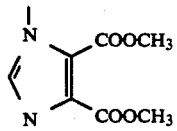
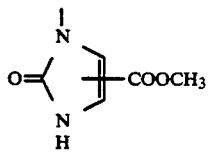
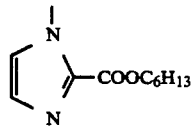
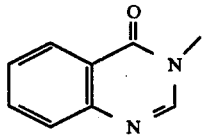
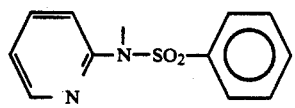
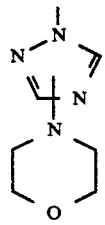
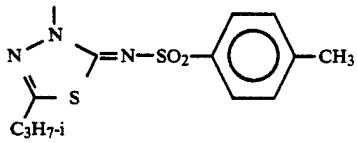
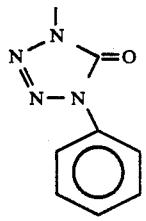
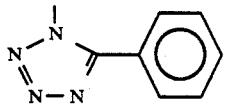
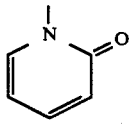
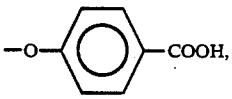
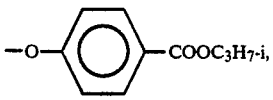
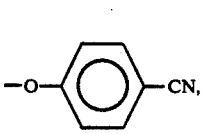
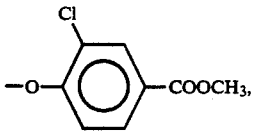
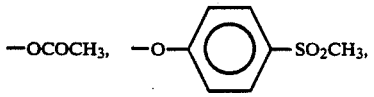
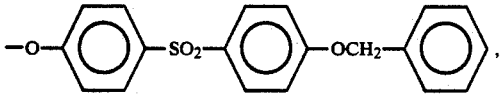
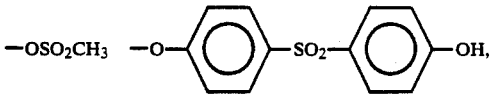
-continued
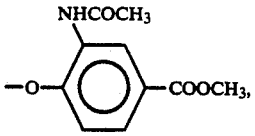
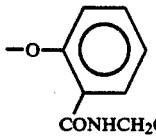
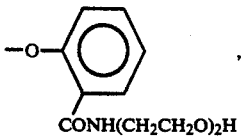
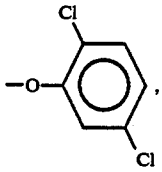
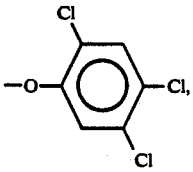
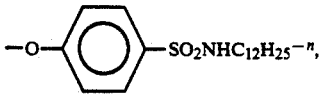
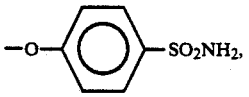
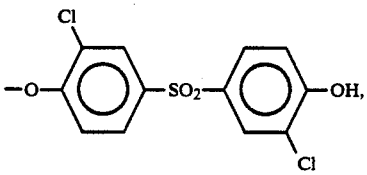
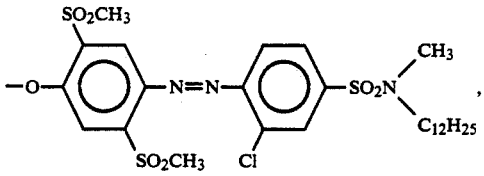
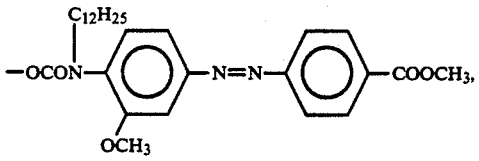
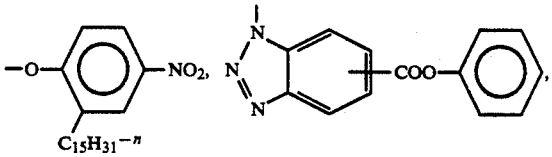
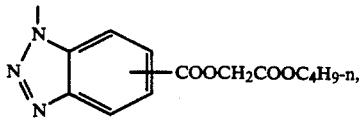

-continued
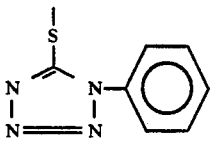
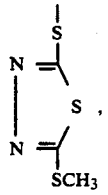
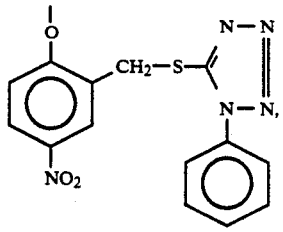
-continued
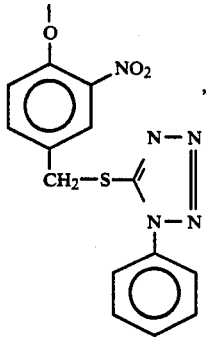
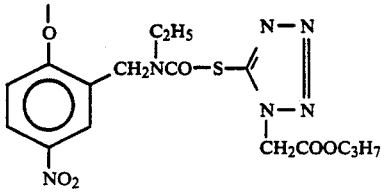
Concrete examples of yellow coupler represented by formula (Y) are shown below.
Y-1
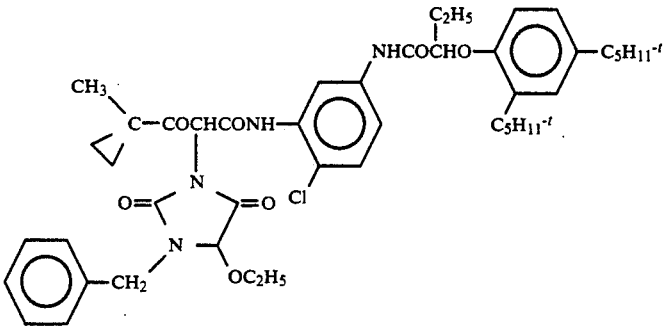
Y-2
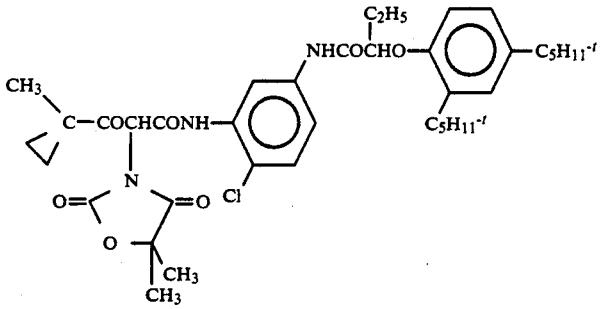
Y-3
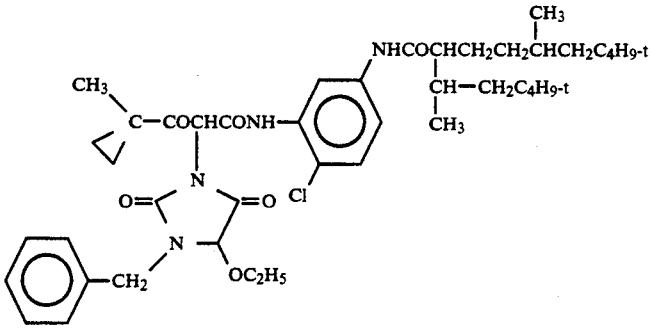

-continued
Y-4
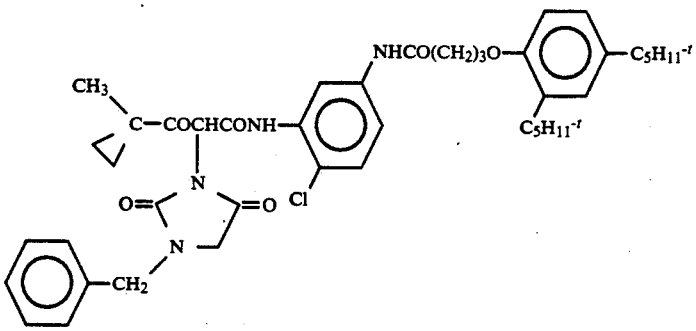
Y-5
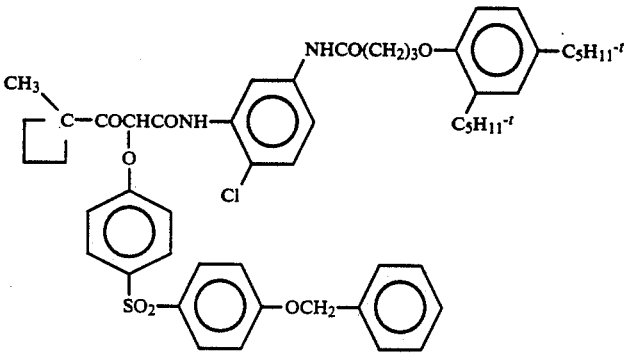
Y-6
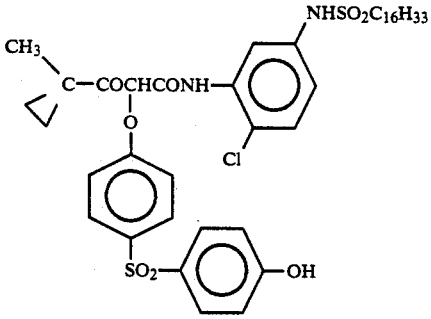
Y-7
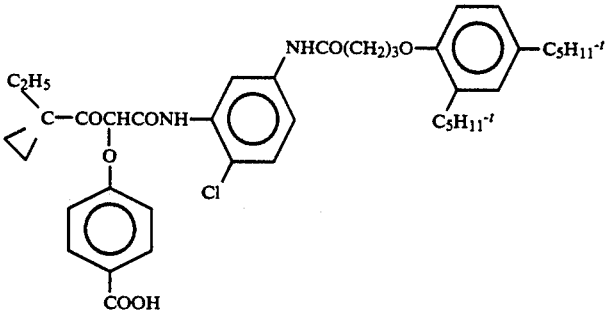
Y-8
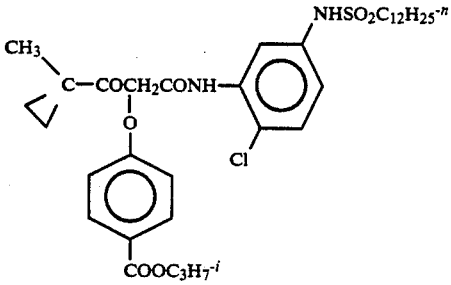
Y-9
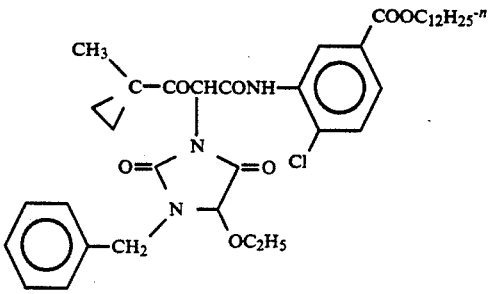

-continued
Y-10
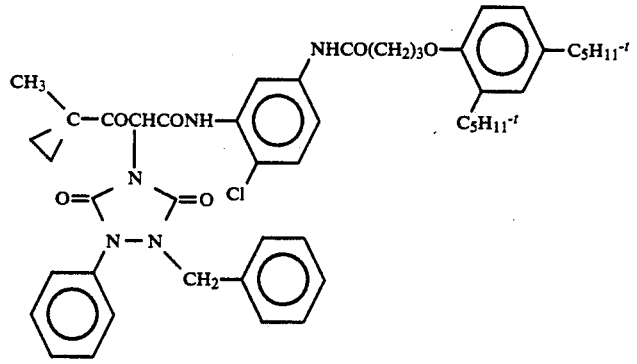
Y-11
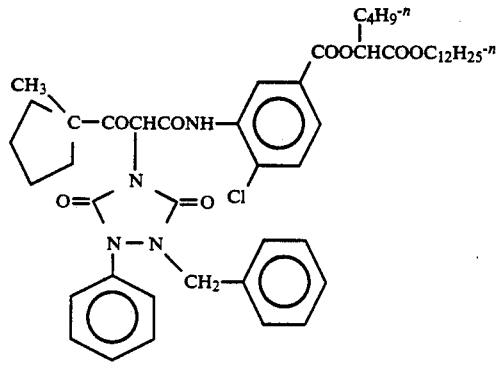
Y-12
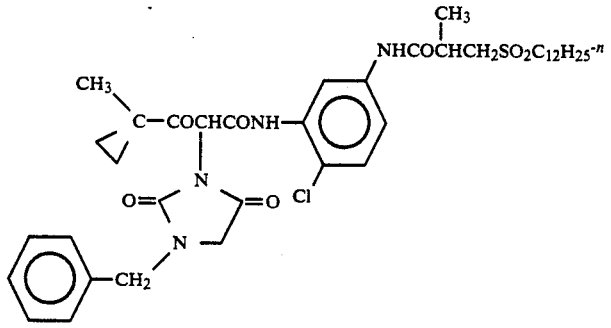
Y-13
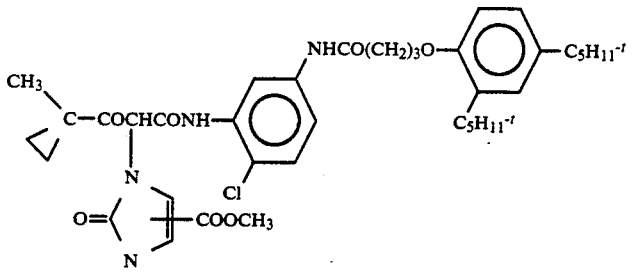
Y-14
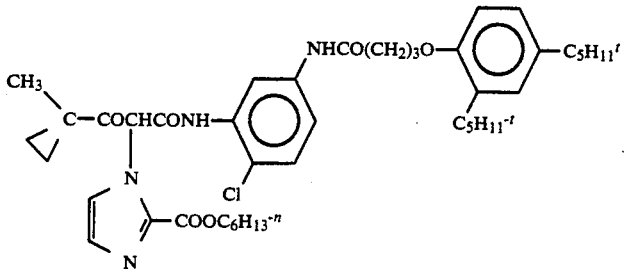

-continued
Y-15
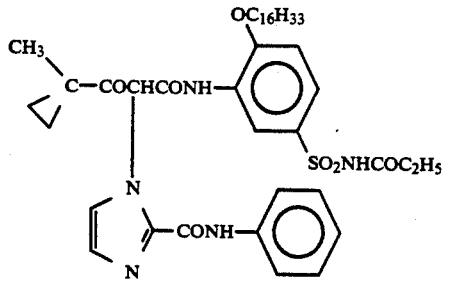
Y-16
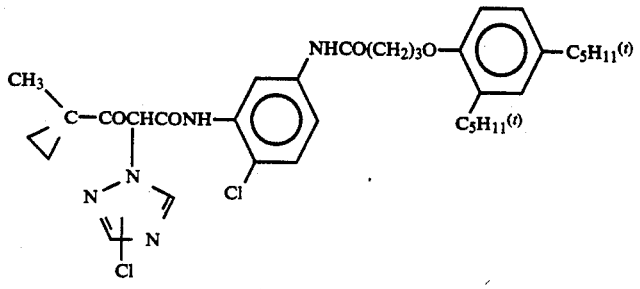
Y-17
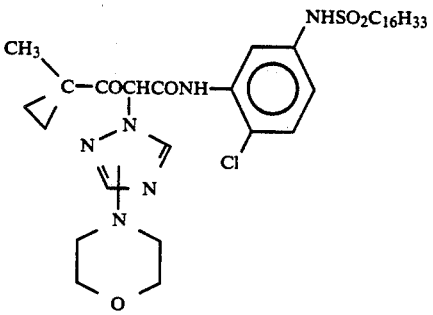
Y-18
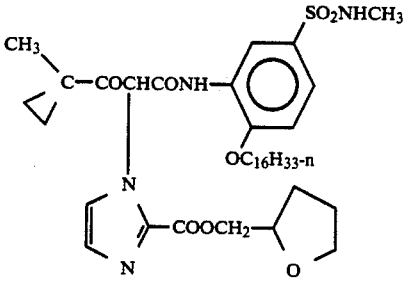
Y-19
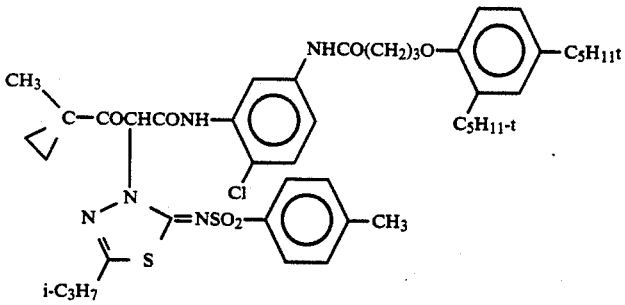
Y-20
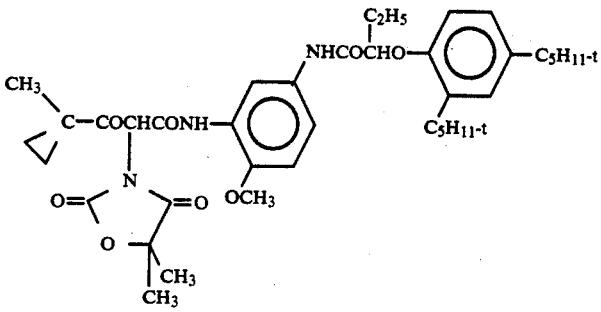

-continued
Y-21
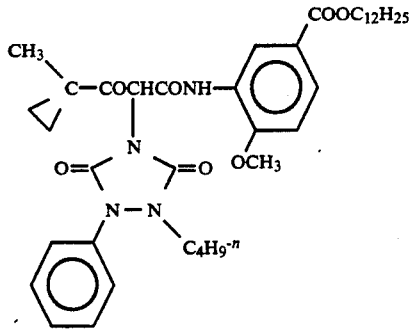
Y-22
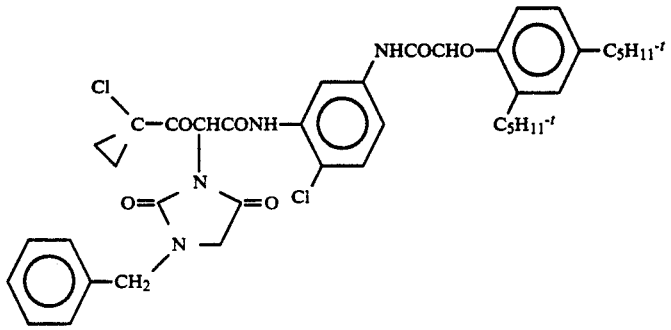
Y-23
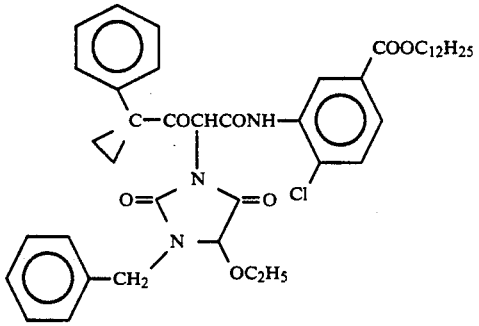
Y-24
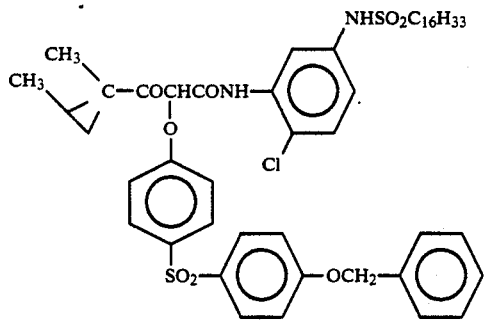
Y-25
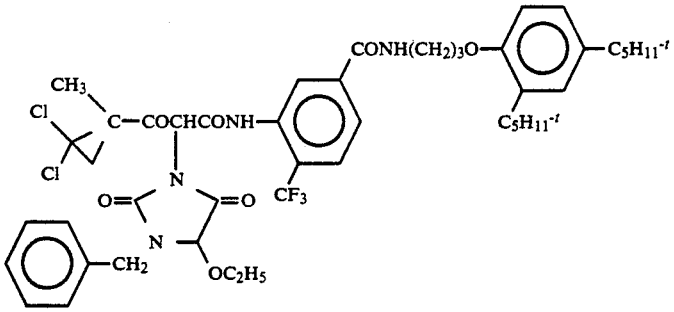
Y-26
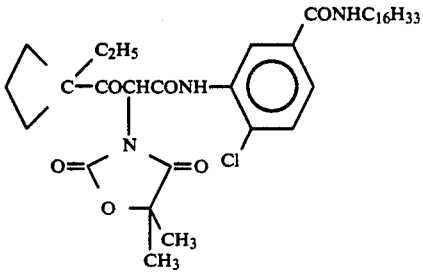
Y-27
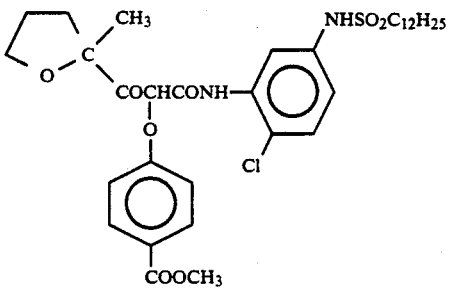

-continued
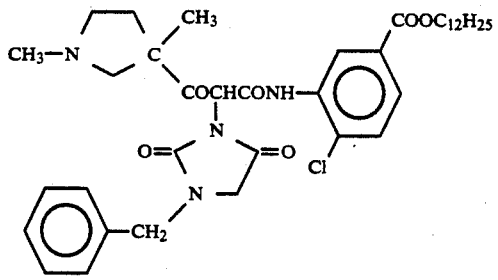
Y-28
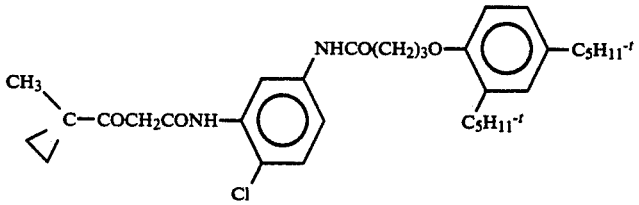
Y-29
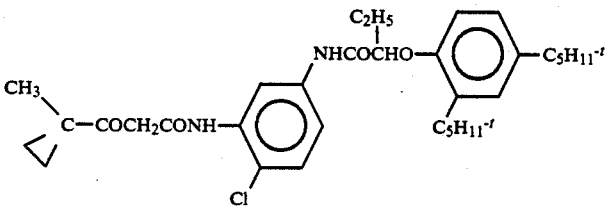
Y-30
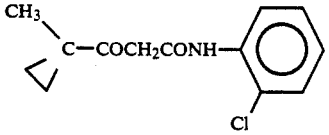
Y-31
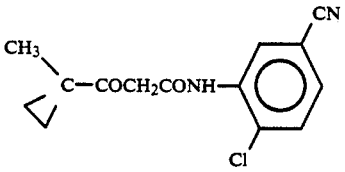
Y-32
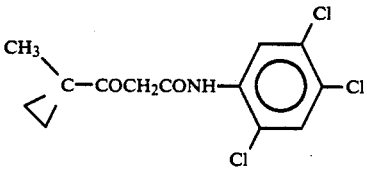
Y-33
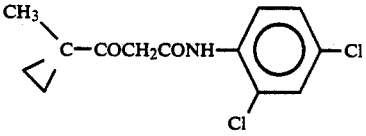
Y-34
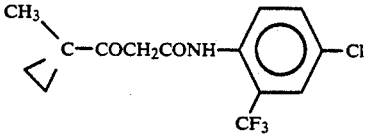
Y-35
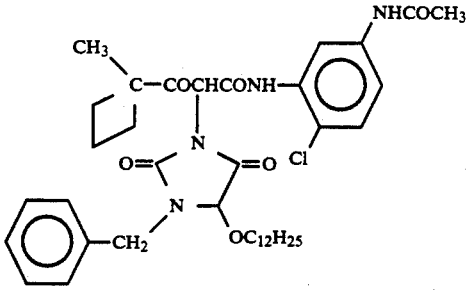
Y-36
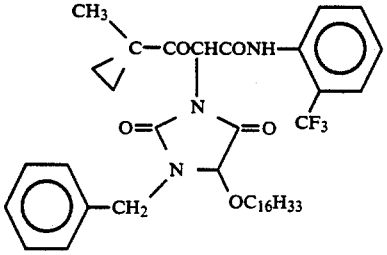
Y-37
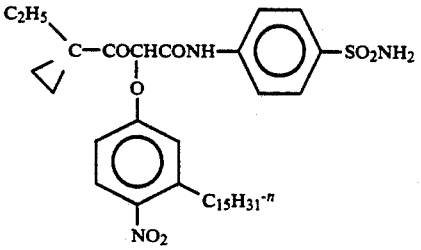
Y-38

-continued
Y-39
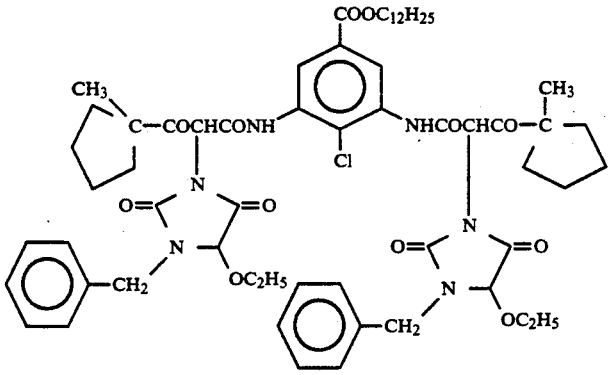
Y-40
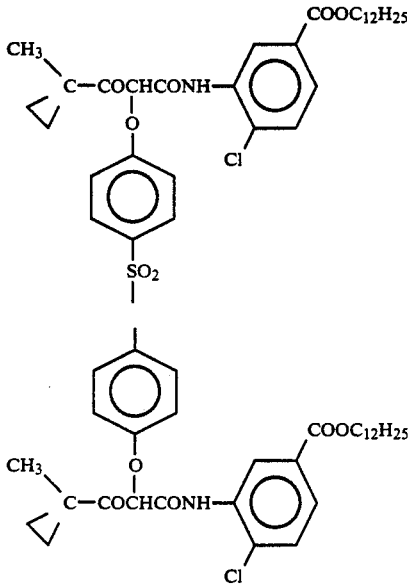
Y-41
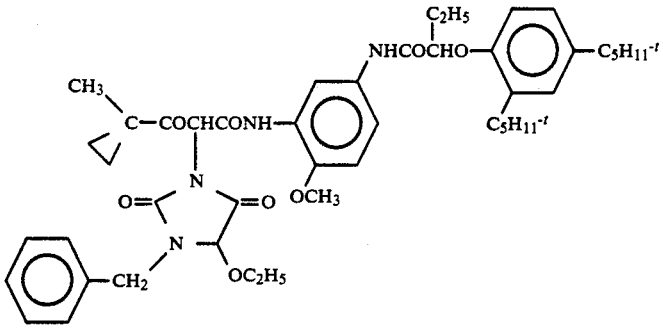
Y-42
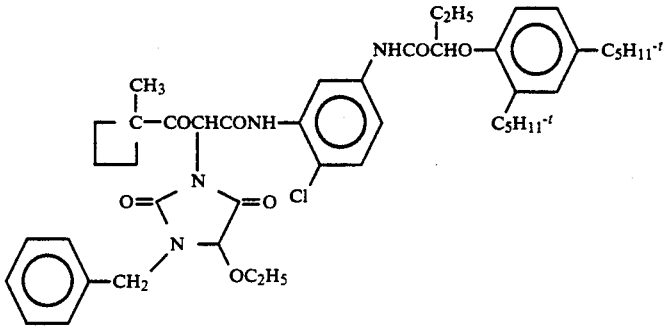

-continued
Y-43
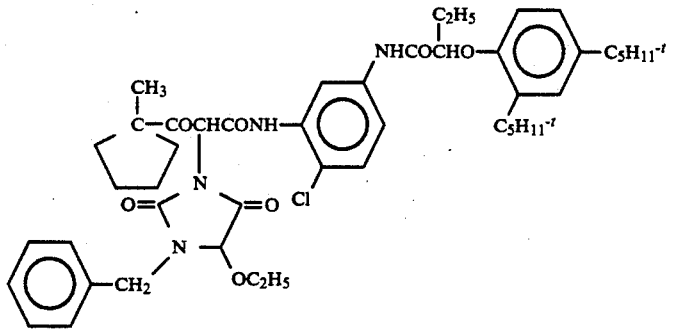
Y-44
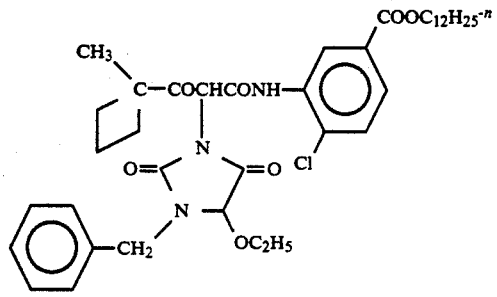
Y-45
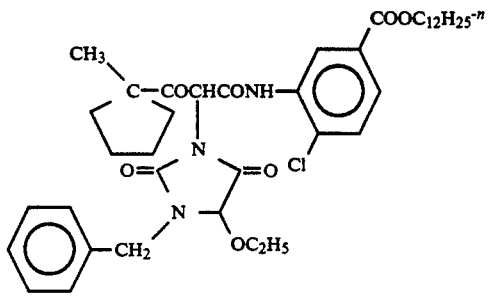
Y-46
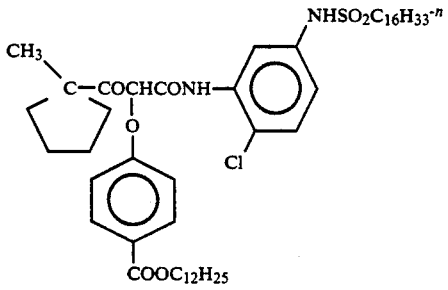
Y-47
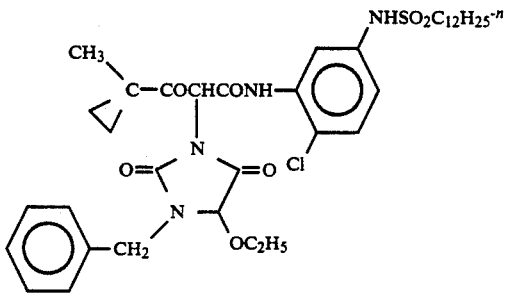
Y-48
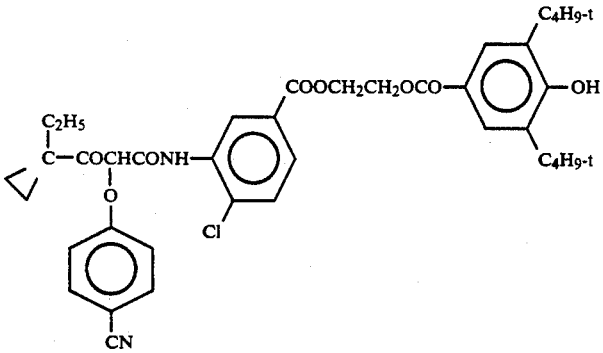
Y-49
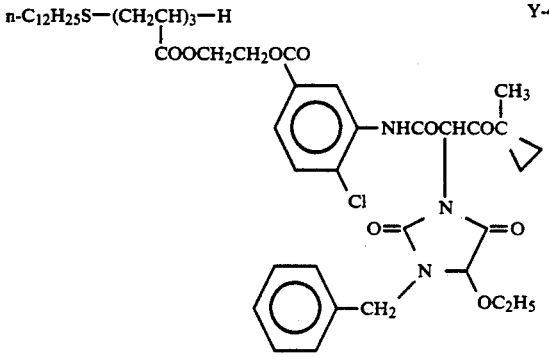
Y-50
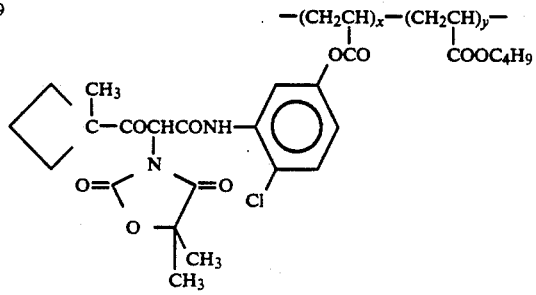
x:y = 50:50 (in weight ratio)

-continued
Y-51
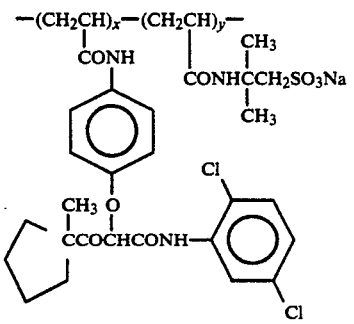
x:y = 80:20 (in weight ratio)
Number average mol. wt.: 70,000
Y-52
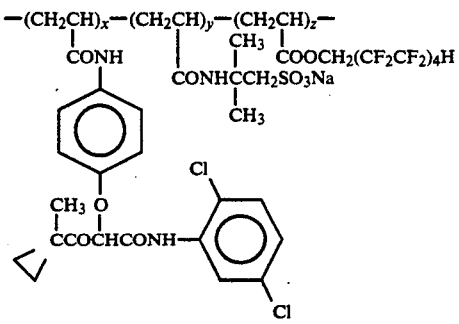
x:y:z = 50:30:20 (in weight ratio)
Number average mol. wt.: 70,000
Y-53
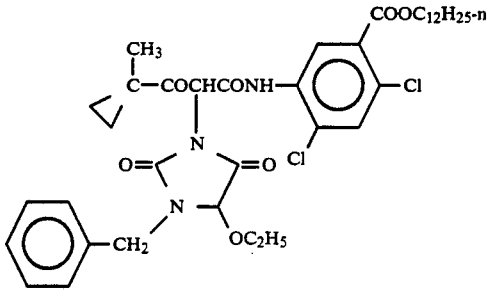
Y-54
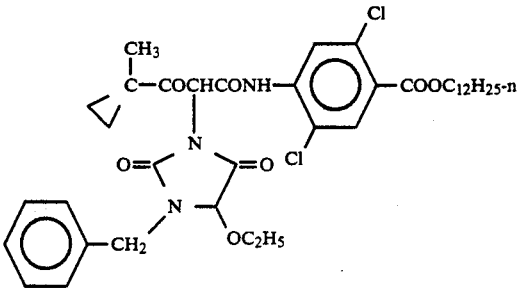
Y-55
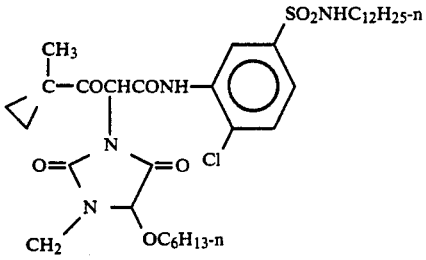
Y-56
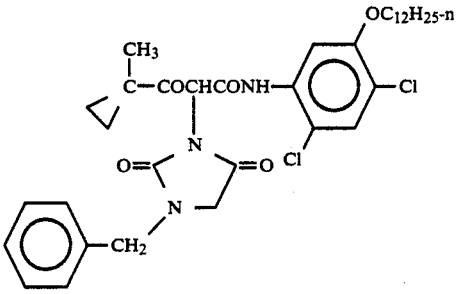
Y-57
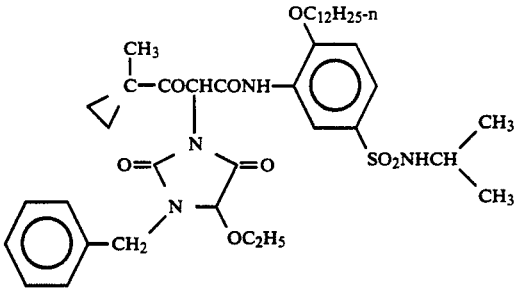
Y-58
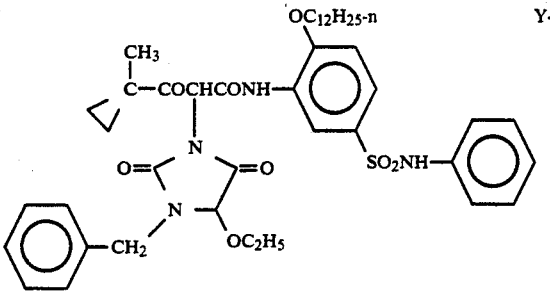
Y-59
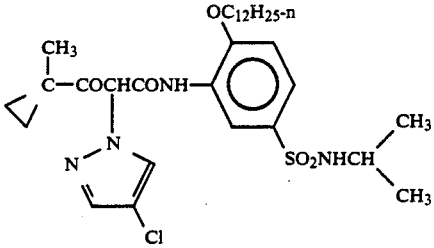

-continued
Y-60
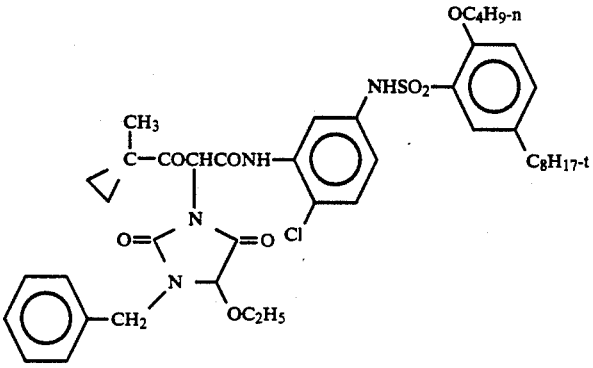
Y-61
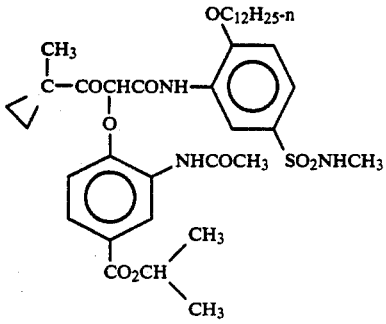
Y-62
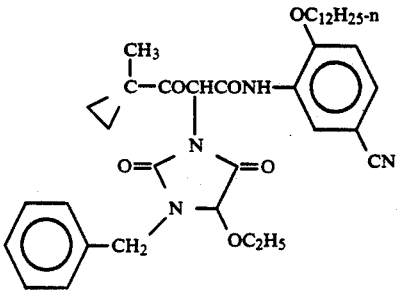
Y-63
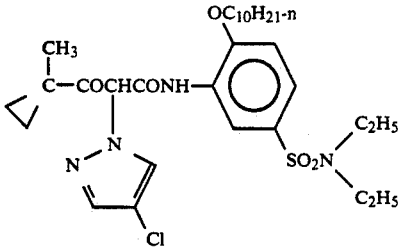
Y-64
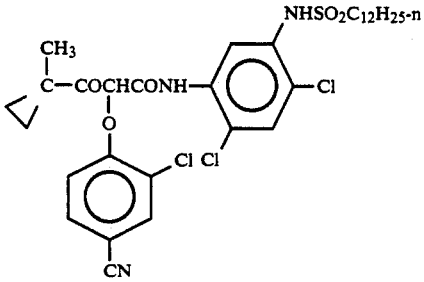
Y-65
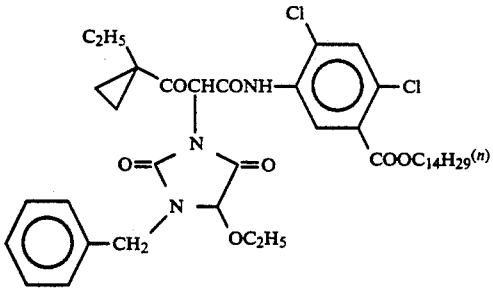
Y-66
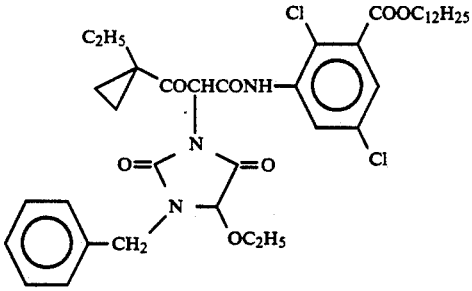
Y-67
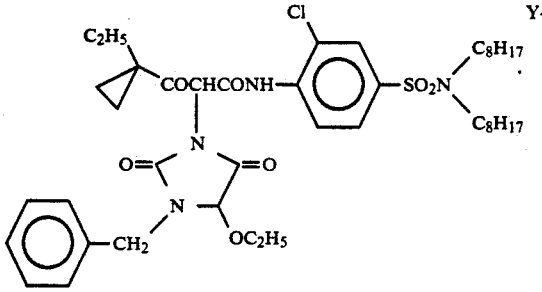
Y-68
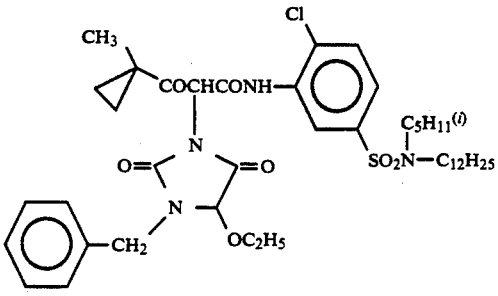

-continued
Y-69
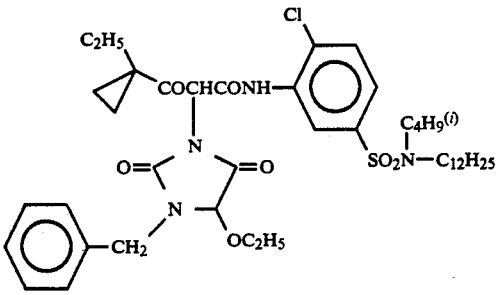
Y-70
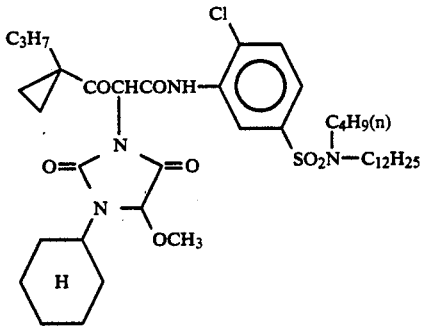
Y-71
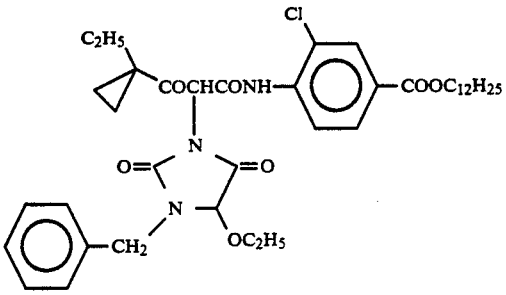
Y-72
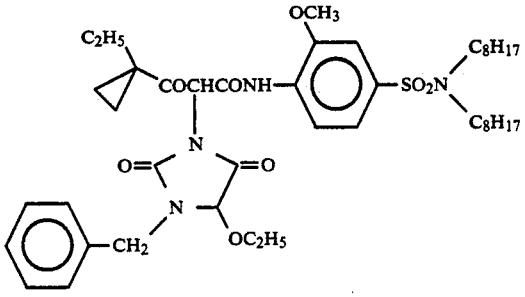
Y-73
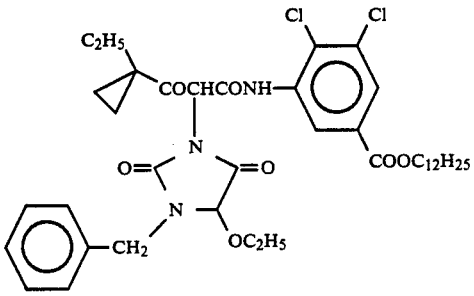
Y-74
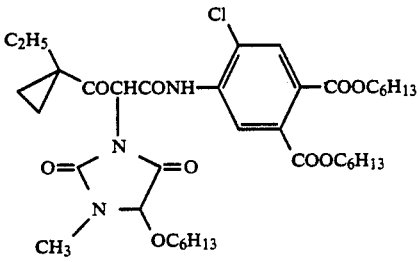
Y-75
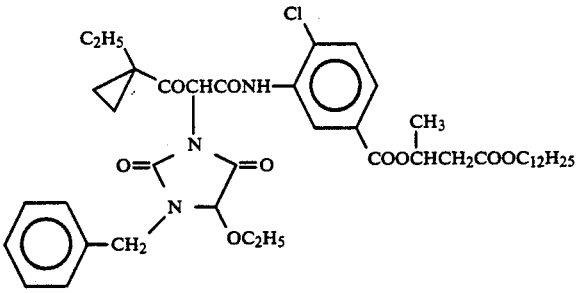
Y-76
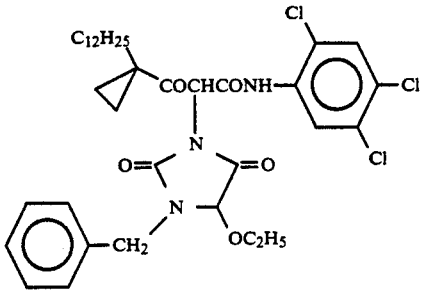

-continued
Y-77
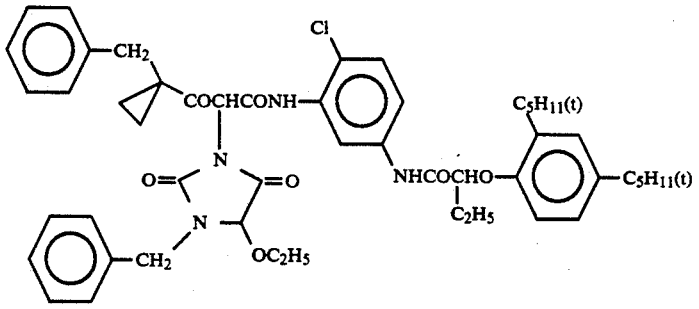
Y-78
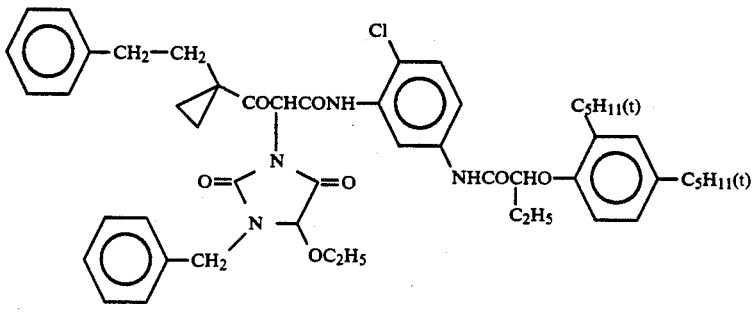
Y-79
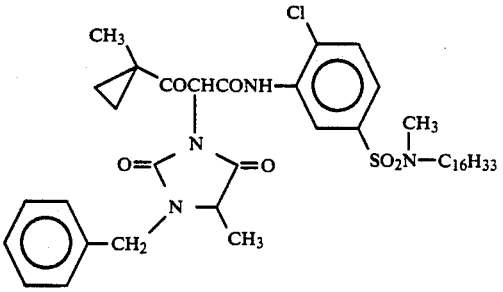
Y-80
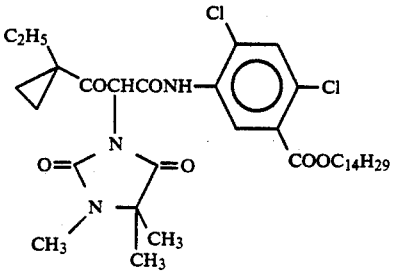
Y-81
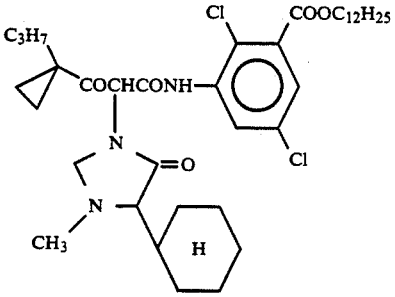
Y-82
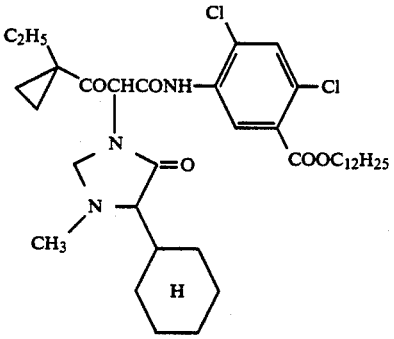
Y-83
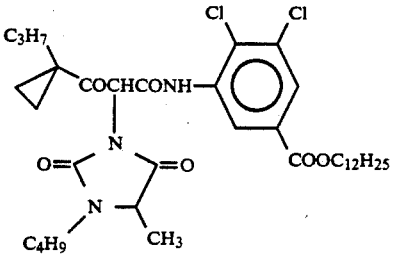
Y-84
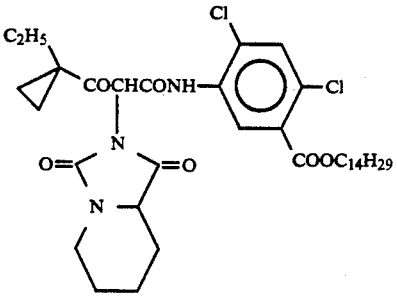
Yellow coupler of the present invention represented by formula (Y) can be synthesized by the synthesis route shown below.

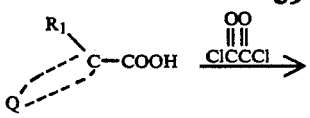

a

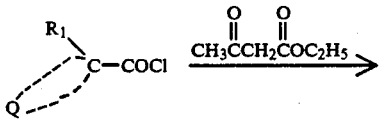

b

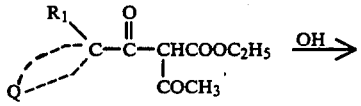

c

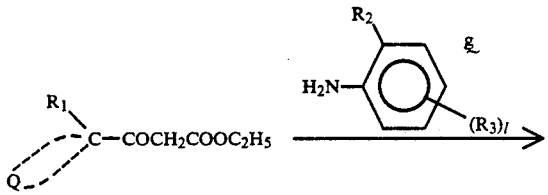

d

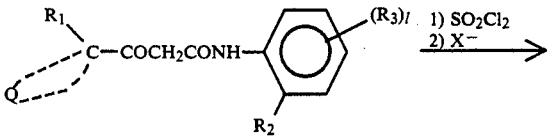

e

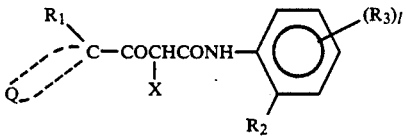

f

The compound a is synthesized by processes described, for example, in *J. Chem. Soc.* (C), 1968, 2548; *J. Am. Chem. Soc.*, 1934, 56, 2710; *Synthesis*, 1971, 258; *J. Org. Chem.*, 1978, 43, 1729, and CA, 1960, 66, 18533y.

The synthesis of the compound b is carried out by a reaction using thionyl chloride, oxalyl chloride, or the like, without any solvent or in a solvent such as methylene chloride, chloroform, carbon tetrachloride, dichloroethane, toluene, N,N-dimethylformamide, and N,N-dimethylacetamide, and the reaction temperature is generally about −20° to 150° C., preferably about −10° to 80° C.

The compound c is synthesized by converting ethyl acetoacetate into an anion by using magnesium methoxide or the like and adding b thereinto. The reaction is carried out without any solvent or using tetrahydrofuran, ethyl ether, or the like, and the reaction temperature is generally about −20° to 60° C., preferably about −10° to 30° C. The compound d is synthesized by a reaction using the compound c and as a base aqueous ammonia, an aqueous $NaHCO_3$ solution, an aqueous sodium hydroxide solution, or the like, without any solvent or using a solvent such as methanol, ethanol, and acetonitrile. The reaction temperature is generally about −20° to 50° C., preferably about −10° to 30° C.

The compound e is synthesized by reacting the compounds d and g in the absence of any solvent. The reaction temperature is generally about 100° to 150° C., preferably about 100° to 120° C. If X is not H, after the chlorination or bromination, a coupling split-off group X is introduced to synthesize the compound f. The compound e is converted in a solvent, such as dichloroethane, carbon tetrachloride, chloroform, methylene chloride, and tetrahydrofuran, by sulfuryl chloride, N-chlorosuccinimide, or the like, to the chloro-substituted product, or by bromine, N-bromosuccinimide to the bromo-substituted product. At that time the reaction temperature is about −20° to 70° C., preferably about −10° to 50° C.

Then, the coupler f of the present invention can be obtained by reacting the chloro-substituted product or the bromo-substituted product and the proton adduct H-X of the coupling split-off group in a solvent, such as methylene chloride, chloroform, tetrahydrofuran, acetone, acetonitrile, dioxane, N-methylpyrrolidone, N,N'-dimethylimidazolidine-2-one, N,N-dimethylformamide, and N,N-dimethylacetamide, at a reaction temperature of about −20° to 150° C., preferably about −10° to 100° C. At that time a base, such as triethylamine, N-ethylmorpholine, tetramethylguanidine, potassium carbonate, sodium hydroxide, and sodium hydrogen carbonate, may be used.

Now, Synthesis Examples of couplers of the present invention will be described.

SYNTHESIS EXAMPLE 1

Synthesis of Exemplified Compound Y-30

38.1 g of oxyalyl chloride was added dropwise to a mixture of 25 g of 1-methylcyclopropanecarboxylic acid synthesized according to the method described by Gotkis, D., et al. in *J. Am. Chem. Soc.*, 1934, 56, 2710, 100 ml of methylene chloride, and 1 ml of N,N-dimethylformamide over 30 min at room temperature. After the addition, the reaction was continued for 2 hours at room temperature and then the methylene chloride and excess oxalyl chloride were removed under reduced pressure by an aspirator, thereby obtaining an oil of 1-methylcyclopropanecarbonyl chloride.

100 ml of methanol was added dropwise to a mixture of 6 g of magnesium and 2 ml of carbon tetrachloride over 30 min at room temperature, and after the mixture was refluxed for 2 hours by heating, 32.6 g of ethyl 3-oxobutyrate was added dropwise over 30 min under heating and reflux. After the addition, the heating was continued for 2 hours and then the methanol was distilled off completely under reduced pressure by an aspirator. 100 ml of tetrahydrofuran was added to the reaction product to disperse the reaction product, and the previously prepared 1-methylcyclopropanecarbonyl chloride was added dropwise at room temperature. After the reaction was continued for 30 min, the reaction liquid was subjected to extraction with 300 ml of ethyl acetate and a dilute aqueous sulfuric acid solution, then after washing with water, the organic layer was dried over anhydrous sodium sulfate and the solvent was distilled off, thereby obtaining 55.3 g of an oil of ethyl 2-(1-methylcyclopropanecarbonyl)-3-oxobutyrate.

While a solution of 55 g of the ethyl 2-(1-methylcyclopropanecarbonyl)-3-oxobutyrate and 160 ml of ethanol was stirred, 60 ml of 30% aqueous ammonia was added dropwise thereto over 10 min. Thereafter, stirring was continued for 1 hour, extraction with 300 ml of ethyl acetate and a dilute aqueous hydrochloric acid solution was carried out, and after neutralization and washing with water, the organic layer was dried over anhydrous sodium sulfate and the solvent was distilled off, thereby obtaining 43 g of an oil of ethyl (1-methylcyclopropanecarbonyl)acetate.

34 g of the ethyl (1-methylcyclopropanecarbonyl-)acetate and 44.5 g of N-(3-amino-4-chlorophenyl)-2-(2,4-di-t-pentylphenoxy)butaneamide were heated under reflux and reduced pressure by an aspirator with the internal temperature kept at 100° to 120° C. After the reaction was continued for 4 hours, the reaction liquid was purified by column chromatography using a mixed solvent of n-hexane and ethyl acetate, thereby obtaining 49 g of a viscous oil of Exemplified Compound Y-30. The structure of the compound was identified by MS spectrum, NMR spectrum, and elemental analysis.

SYNTHESIS EXAMPLE 2

Synthesis of Exemplified Compound Y-1

22.8 g of the Exemplified Compound Y-30 was dissolved in 300 ml of methylene chloride, and 5.4 g of sulfuryl chloride was added to the solution over 10 min under cooling with ice. After the reaction had continued for 30 min, the reaction liquid was washed well with water, dried over anhydrous sodium sulfate, and condensed, thereby obtaining the chloride of the Exemplified Compound Y-30. The solution of the thus obtained chloride of the Exemplified Compound Y-30 was dissolved in 50 ml of N,N-dimethylformamide and was added dropwise to a solution of 18.7 g of 1-benzyl-5-ethoxyhydantoin in 11.2 ml of triethylamine and 50 ml of N,N-dimethylformamide over 30 min at room temperature.

Thereafter the reaction was allowed to continue for 4 hours at 40° C., and after the reaction liquid was extracted with 300 ml of ethyl acetate, thereafter washed with water and then washed with 300 ml of a 2% aqueous triethylamine solution. This was followed by neutalization with a dilute aqueous hydrochloric acid solution. After the organic layer was dried over anhydrous sodium sulfate, the solvent was distilled off, to obtain an oil, and the oil was subjected to crystallization from a mixed solvent of n-hexane and ethyl acetate. The deposited crystals were washed with a mixed solvent of n-hexane and ethyl acetate and then dried, to obtain 22.8 of crystals of the Exemplified Compound Y-1.

The structure of the compound was identified by MS spectrum, NMR spectrum, and elemental analysis. The melting point was 132° to 133° C.

The amount of the coupler of the present invention to be used is such that preferably $1\times10^{-3}$ mol to 2 mol, more preferably $2\times10^{-2}$ to 0.6 mol, per mol of the silver halide in the photosensitive layer in which the coupler is added.

To introduce the coupler of the present invention represented by formula (I) and couplers and other lipophilic photographic organic compounds that can be used in the present photographic material that are described later into the photographic material, various known dispersing techniques are used.

In the oil-in-water dispersion method described in U.S. Pat. No. 2,322,027, lipophilic photographic organic compounds are dissolved in a high-boiling organic solvent that has a boiling point of about 175° C. or over under normal pressures, such as phthalates, phosphates, benzoates, fatty esters, amides, phenols, alcohols, carboxylic acids, N,N-dialkylanilines, hydrocarbons, oligomers and polymers, and/or a low-boiling organic solvent that has a boiling point of about 30° C. to about 160° C. under normal pressures, such as esters (e.g., ethyl acetate, butyl acetate, ethyl propionate, β-ethoxyethyl acetate, and methyl cellosolve acetate), alcohols (e.g., secondary butyl alcohol), ketones (e.g., methyl isobutyl ketone, methyl ethyl ketone, and cyclohexanone), amides (e.g., dimethylformamide and N-methylpyrrolidone), and ethers (e.g.. tetrahydrofuran and dioxane), and then the lipophilic photographic organic compounds are emulsified and dispersed into a hydrophilic colloid, such as gelatin.

Steps of latex dispersion method, their effects, and specific examples of latices for impregnation are described, for example, in U.S. Pat. No. 4,199,363, West German Patent Application (OLS) Nos. 2,541,274 and 2,541,230, and European Patent No. 294,104A. These high-boiling organic solvents and latices not only function simply as a dispersing medium, they also can provide various functions, by selecting the structure thereof, for example, to improve the physical properties of the gelatin coating, to accelerate the color formation, to adjust the hue of the color formed image dye, and to improve the fastness of the image dye. The high-boiling organic solvent may be in the form of any of a liquid, a wax, or a solid, and preferably the high-boiling organic solvent is represented by the following formulae (S-1) to (S-9):

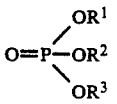
Formula (S-1)

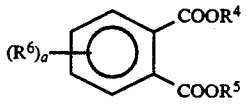
Formula (S-2)

$(Ar-COO\rangle_b R^7$ Formula (S-3)

$(R^8-COO\rangle_c R^9$ Formula (S-4)

$R^{10}\langle COO-R^{11})_d$ Formula (S-5)

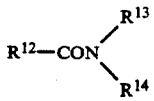
Formula (S-6)

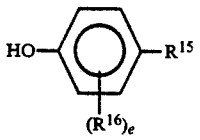
Formula (S-7)

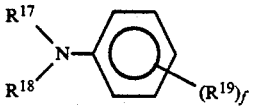
Formula (S-8)

$-(A_1)_{a1}-(A_2)_{a2}-\cdots-(A_n)_{an}-$ Formula (S-9)

In formula (S-1), $R^1$, $R^2$, and $R^3$ each independently represent an alkyl group, a cycloalkyl group, or an aryl group.

In formula (S-2), $R^4$ and $R^5$ each independently represents an alkyl group, a cycloalkyl group, or an aryl group, $R^6$ represents a halogen atom (e.g., F, Cl, Br, and I, hereinafter the same being applied), an alkyl group, an alkoxy group, an aryloxy group, or an alkoxycarbonyl group, a is an integer of 0 to 3, and if a is 2 or 3, the $R^6$ groups may be the same or different.

In formula (S-3), Ar represents an aryl group, b is an integer of 1 to 6, and $R^7$ represents a b-valent hydrocarbon group or hydrocarbon groups bonded together through an ether linkage.

In formula (S-4), $R^8$ represents an alkyl group or a cycloalkyl group, c is an integer of 1 to 6, and $R^9$ represents a c-valent hydrocarbon group or hydrocarbon groups bonded together through an ether linkage.

In formula (S-5), d is an integer of 2 to 6, $R^{10}$ represents a d-valent hydrocarbon group excluding aromatic groups, and $R^{11}$ represents an alkyl group, a cycloalkyl group, or an aryl group.

In formula (S-6), $R^{12}$, $R^{13}$, and $R^{14}$ each independently represents an alkyl group, a cycloalkyl group, or an aryl group and $R^{12}$ and $R^{13}$ or $R^{13}$ and $R^{14}$ may bond together to form a ring.

In formula (S-7), $R^{15}$ represents an alkyl group, a cycloalkyl group, an alkoxycarbonyl group, an alkylsulfonyl group, an arylsulfonyl group, an aryl group, or a cyano group, $R^{16}$ represents a halogen atom, an alkyl group, a cycloalkyl group, an aryl group, an alkoxy group, or an aryloxy group, e is an integer of 0 to 3, and if e is 2 or 3, the $R^{16}$ groups may be the same or different.

In formula (S-8), $R^{17}$ and $R^{18}$ each independently represent an alkyl group, a cycloalkyl group, or an aryl group, $R^{19}$ represents a halogen atom, an alkyl group, a cycloalkyl group, an aryl group, an alkoxy group, or an aryloxy group, f is an integer of 0 to 4, and if f is an integer of 2 to 4, the $R^{19}$ groups may be the same or different.

In formula (S-9), $A_1$, $A_2$, . . . , and $A_n$ each represent a polymerization unit given by a non-colorforming ethylenically-unsaturated monomer, $a_1$, $a_2$, . . . , and $a_n$ each represent the weight percentage of the polymerization unit, and n is an integer of 1 to 30.

Specific examples of high-boiling organic solvents used in the present invention are shown below:

S-1

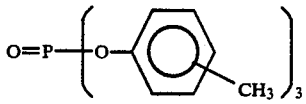

S-2

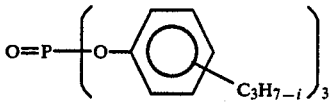

S-3

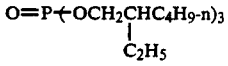

S-4

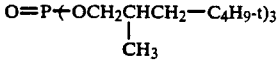

-continued

S-5

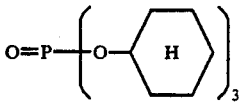

S-6

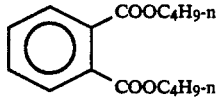

S-7

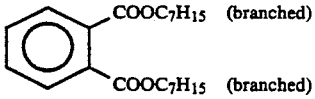

S-8

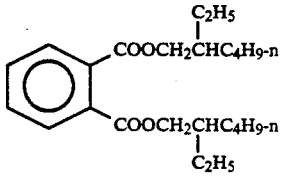

S-9

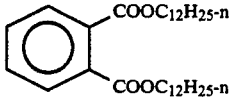

S-10

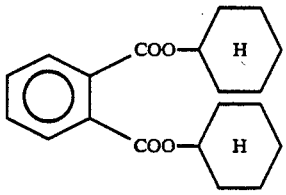

S-11

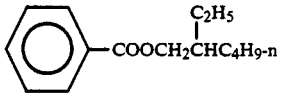

S-12

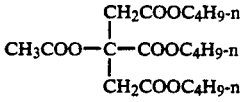

S-13

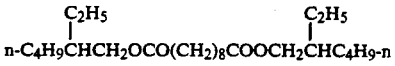

S-14

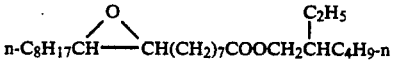

S-15

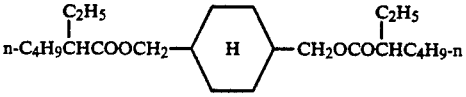

S-16

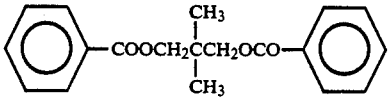

S-17

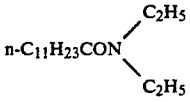

-continued

S-18

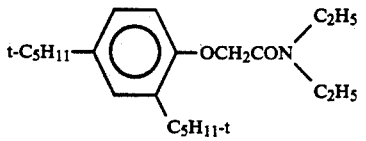

S-19

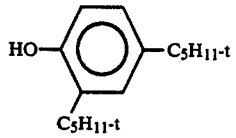

S-20

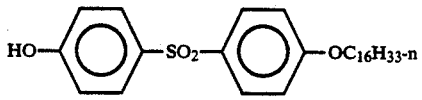

S-21

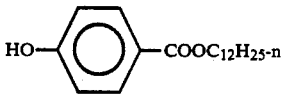

S-22

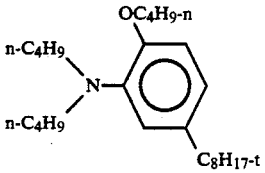

S-23

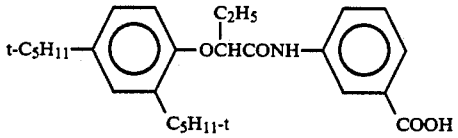

S-24 Poly(methyl methacrylate)
(average molecular weight: 20,000)

S-25 Poly(N-t-butylacrylamide)
(average molecular weight: 60,000)

S-26 Chlorinated paraffin
(mean composition: $C_{12}H_{18}Cl_8$)

Examples of compounds other than the above high-boiling organic solvents used in the present invention and/or methods for synthesizing these high-boiling organic solvents are described in, for example, U.S. Pat. Nos. 2,322,027, 2,533,514, 2,772,163, 2,835,579, 3,676,137, 3,912,515, 3,936,303, 4,080,209, 4,127,413, 4,193,802, 4,239,851, 4,278,757, 4,363,873, 4,483,918, and4,745,049, European Patent No. 276,319A, and JP-A Nos. 47335/1973, 149028/1976, 84641/1986, 118345/1987, 247364/1987, 167357/1988, 68745/1989, and 101543/1989.

The amount of the high-boiling organic solvent of the present invention to be used is 0.3 or below in terms of weight ratio to the coupler used in each photosensitive layer. The weight ratio is preferably 0.1 or below in view of the effect of the improvement in sharpness. Of course it is also possible not to use any high-boiling organic solvent at all.

Roughly speaking, the thickness of film can be lessened to about $\frac{2}{3}$ by lowering the ratio of oil/coupler from 1.0 to 0.3.

From a practical standpoint, reduction of film thickness from 2.0 μm to 1.6 μm by lowering the ratio of oil/coupler from 0.4 to 0.1 has a big significance.

It is sufficient that the photographic material of the present invention has on a base at least one silver halide emulsion layer of a blue-sensitive layer, a green-sensitive layer, or a red-sensitive layer, and there is no particular restriction on the number of silver halide emulsion layers and nonsensitive layers or on the order of the layers. A typical example is a silver halide photographic material having on a base at least one photosensitive layer comprising multiple silver halide emulsion layers that have substantially the same color sensitivity but are different in photographic sensitivity, wherein said photosensitive layer is a unit photosensitive layer having color sensitivity to any one of blue light, green light, and red light. In the case of a multilayer silver halide color photographic material, generally the arrangement of unit photosensitive layers is such that a red-sensitive layer, a green-sensitive layer, and a blue-sensitive layer are placed in the stated order from the base side. However, the order of the arrangement may be reversed in accordance with the purpose, and between layers having the same color sensitivity there may be placed a different photosensitive layer.

A nonsensitive layer, such as various intermediate layers, may be placed between or on top of or beneath the above-mentioned silver halide photosensitive layers.

Said intermediate layers may contain couplers and DIR compound as described, for example, in JP-A Nos. 43748/1986, 113438/1984, 113440/1984, 20037/1986, and 20038/1986, and also color mixing inhibitors as usualy used.

Multiple silver halide emulsion layers constituting each unit photosensitive layer are preferably made up of two layers, i.e., a high-speed emulsion layer and a low-speed emulsion layer, as described, for example, in West German Patent No. 1,121,470 or British Patent No. 923,045. Generally, preferably the order of the layers is such that the sensitivities decrease successively toward the base, and a nonsensitive layer may be placed between halogen emulsion layers. A low-speed emulsion layer may be placed away from the base and a high-speed emulsion layer may be placed near the base, as described, for example, in JP-A Nos. 112751/1982, 200350/1987, 206541/1987, and 206543/1987.

In a specific example, a low-speed blue-sensitive layer (BL), a high-speed blue-sensitive layer (BH), a high-speed green-sensitive layer (GH), a low-speed green-sensitive layer (GL), a high-speed red-sensitive layer (RH), and a low-speed red sensitive layer (RL), or BH, BL, GL, GH, RH, and RL, or RH, BL, GH, GL, RL, and RH are arranged in the stated order toward a base.

As described in JP-B ("JP-B" means examined Japanese patent publication) No. 34932/1980, a blue-sensitive layer, GH, RH, GL, and RL may be arranged in the stated order toward a base. Also, as described in JP-A Nos. 25738/1981 and 63936/1987, a blue-sensitive layer, GL, RL, GH, and RH are arranged in the stated order toward a base.

Also, as described in JP-B No. 15495/1974, an arrangement having three layers whose sensitivities are different and are decreased successively toward a base can be mentioned, wherein the top layer comprises a silver halide emulsion layer highest in sensitivity, the intermediate layer comprises a silver halide emulsion layer lower in sensitivity than the top layer, and the bottom layer comprises a silver halide emulsion layer lower in sensitivity than the intermediate layer. Even in such a case comprising three layers different in sensitivity, a medium-speed emulsion layer, a high-speed emulsion layer, and a low-speed emulsion layer may be arranged in the same color-sensitive layer in the stated order toward a base, as described in JP-A No. 202464/1984.

Further, for example, a high-speed emulsion layer, a low-speed emulsion layer, and an medium-speed emulsion layer, or a low-speed emulsion layer, a medium-speed emulsion layer, and a high-speed emulsion layer may be arranged in the stated order.

If there are more than three layers, the arrangement may be changed as described above.

As stated above, various layer constitutions and arrangements can be chosen in accordance with the purpose of each photographic material.

A preferable silver halide to be contained in the photographic emulsion layer of the photographic material used in the present invention is silver bromoiodide, silver chloroiodide, or silver bromochloroiodide containing up to about 30 mol % of silver iodide, particularly preferably silver bromochloroiodide containing about 2 to about 10 mol % of silver iodide.

The silver halide grains in the photographic emulsion may have a regular crystal form, such as a cubic shape, an octahedral shape, and a tetradecahedral shape, or a regular crystal shape, such as spherical shape or a tabular shape, or they may have a crystal defect, such as twin planes, or they may have a composite crystal form.

The silver halide grains may be fine grains having a diameter of about 0.2 μm or less, or coarse grains with the diameter of the projected area being down to about 10 μm. As a silver halide emulsion, a polydisperse emulsion or a monodisperse emulsion can be used.

The silver halide photographic emulsions that can be used in the present invention may be prepared suitably by known means, for example, by the methods described in *I. Emulsion Preparation and Types,* in *Research Disclosure* (RD) No. 17643 (December 1979), pp. 22–23, and ibid. No. 18716 (November 1979), p. 648, and ibid. No. 307105 (November, 1989), pp. 863–865; the methods described in P. Glafkides, *Chimie et Phisique Photographique,* Paul Montel (1967), in G. F. Duffin, *Photographic Emulsion Chemistry,* Focal Press (1966), and in V. L. Zelikman et al., *Making and Coating of Photographic Emulsion,* Focal Press (1964).

A monodisperse emulsion, such as described in U.S. Pat. Nos. 3,574,628 and 3,655,394, and in British Patent No. 1,413,748, is also preferable.

Tabular grains having an aspect ratio of 3 or greater can be used in the emulsion of the present invention. Tabular grains can be easily prepared by the methods described in, for example, Gutoof, *Photographic Science and Engineering,* Vol. 14, pp. 248–257 (1970), U.S. Pat. Nos. 4,434,226, 4,414,310, 4,433,048, and 4,439,520, and British Patent No. 2,112,157.

The crystal structure of silver halide grains may be uniform, the outer halogen composition of the crystal structure may be different from the inner halogen composition, or the crystal structure may be layered. Silver halides whose compositions are different may be joined by the epitaxial joint, or a silver halide may be joined, for example, to a compound other than silver halides, such as silver rhodanide, lead oxide, etc.

Although the above-described emulsions may be either a surface latent image-type that forms latent image mainly on the surface, an internal latent image-type that forms latent image at the inner part of grain, or a type that forms latent image both on the surface and at the inner part of grain, it is necessary to be a negative-type emulsion. Of internal latent image-type emulsions, an internal latent image-type emulsion of core/shell-type grain may be used. The preparation method of such internal latent image-type emulsion of core/shell-type grain is described in JP-A No. 133542/1984. The thickness of shell in such emulsion may be different according to a development process or the like, but a range of 3 to 40 nm is preferable, and a range of 5 to 20 nm is particularly preferable.

The silver halide emulsion may generally be physically ripened, chemically ripened, and spectrally sensitized. Additives that will be used in these steps are described in *Research Disclosure* No. 17643, ibid. No. 18716 and ibid. No. 307105, and involved sections are listed in the Table shown below.

In the photographic material of the present invention, two or more kinds of emulsions in which at least one of characteristics, such as grain size of photosensitive silver halide emulsion, distribution of grain size, composition of silver halide, shape of grain, and sensitivity is different each other can be used in a layer in a form of mixture.

Silver halide grains the surface of which has been fogged as described in, for example, U.S. Pat. No. 4,082,553, and silver halide grains or colloidal silver grains the inner part of which has been fogged as described in, for example, U.S. Pat. No. 4,626,498 and JP-A No. 214852/1984 may be preferably used in a photosensitive silver halide emulsion layer and/or a substantially non-photosensitive hydrophilic colloid layer. "Silver halide emulsion the surface or inner part of which has been fogged" means a silver halide emulsion capable of being uniformly (non-image-wisely) developed without regard to unexposed part or exposed part to light of the photographic material. The method for preparing a silver halide emulsion the surface or inner part of which has been fogged are described in, for example, U.S. Pat. No. 4,626,498 and JP-A No. 214852/1984.

The silver halide composition forming inner nucleus of core/shell-type silver halide grain the inner part of which has been fogged may be the same or different. As a silver halide grain the surface or inner part of which has been fogged, any of silver chloride, silver chlorobromide, silver chloroiodobromide can be used. Although the grain size of such silver halide grains which has been fogged is not particularly restricted, the average grain size is preferably 0.01 to 0.75 μm, particularly preferably 0.05 to 0.6 μm. Further, the shape of grains is not particularly restricted, a regular grain or an irregular grain can be used, and although it may be a polydisperse emulsion or a monodisperse emulsion, a monodisperse emulsion (that contains at least 95% of silver halide grains in weight or in number of grains having grain diameter within ±40% of average grain diameter) is preferable.

In the present invention, it is preferable to use a non-photosensitive fine grain silver halide. "Non-photosensitive fine grain silver halide" means a silver halide grain that does not expose at an imagewise exposure to light to obtain a color image and is not developed substantially at a development processing, and preferably it is not fogged previously.

Fine grain silver halide has a silver bromide content of 0 to 100%, and may contain silver chloride and/or silver iodide, if needed. Preferable ones contain silver iodide of 0.5 to 10 mol %.

The average grain diameter (average diameter of circle corresponding to projected area) of fine grain silver halide is preferably 0.01 to 0.5 μm, more preferably 0.02 to 0.2 μm.

The fine grain silver halide can be prepared in the same manner as an ordinary photosensitive silver halide. In this case, it is not necessary to optically sensitize the surface of the silver halide grain and also spectrally sensitizing is not needed. However, to add previously such a compound as triazoles, azaindenes, benzothiazoliums, and mercapto compounds or a known stabilizing agent, such as zinc compounds, is preferable. Colloidal silver is preferably contained in a layer containing this fine grain silver halide.

The coating amount in terms of silver of photographic material of the present invention is preferably 6.0 g/m$^2$ or below, most preferably 4.5 g/m$^2$ or below.

Known photographic additives that can be used in the present invention are also described in the above-mentioned three Research Disclosures, and involved sections are listed in the same Table below.

| Additive | RD 17643 | RD 18716 | RD 307105 |
|---|---|---|---|
| 1 Chemical sensitizer | p. 23 | p. 648 (right column) | p. 866 |
| 2 Sensitivity-enhancing agent | — | p. 648 (right column) | — |
| 3 Spectral sensitizers and Supertabilizers | pp. 23–24 | pp. 648 (right column)–649 (right column) | pp. 866–868 |
| 4 Brightening agents | p. 24 | p. 647 (right column) | p. 868 |
| 5 Antifogging agents and Stabilizers | pp. 24–25 | p. 649 (right column) | pp. 868–870 |
| 6 Light absorbers, Filter dyes, and UV Absorbers | pp. 25–26 | pp. 649 (right column)–650 (left column) | p. 873 |
| 7 Stain-preventing agent | p. 25 (right column) | p. 650 (left to right column) | p. 872 |
| 8 Image dye stabilizers | p. 25 | p. 650 (left column) | p. 872 |
| 9 Hardners | p. 26 | p. 651 (left column) | pp. 874–875 |
| 10 Binders | p. 26 | p. 651 (left column) | pp. 873–874 |
| 11 Plasticizers and Lubricants Lubricants | p. 27 | p. 650 (right column) | p. 876 |
| 12 Coating aids and Surface-active agents | pp. 26–27 | p. 650 (right column) | pp. 875–876 |
| 13 Antistatic agents | p. 27 | p. 650 (right column) | pp. 876–877 |
| 14 Matting agent | — | — | pp. 878–879 |

Further, in order to prevent the lowering of photographic performances due to formaldehyde gas, a compound described in, for example, U.S. Pat. Nos. 4,411,987 and 4,435,503 that is able to react with formaldehyde to immobilize is preferably added to the photographic material.

In the photographic material of the present invention, a mercapto compound described in, for example, U.S. Pat. Nos. 4,740,454 and 4,788,132, and JP-A Nos. 18539/1987 and 283551/1989 is preferably contained.

In the photographic material of the present invention, a compound that releases a fogging agent, a development accelerator, a solvent for silver halide, or the precursor thereof, independent of the amount of silver formed by a development processing, described in, for example, JP-A No. 106052/1989 is preferably contained.

In the photographic material of the present invention, a dye dispersed by a method described in, for example, International Publication No. WO88/04794 and JP-A No. 502912/1989, or a dye described in, for example, European Patent No. 317,308A, U.S. Pat. No. 4,420,555, and JP-A No. 259358/1989 is preferably contained.

In the present invention, various color couplers can be used, and concrete examples of them are described in patents cited in the above-mentioned *Research Disclosure* No. 17643,VVII-C to G, and ibid. No. 307105, VII-C to G.

As yellow couplers to be used in combination other than couplers represented by formula (I), couplers described in, for example, U.S. Pat. Nos. 3,933,501, 4,022,620, 4,326,024, 4,401,752, and 4,248,961, JP-B No. 10739/1983, British Patent Nos. 1,425,020 and 1,476,760, U.S. Pat. Nos. 3,973,968, 4,314,023, and 4,511,649, and European Patent No. 249,473A are preferable.

As magenta couplers, various pyrazolone-type magenta couplers and pyrazoloazole-series magenta couplers are preferably used. As pyrazolone-type magenta couplers, couplers described in, for example, U.S. Pat. Nos. 4,310,619 and 4,351,897, European Patent No. 73,636, U.S. Pat. Nos. 3,061,432 and 3,725,067, JP-A Nos. 35730/1985, 118034/1980, and 185951/1985, U.S. Pat. No. 4,556,630, and International Publication No. WO88/04795 are preferable, in particular.

As preferable pyrazoloazole-series magenta couplers for use in the present invention, magenta couplers represented by the following formula (II) can be mentioned:

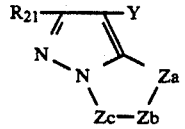

Formula (II)

wherein $R_{21}$ represents a hydrogen atom or a substituent, Y represents a hydrogen atom or a group capable of being released, Za, Zb and Zc each represent a methine, substituted methine, =N—, or —NH—, provided that one of Za—Zc bond and Zb—Zc bond is a double bond, another is a single bond, and when the Zb—Zc bond is a carbon—carbon double bond, it may be part of an aromatic ring.

Pyrazoloazole couplers represented by the above-described formula (II) are known couplers, and, of the pyrazoloazole couplers, imidazo [1,2-b]pyrazoles described in U.S. Pat. No. 4,500,630 are preferable in view of reduced yellow subsidiary absorption of the colored dye and light-fastness, pyrazolo[1,5-b][1,2,4]triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1986, pyrazoloazole couplers containing a sulfonamido group in the molecular, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group at the 6-position, as described in European Patent Nos. 226,849 and 294,785, is preferable.

Concrete examples of coupler represented by formula (II) are shown below.

M-1

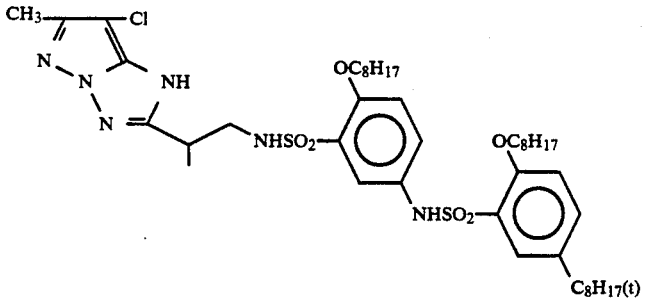

M-2

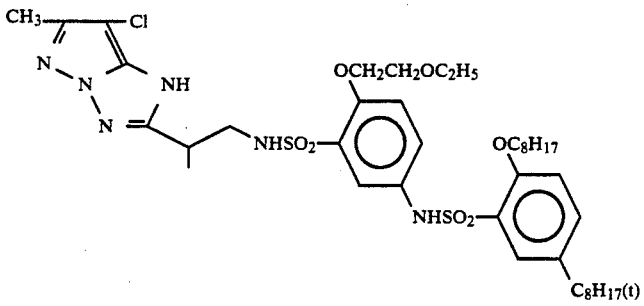

M-3

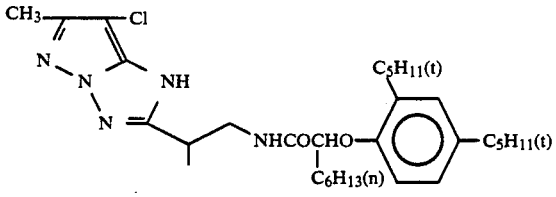

M-4

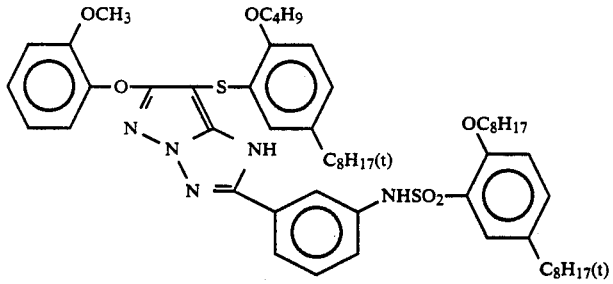

M-5

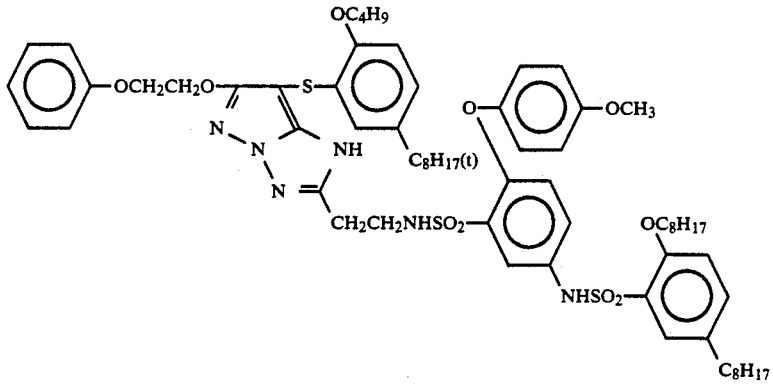

-continued
M-6
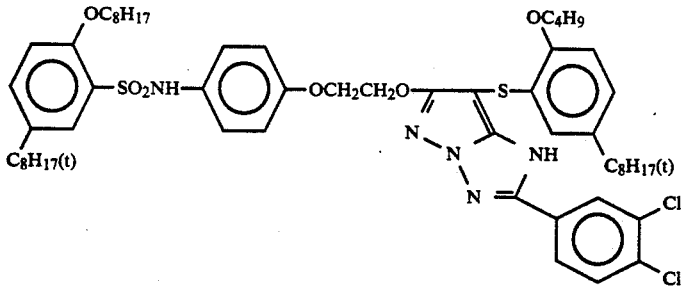
M-7
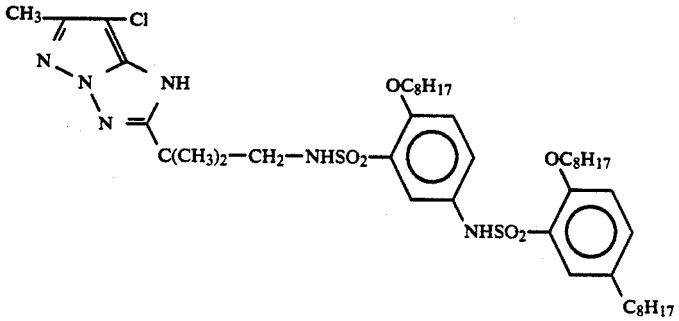
M-8
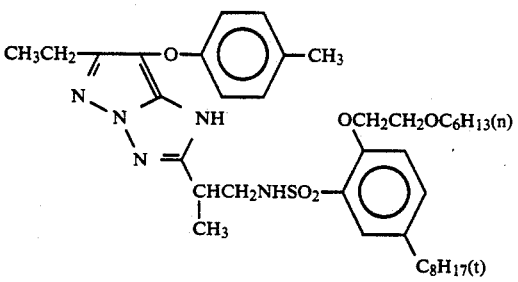
M-9
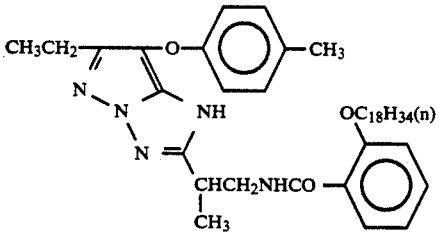
M-10
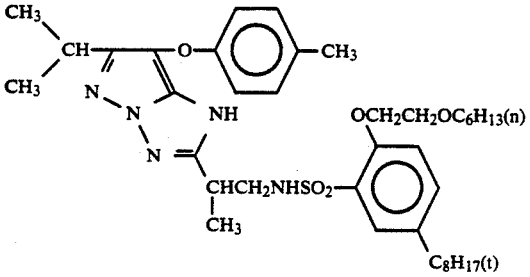

-continued
M-11
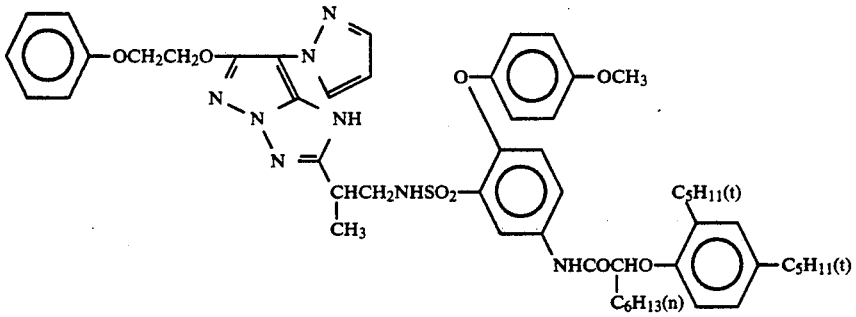
M-12
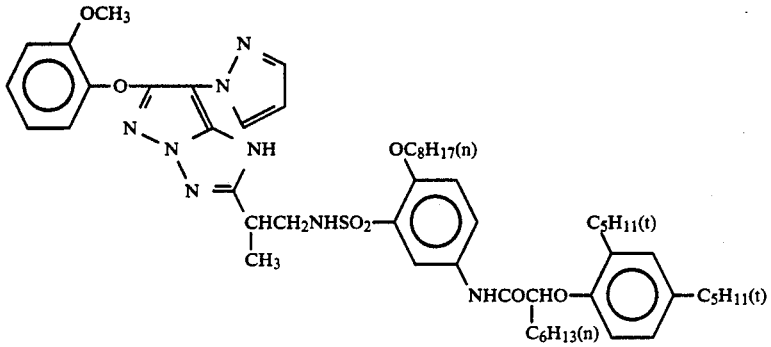
M-13
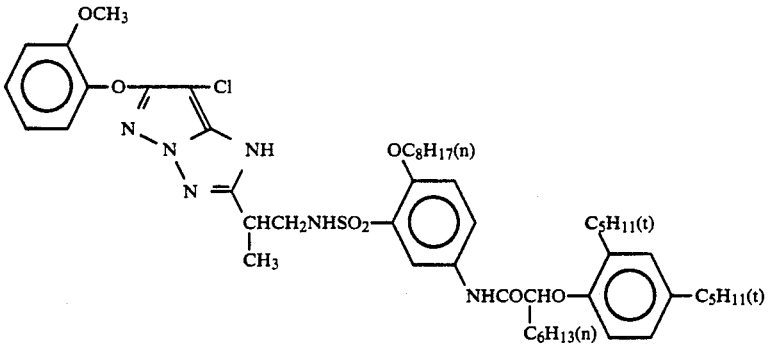
M-14
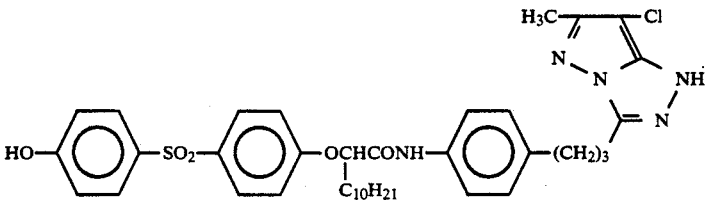
M-15
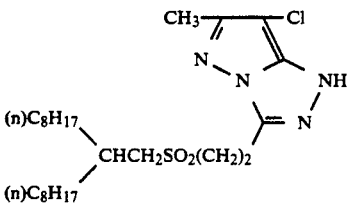

-continued

M-16

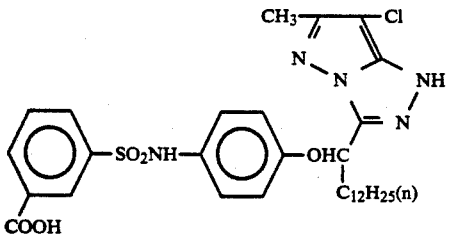

M-17

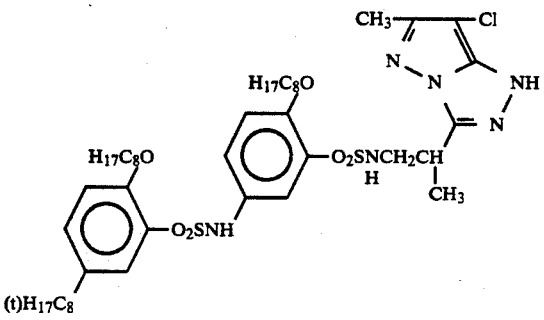

M-18

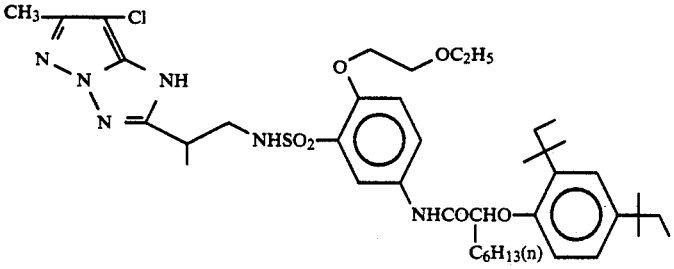

M-19

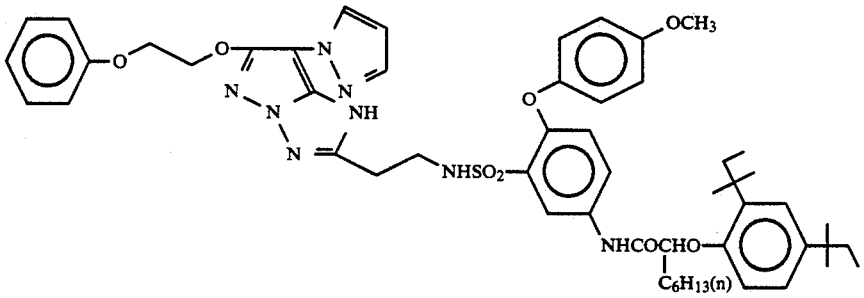

As cyan couplers, phenol-type couplers and naphthol-type couplers can be mentioned, and those described in U.S. Pat. Nos. 4,052,212, 4,145,396, 4,228,233, 4,296,200, 2,369,929, 2,801,171, 2,772,162, 2,895,826, 3,772,002, 3,756,308, 4,334,011, and 4,327,173, West German Patent Application (OLS) No. 3,329,729, EP Nos. 121,365A and 249,453A, U.S. Pat. Nos. 3,446,622, 4,333,999, 4,775,616, 4,451,559, 4,427,767, 4,690,889, 4,254,212, and 4,296,199, and JP-A No. 42685/1986 are more preferable.

Of those, particularly preferable ones are ureid-type cyan couplers represented by formula (III) and 5-amidonaphthol-type cyan couplers represented by formula (IV):

Formula (III)

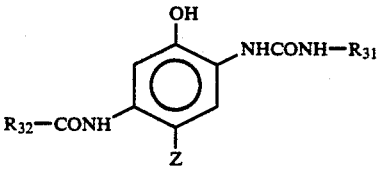

wherein $R_{31}$ represents a substituted or unsubstituted aryl group, $R_{32}$ represents a substituted or unsubstituted alkyl group, aryl group, cycloalkyl group, or heterocyclic residue, and Z represents a hydrogen atom or a group capable of being released upon a coupling reaction.

Concrete examples of cyan coupler represented by formula (III) are shown below, but the present invention is not limited by them.

C-1
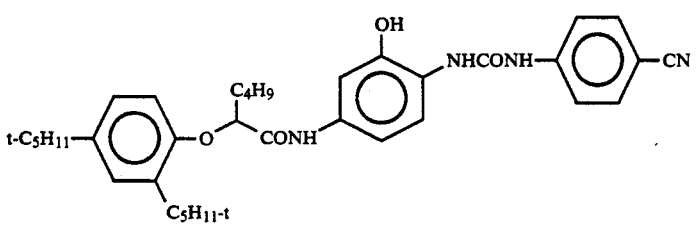
C-2
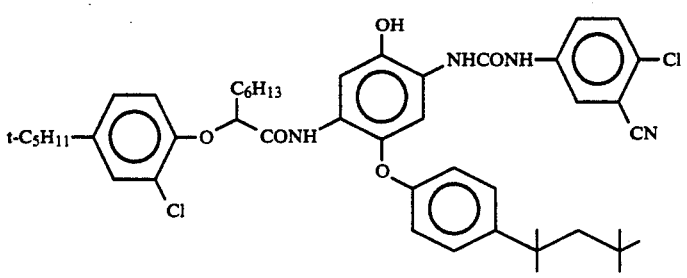
C-3
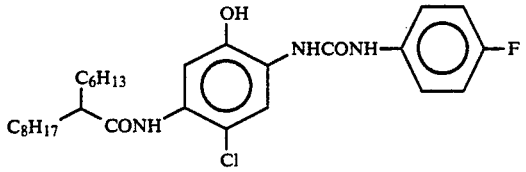
C-4
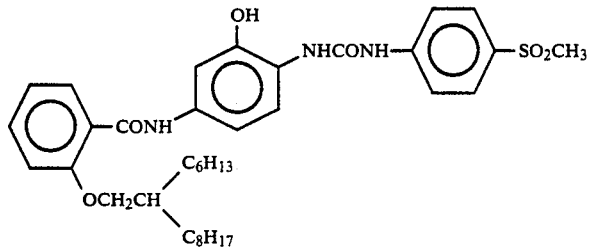
C-5
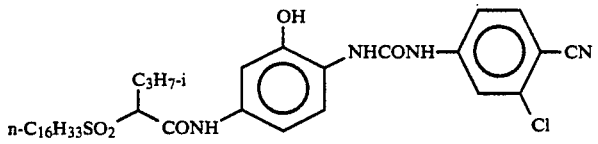
C-6
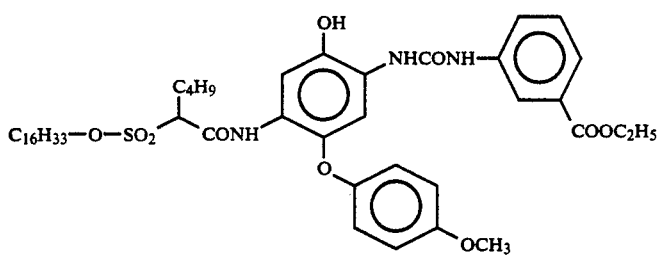
C-7
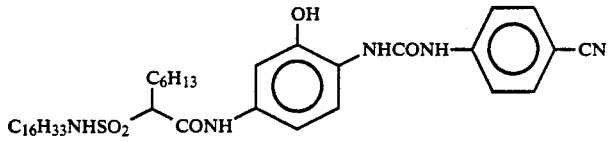

-continued
C-8
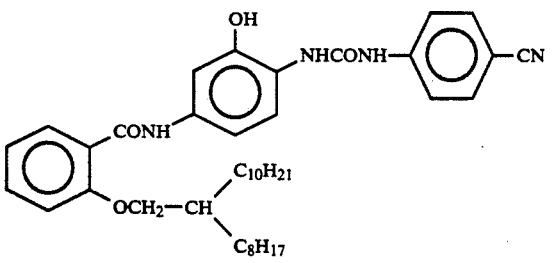
C-9
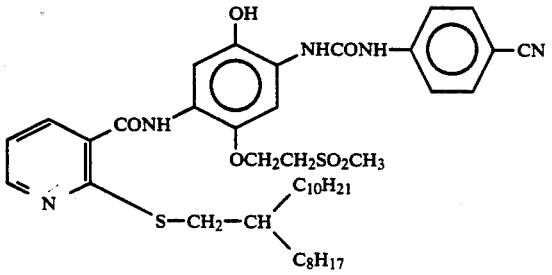
C-10
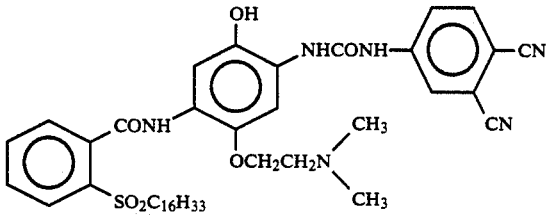
C-11
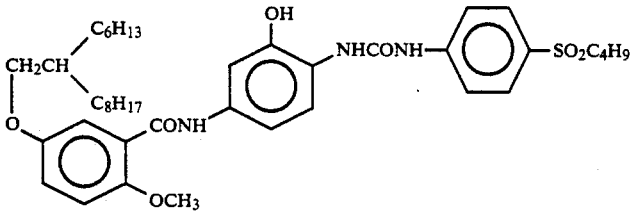
C-12
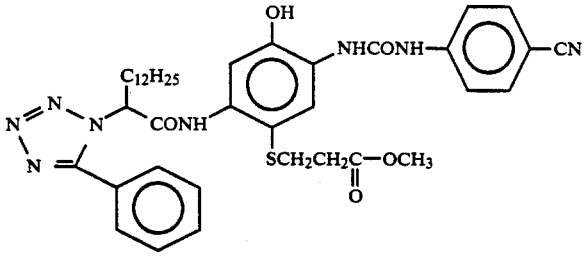
C-13
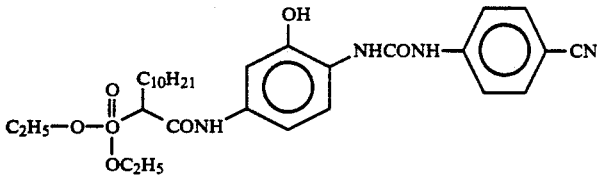
C-14
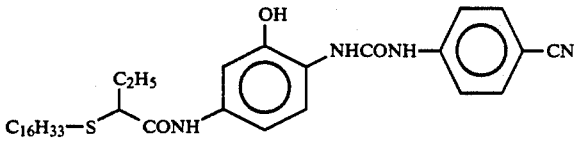

-continued

C-15

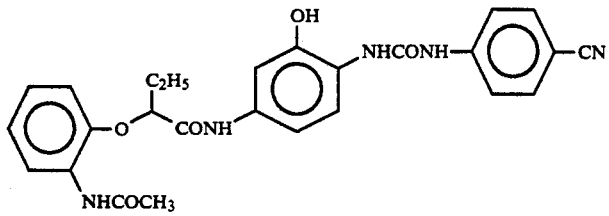

C-16

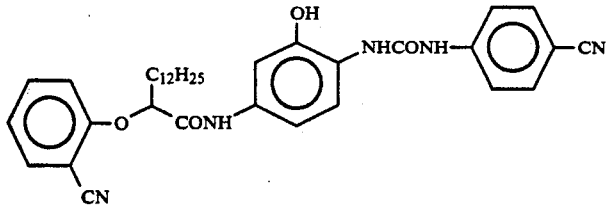

Formula (IV)

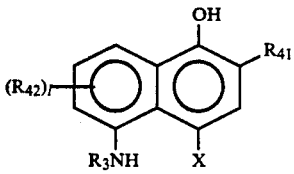

in formula (IV), $R_{41}$ represents —$CONR_{44}R_{45}$ or —$SO_2NR_{44}R_{45}$, $R_{42}$ represents a group substitutable on a naphthalene ring, l is an integer of 0 to 3, $R_{43}$ represents an alkyl group, an aralkyl group, an acyl group, an alkoxycarbonyl group, an alkylaminocarbonyl group, or an alkylsulfonyl group, which may be substituted, for example, by a halogen atom or an alkoxy group, X represents a hydrogen atom or a group capable being released upon coupling reaction with the oxidized product of an aromatic primary amine developing agent, $R_{44}$ and $R_{45}$, which may be the same or different, each represent independently a hydrogen atom, an alkyl group, an aryl group, or a heterocyclic group, when l is 2 or 3, groups $R_{42}$ may be the same or different or may bond together to form a ring, $R_{42}$ and $R_{43}$ or $R_{43}$ and X may bond together to form a ring, and two or more molecules of the compound may bond through a divalent or higher valent group at $R_{41}$, $R_{42}$, $R_{43}$, or X to form a dimer or higher polymer.

Specific examples of the coupler represented by formula (IV) are shown below, but the present invention is not restricted to them.

C-17

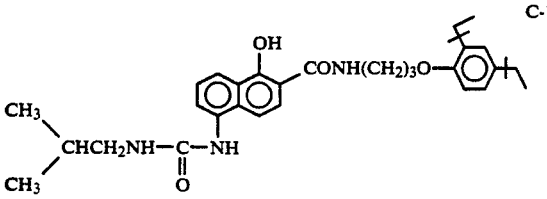

C-18

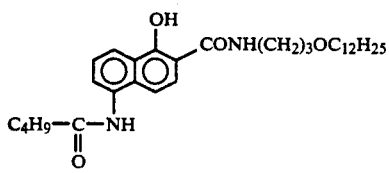

-continued

C-19

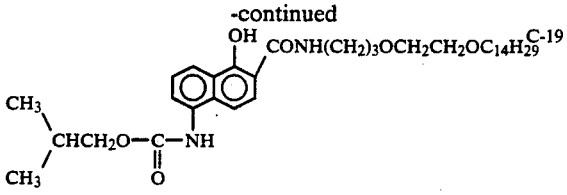

C-18

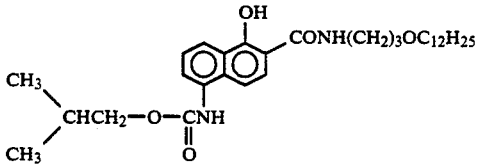

C-19

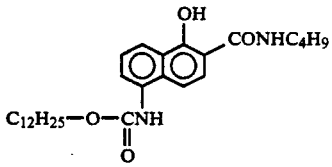

C-20

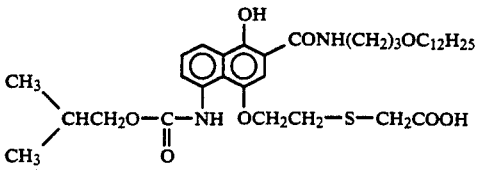

C-21

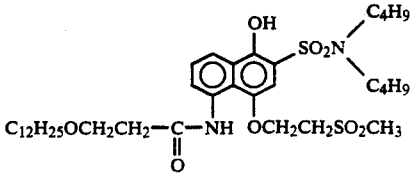

-continued

C-22

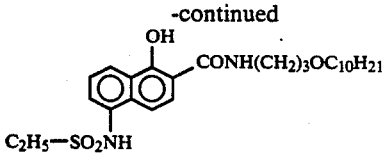

Typical examples of polymerized dye-forming coupler are described in, for example, U.S. Pat. Nos. 3,451,820, 4,080,211, 4,367,282, 4,409,320, and 4,576,910, British Patent No. 2,102,137, and European Patent No. 341,188A.

As a coupler which forms a dye having moderate diffusibility, those described in U.S. Pat. No. 4,366,237, British Patent No. 2,125,570, European Patent No. 96,570, and West German Patent Application (OLS) No. 3,234,533 are preferable.

As a colored coupler to rectify the unnecessary absorption of color-forming dyes, those couplers described in, paragraph VII-G of *Research Disclosure* No. 17643, paragraph VII-G of ibid. No. 307105, U.S. Pat. No. 4,163,670, JP-B No. 39413/1982, U.S. Pat. Nos. 4,004,929 and 4,138,258, and British Patent No. 1,146,368 are preferable. Further, it is preferable to use couplers to rectify the unnecessary absorption of color-forming dyes by a fluorescent dye released upon the coupling reaction as described in U.S. Pat. No. 4,774,181 and couplers having a dye precursor, as a group capable of being released, that can react with the developing agent to form a dye as described in U.S. Pat. No. 4,777,120.

A coupler that releases a photographically useful residue accompanied with the coupling reaction can be used favorably in this invention. As a DIR coupler that release a development retarder, those described in patents cited in paragraph VII-F of the above-mentioned *Research Disclosure No.* 17643 and in paragraph VII-F of ibid. No. 307105, JP-A Nos. 151944/1982, 154234/1982, 184248/1985, 37346/1988, and 37350/1986, and U.S. Pat. Nos. 4,248,962 and 4,782,012 are preferable.

As a coupler which releases, imagewisely, a nucleating agent or a development accelerator upon developing, those described in British Patent Nos. 2,097,140 and 2,131,188, and JP-A Nos. 157638/1984 and 170840/1984 are preferable. Further, compounds which release a fogging agent, a developing accelerator, or a solvent for silver halide by a oxidation-reduction reaction with the oxidized product of developing agent as described in JP-A Nos. 107029/1985, 252340/1985, 44940/1989, and 45687/1989 are also preferable.

Other couplers that can be incorporated in the photographic material of the present invention include competitive couplers described in U.S. Pat. No. 4,130,427, multi-equivalent couplers described in U.S. Pat. Nos. 4,283,472, 4,338,393, and 4,310,618, couplers which release a DIR redox compound, couplers which release a DIR coupler, and redox compounds which release a DIR coupler or a DIR redox as described in JP-A Nos. 185950/1985 and 24252/1987, couplers which release a dye to regain a color after releasing as described in European Patent Nos. 173,302A and 313,308A, couplers which release a bleaching-accelerator as describe in *Research Disclosure* Nos. 11449 and 24241, and JP-A No. 201247/1986, couplers which release a ligand as described in U.S. Pat. No. 4,553,477, couplers which release a leuco dye as described in JP-A No. 75747/1988, and couplers which release a fluorescent dye as described in U.S. Pat. No. 4,774,181.

In the photographic material of this invention, various antiseptics and antifungal agents, such as phenetyl alcohol, and 1,2-benzisothiazoline-3-one, n-butyl-p-hydroxybenzoate, phenol, 4-chloro-3,5-dimethylphenol, 2-phenoxyethanol, and 2-(4-thiazolyl)-bezimidazole as described in JP-A Nos. 257747/1988, 272248/1987, and 80941/1989 are preferably added.

The present invention can be adopted to various color photographic materials. Representable examples include a color negative film for general use or for cine, a color reversal film for slide or for television, a color paper, a color positive film, and a color reversal paper.

Suitable bases to be used in the present invention are described in, for example, in the above-mentioned *Research Disclosure* No. 17643, page 28 and ibid. No. 18716, from page 647, right column to page 648, left column.

In the photographic material of the present invention, preferably the total layer thickness of all the hydrophilic colloid layers on the side having emulsion layers is 28 μm or below, more preferably 23 μm or below, further more preferably 20 μm or below, are particularly preferably 16 μm or below. Preferably the film swelling speed $T_{\frac{1}{2}}$ is 30 sec or below, more preferably 20 sec or below. The term "layer thickness" means layer thickness measured after moisture conditioning at 25° C. and a relative humidity of 55% for two days, and the film swelling speed $T_{\frac{1}{2}}$ can be measured in a manner known in the art. For example, the film swelling speed $T_{\frac{1}{2}}$ can be measured by using a swellometer (swell-measuring meter) of the type described by A. Green et al. in *Photographic Science and Engineerig,* Vol. 19, No. 2, pp. 124–129, and $T_{\frac{1}{2}}$ is defined as the time required to reach a film thickness of ½ of the saturated film thickness that is 90% of the maximum swelled film thickness that will be reached when the film is treated with a color developer at 30° C. for 3 min 15 sec.

The film swelling speed $T_{\frac{1}{2}}$ can be adjusted by adding a hardening agent to the gelatin that is a binder or by changing the time conditions after the coating. Preferably the ratio of swelling is 150 to 400%. The ratio of swelling is calculated from the maximum swelled film thickness obtained under the above conditions according to the formula: (Maximum swelled film thickness—film thickness)/Film thickness.

It is preferable that the photographic material of the present invention is provided a hydrophilic layer (designated as a back layer) having a total dried layer thickness of 2 μm to 20 μm at the opposite side of having emulsion layers. In such layer, it is preferable to be contained the above-mentioned light-absorbent, filter-dye, UV-absorbent, static preventer, film-hardener, binder, plasticizer, lubricant, coating auxiliary, and surface-active agent.

The photographic material in accordance with the present invention can be subjected to the development processing by an ordinary method as described in the above-mentioned *Research Disclosure* No. 17463, pp. 28–29, ibid. No. 18716, p. 651, from left column to right column, and ibid. No. 307105, pp. 880–881.

Preferably, the color developer used for the development processing of the photographic material of the present invention is an aqueous alkaline solution whose major component is an aromatic primary amine color-developing agent. As the color-developing agent, aminophenol compounds are useful, though p-phenylene diamine compounds are preferably used, and typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxyethylaniline, and their sulfates, hydrochlorides, and p-toluenesulfonates. A combination of two or more of these compounds may be used in accordance with the purpose.

The color developer generally contains, for example, buffers, such as carbonates or phosphates of alkali metals, and development inhibitors or antifoggants, such as bromide salts, iodide salts, benzimidazoles, benzothiazoles, or mercapto compounds. The color developer may, if necessary, contain various preservatives, such as hydroxylamine, diethylhydroxylamine, sulfites, hydrazines for example N,N-biscarboxymethylhydrazine, phenylsemicarbazides, triethanolamine, and catecholsulfonic acids, organic solvents such as ethylene glycol and diethylene glycol, development accelerators such as benzyl alcohol, polyethylene glycol, quaternary ammonium salts, and amines, dye forming couplers, competing couplers, auxiliary developers such as 1-phenyl-3-pyrazolidone, tackifiers, and various chelate agents as represented by aminopolycarboxylic acids, aminopolyphosphonic acids, alkylphosphonic acids, and phosphonocarboxylic acids, typical example thereof being ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and their salts.

If reversal processing is carried out, it is common that after black and white development and reversal processing are carried out, the color development is carried out. As the black and white developers, known black and white developing agents, such as dihydroxybenzenes, for example hydroquinone, 3-pyrazolidones, for example 1-phenyl-3-pyrazolidone, and aminophenols, for example N-methyl-p-aminophenol, can be used alone or in combination.

Generally the pH of this color developer and black-and-white developing solution is 9 to 12. The replenishing amount of these developing solutions is generally 3 liter or below per square meter of the color. photographic material to be processed, though the replenishing amount changes depending on the type of color photographic material, and if the concentration of bromide ions in the replenishing solution is lowered previously, the replenishing amount can be lowered to 500 ml or below per square meter of the color photographic material. If it is intended to lower the replenishing amount, it is preferable to prevent the evaporation of the solution and oxidation of the solution with air by reducing the area of the solution in processing tank that is in contact with the air. The contact area of the photographic processing solution with the air in the processing tank is represented by the opened surface ratio which is defined as follows:

$$\text{Opened surface ratio } (\text{cm}^{-1}) = \frac{\text{Contact surface area } (\text{cm}^2) \text{ of the processing solution with the air}}{\text{Whole volume } (\text{cm}^3) \text{ of the processing solution}}$$

wherein "contact surface area of the processing solution with the air" means a surface area of the processing solution that is not covered by anything such as floating lids or rolls.

The opened surface ratio is preferably 0.1 $cm^{-1}$ or less, more preferably 0.001 to 0.05 $cm^{-1}$. Methods for reducing the opened surface ratio that can be mentioned include a utilization of movable lids as described in JP-A No. 82033/1989 and a slit-developing process as described in JP-A No. 216050/1988, besides a method of providing a shutting materials such as floating lids. It is preferable to adopt the means for reducing the opened surface ratio not only in a color developing and black-and-white developing process but also in all succeeding processes, such as bleaching, bleach-fixing, fixing, washing, and stabilizing process. It is also possible to reduce the replenishing amount by using means of suppressing the accumulation of bromide ions in the developer.

Although the processing time of color developing is settled, in generally, between 2 and 5 minutes, the time can be shortened by, for example, processing at high temperature and at high pH, and using a color developer having high concentration of color developing agent.

The photographic emulsion layers are generally subjected to a bleaching process after color development.

The beaching process can be carried out together with the fixing process (bleach-fixing process), or it can be carried out separately from the fixing process. Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process. As the bleaching agent, use can be made of, for example, compounds of polyvalent metals, such as iron (III). As a typical bleaching agent, use can be made of organic complex salts of iron (III), such as complex salts of aminopolycarboxylic acids, for example ethylenediaminetetraacetic acid, diethylenetriaminetetraacetic acid, cyclohexanediaminetetraacetic acid, methyliminodiacetic acid, 1,3-diaminopropanetetraacetic acid, and glycoletherdiaminetetraacetic acid, citric acie, tartaric acid, and malic acid. Of these, aminopolycarboxylic acid iron (III) complex salts, including ethylenediaminetetraacetic acid iron (III) complex salts are preferable in view of rapid-processing and the prevention of pollution problem. Further, aminopolycarboxylic acid iron (III) complex salts are particularly useful in a bleaching solution as well as a bleach-fixing solution. The pH of the bleaching solution or the bleach-fixing solution using these aminopolycarboxylic acid iron (III) complex salts is generally 4.0 to 8.0, but if it is required to quicken the process, the process can be effected at a low pH.

In the bleaching solution, the bleach-fixing solution, and in the bath preceding them, a bleach-accelerating agent may be used if necessary. Examples of useful bleach-accelerating agents are compounds having a mercapto group or a disulfide linkage, described in U.S.

Pat. No. 3,893,858, West German Patent Nos. 1,290,812 and 2,059,988, JP-A Nos. 32736/1978, 57831/1978, 37418/1978, 72623/1978, 95630/1978, 95631/1978, 104232/1978, 124424/1978, 141623/1978, and 28426/1978, and *Research Disclosure* No. 17129 (July, 1978); thiazolidine derivatives, described in JP-A No. 140129/1975; thiourea derivatives, described in JP-B No. 8506/1970, JP-A Nos. 20832/1977 and 32735/1978, and U.A. Patent No. 3,706,561; iodide salts, described in West German Patent No. 1,127,715 and JP-A No. 16235/1983; polyoxyethylene compounds in West German Patent Nos. 966,410 and 2,748,430; polyamine compounds, described in JP-B No. 8836/1970; other compounds, described in JP-A Nos. 40943/1974, 59644/1974, 94927/1978, 35727/1979, 26506/1980, and 163940/1983; and bromide ions. Of these, compounds having a mercapto group or a disulfide group are preferable in view of higher acceleration effect, and in particular, compounds described in U.A. Patent No. 3,893,858, West German Patent No. 1,290,812, and JP-A No. 95630/1978 are preferable. Further, compound described in U.S. Pat. No. 4,552,834 are preferable. These bleach-accelerating agents may be added into a photographic material. When the color photographic materials for photographing are to be bleach-fixed, these bleach-accelerating agents are particularly effective.

In addition to the above compounds, an organic acid is preferably contained in the bleach solution or bleach-fix solution in order to prevent bleach stain. A particularly preferable organic acid is a compound having an acid dissociation constant (pKa) of 2 to 5, and specifically, for example, acetic acid and propionic acid are preferable.

As a fixing agent to be used in the fixing solution and the bleach-fix solution, thiosulfates, thiocyanates, thioether compounds, thioureas, and large amounts of iodides can be mentioned, although thiocyanates are used generally, and particularly ammonium thiosulfate is used most widely. A combination, for example, of a thiosulfate with a thiocyanate, a thioether compound, or thiourea is also used preferably. As preservatives for the fixing solution or the bleach-fix solution, sulfites, bisulfites, carbonyl bisulfite adducts, and sulfinic acid compounds described in European Patent No. 294,769A are preferable. Further, in order to stabilize the fixing solution or the bleach-fix solution, the addition of various aminopolycarboxylic acids or organic phosphonic acids to the solution is preferable.

In the present invention, to the fixing solution or the bleach-fix solution, a compound having a pKa of 6.0 to 9.0, preferably an imidazole, such as imidazole, 1-methylimidazole, 1-ethylimidazole, and 2-methylimidazole, is added in an amount of 0.1 to 10 mol/l in order to adjust the pH.

The total period of the desilvering step is preferably made shorter within the range wherein silver retention will not occur. A preferable period is 1 to 3 min, more preferably 1 to 2 min. The processing temperature is 15° to 50° C., preferably 35° to 45° C. In a preferable temperature range, the desilvering speed is improved and the occurrence of stain after the processing can effectively be prevented.

In the desilvering step, preferably the stirring is intensified as far as possible. Specific methods for intensifying the stirring are a method described in JP-A No. 183460/1987, wherein a jet stream of a processing solution is applied to the emulsion surface of the photographic material; a method described in JP-A No. 183461/1987, wherein the stirring effect is increased by using a rotating means; a method wherein a photographic material is moved with a wiper blade placed in a solution in contact with the emulsion surface, to cause a turbulent flow to occur over the emulsion surface to improve the stirring effect, and a method wherein the amount of the circulating flow of the whole processing solution is increased. Such stirring improvement means are effective for any of the bleaching solution, the bleach-fix solution, and the fixing solution. The improvement of stirring seems to quicken the supply of the bleaching agent and the fixing agent to the emulsion coating, thereby bringing about an increase of the desilvering speed. The above stirring improvement means is more effective when a bleach accelerator is used and the means can increase the acceleration effect remarkably or can cancel the fixing inhibiting effect of the bleach accelerator.

Preferably, the automatic processor used for the present photographic material is provided with a photographic material conveying means described in JP-A Nos. 191257/1985, 191258/1985, and 191259/1985. As described in 191257/1985 mentioned above, such a conveying means can reduce extraordinarily the carry-in of the processing solution from one bath to the next bath, and therefore it is highly effective in preventing the performance of the processing solution from deteriorating. Such an effect is particularly effective in shortening the processing time in each step and in reducing the replenishing amount of the processing solution.

It is common for the silver halide color photographic material of the present invention to undergo, after a desilvering process such as fixing or bleach-fix, a washing step and/or a stabilizing step. The amount of washing water may be set within a wide range depending on the characteristics (e.g., due to the materials used, such as couplers), the application of the photographic material, the washing temperature, the number of washing tanks (the number if steps), the type of replenishing system, including, for example, the counter-current system and the direct flow system and other various conditions. Of these, the relationship between the number of waterwashing tanks and the amount of washing water in the multi-stage counter current system can be found according to the method described in *Journal of Society of Motion Picture and Television Engineers,* Vol. 64, pages 248 to 253 (May 1955).

According to the multi-stage-counter-current system described in the literature mentioned above, although the amount of washing water can be considerably reduced, bacteria propagate with an increase of retention time of the washing water in the tanks, leading to a problem with the resulting suspend matter adhering to the photographic material. In processing the present color photographic material, as a measure to solve this problem the method of reducing calcium and magnesium described in JP-A No. 288838/1987 can be used quite effectively. Also chlorine-type bactericides such as sodium chlorinated isocyanurate, cyabendazoles, isothiazolone compounds described in JP-A No. 8542/1982, benzotriazoles, and other bactericides described by Hiroshi Horiguchi in *Bokin Bobai-zai no Kagaku,* (1986) published by Sankyo-Shuppan, *Biseibutsu no mekkin, Sakkin, Bobaigijutsu* (1982) edited by Eiseigijutsu-kai, published by Kogyo-Gijutsu-kai, and in *Bokin Bobaizai Jiten* (1986) edited by Nihon Bokin Bobai-gakkai), can be used.

The pH of the washing water used in processing the present photographic material is 4 to 9, preferably 5 to 8. The washing water temperature and the washing time to be set may very depending, for example, on the characteristics and the application of the photographic material, and they are generally selected in the range of 15° to 45° C. for sec to 10 min, and preferably in the range of 25° to 40° C. for 30 sec to 5 min. Further, the photographic material of the present invention can be processed directly with a stabilizing solution instead of the above washing. In such a stabilizing process, any of known processes, for example, a multi-step counter-current stabilizing process or its low-replenishing-amount process, described in JP-A Nos. 8543/1982, 14834/1983, and 220345/1985.

In some cases, the above washing process is further followed by stabilizing process, and as an example thereof can be mentioned a stabilizing bath that is used as a final bath for color photographic materials for photography, which contains a dye-stabilizing agent and a surface-active agent. As an example of dye-stabilizing agent can be mentioned aldehyde (e.g., formalin and gulaldehyde), N-methylol compound, hexamethylenetetramine and aldehyde-sulfite adduct.

In this stabilizing bath, each kind of the chelating agents and bactericides may be added.

The over-flowed solution due to the replenishing of washing solution and/or stabilizing solution may be reused in other steps, such as a desilvering step.

When each of the above-mentioned processing solutions is concentrated due to the evaporation of water in the processing using an automatic processor, preferably water to correct the concentration is added into each solution.

The silver halide color photographic material of the present invention may contain therein a color-developing agent for the purpose of simplifying and quickening the process. To contain such a color-developing agent, it is preferable to use a precursor for color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, and metal salt complexes described in U.S. Pat. No. 3,719,492, and urethane-type compounds described in JP-A No. 135628/1978 can be mentioned.

For the purpose of accelerating the color development, the present silver halide color photographic material may contain, if necessary, various 1-phenyl-3-pyrazolicones. Typical compounds are described in JP-A Nos. 64339/1981, 144547/1982, and 115438/1983.

The various processing solutions used for the present invention may be used at 10° to 50° C. Although generally a temperature of 33° to 38° C. may be standard, a higher temperature can be used to accelerate the process to reduce the processing time, or a lower temperature can be used to improve the image quality or the stability of the processing solution.

Further, the silver halide photographic material of the present invention can be adopted to photographic materials for heat development described in, for example, U.S. Pat. No. 4,500,626, JP-A Nos. 133449/1985, 218443/1984, and 23805/1986, and European Patent No. 210,660A2.

Next, the present invention will be described in detail in accordance with examples, but the invention is not limited to them.

Compounds shown below were used in Examples 1 to 5 as couplers for comparison.

YC-1

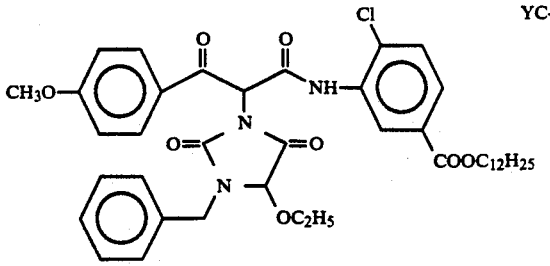

(PE 2213461)

YC-2

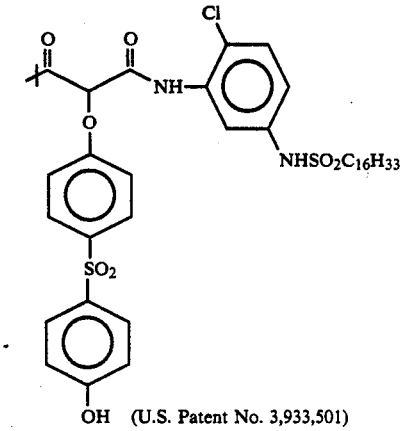

(U.S. Patent No. 3,933,501)

YC-3

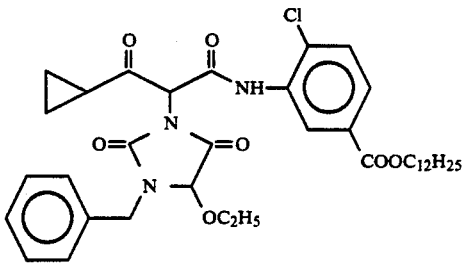

(JP-A No. 26133/1972)

YC-4

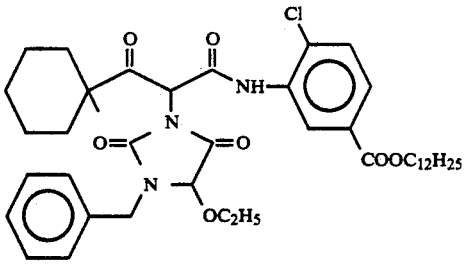

(U.S. Patent Re No. 27,848)

YC-5

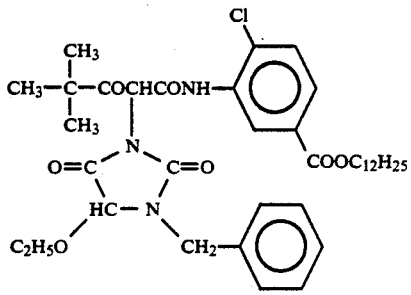

-continued

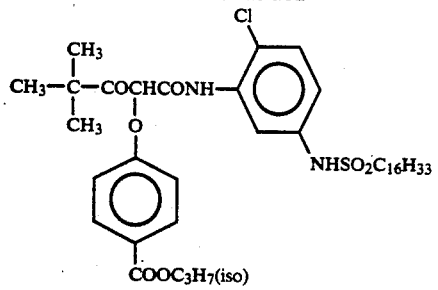

(JP-A No. 43144/1988)

EXAMPLE 1

A monolayer color photographic material (Sample 001) for evaluation test was prepared by coating two layers of each layer having a composition shown below on a prime-coated triacetate cellulose film.

Composition of each layer

The figure corresponding to each component is indicated in a coating amount of $gm^2$, but the coating amount of sensitizing dye is indicated in mol per mol of silver halide in the same layer.

| (Sample 001) | |
|---|---|
| First layer (Blue-sensitive emulsion layer | |
| Emulsion (Av. AgI content: 8.9%, av. grain diameter: 0.73 μm, coefficient of variation: 14%, core/shell = 3/7 double structure grain of ratio of AgI content = 2.5%/2%) silver | 0.43 |
| Sensitizing dye | $3.6 \times 10^{-4}$ |
| YC-1 | 0.75 |
| HBS-1 | 0.75 |
| W-1 | 0.10 |
| F-1 | 0.004 |
| B-1 | 0.014 |
| B-2 | 0.010 |
| Gelatin | 2.00 |
| Second layer (Protective layer) | |
| H-1 | 0.18 |
| W-2 | 0.10 |
| B-2 | 0.01 |
| B-3 (diameter: 1.7 μm) | 0.05 |
| B-4 (diameter: 1.7 μm) | 0.10 |
| B-5 | 0.10 |
| Gelatin | 1.20 |

HBS-1

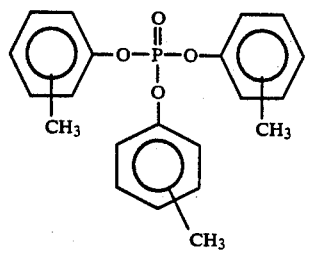

W-1 $C_{12}H_{25}$—$SO_3Na$

W-2 $NaO_3S$—CH($C_2H_5$)—$COOCH_2CH(C_2H_5)C_4H_9$
$CH_2$—$COOCH_2CH(C_2H_5)C_4H_9$

-continued

YC-6

(Sample 001)

F-1

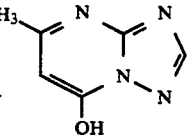

B-1 $-(CH_2-CH)_x-(CH_2-CH)_y-$ x/y = 70/30

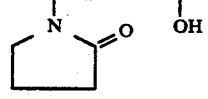

B-2 $-(CH_2-CH)_n-$

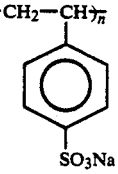

B-3 $-(CH_2-C(CH_3)(COOH))_x-(CH_2-C(CH_3)(COOCH_3))_y-$ x/y = 10/90

B-4 $-(CH_2-C(CH_3)(COOH))_x-(CH_2-C(CH_3)(COOCH_3))_y-$ x/y = 40/60

B-5

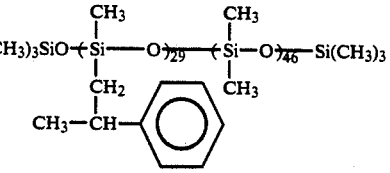

H-1 $CH_2=CHSO_2CHCONH-CH_2$
$CH_2=CHSO_2CHCONH-CH_2$

Sensitizing dye VII

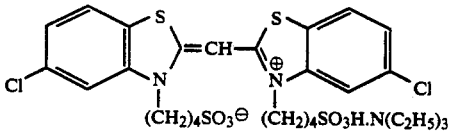

Samples 002 to 036 were prepared in the same manner as Sample 001, except that YC-1 in Sample 001 was changed to coupler shown in Table 1 in an equimolar amount, respectively. The amount of high-boiling organic solvent was changed as shown in Table 1.

These samples were subjected to an imagewise exposure to light through an optical wedge and then the processing as shown below.

| Processing process | | |
|---|---|---|
| Process | Processing time | Processing temperature |
| Color-development | 2 min 45 sec | 38° C. |
| Bleaching | 6 min 30 sec | 38° C. |
| Water washing | 2 min 10 sec | 24° C. |
| Fixing | 4 min 20 sec | 38° C. |
| Water washing (1) | 1 min 05 sec | 24° C. |
| Water washing (2) | 1 min 00 sec | 24° C. |
| Stabilizing | 1 min 05 sec | 38° C. |
| Drving | 4 min 20 sec | 55° C. |

Compositions of processing solution were as follows:

| | gram |
|---|---|
| Color developer | |
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfonate | 2.4 |
| 4-(N-ethyl-N-β-hyroxyethylamino)-2-methylaniline sulfonate | 4.5 |
| Water to make | 1,000 ml |
| pH | 10.05 |
| Bleaching solution | |
| Fe(III) sodium ethylenediamine-tetraacetate trihydrate | 100.0 |
| Disodium ethylenediaminetetraacetate | 10.0 |
| Ammonium bromide | 140.0 |
| Ammonium nitrate | 30.0 |
| Aqueous ammonia (27%) | 6.5 ml |
| Water to make | 1,000 ml |
| pH | 6.0 |
| Fixing solution | |
| Disodium ethylenediaminetetraacetate | 0.5 |
| Sodium sulfite | 7.0 |
| Sodium bisulfite | 5.0 |
| Ammonium thiosulfite aqu. solution (70%) | 170.0 ml |
| Water to make | 1,000 ml |
| pH | 6.7 |
| Stabilizing solution | |
| Formalin (37%) | 2.0 ml |
| Polyoxyethylene-p-monononylphenyl ether (average polymerization degree: 10) | 0.3 |
| Disodium ethylenediaminetetraacetate | 0.05 |
| Water to make | 1,000 ml |

-continued

| | gram |
|---|---|
| pH | 5.0–8.0 |

After processing, the characteristic curve of each photographic material was determined by using blue light to obtain a maximum density (Dm) and a gradation (γ) of tangent line of the characteristic curve.

Further, each processed sample was stored for three months in such hot and moisture conditions as 60° C. and 70% and then the remaining ratio of color image at maximum density was determined.

Data obtained are shown in Table 1.

TABLE 1

| Sample No. | Coupler | Ratio of high-boiling organic solvent/coupler | Dm | δ | Discoloration Test at 60° C.-70% RH for 3 months (Residual Ratio) | Remarks |
|---|---|---|---|---|---|---|
| 001 | YC-1 | 1.0 | 1.72 | 1.49 | 55% | Comparative example |
| 002 | " | 0.5 | 1.63 | 1.40 | 52% | " |
| 003 | " | 0.3 | 1.54 | 1.34 | 53% | " |
| 004 | " | 0.1 | 1.27 | 1.02 | 52% | " |
| 005 | " | 0.0 | 1.11 | 0.85 | 54% | " |
| 006 | YC-2 | 1.0 | 1.34 | 1.19 | 48% | " |
| 007 | " | 0.3 | 1.33 | 1.11 | 50% | " |
| 008 | " | 0.0 | 1.36 | 1.15 | 47% | " |
| 009 | Y-9 | 1.0 | 1.78 | 1.51 | 77% | " |
| 010 | " | 0.5 | 1.72 | 1.43 | 78% | " |
| 011 | " | 0.3 | 1.68 | 1.37 | 79% | This invention |
| 012 | " | 0.1 | 1.57 | 1.32 | 77% | " |
| 013 | " | 0.0 | 1.51 | 1.27 | 76% | " |
| 014 | Y-53 | 1.0 | 1.92 | 1.59 | 75% | Comparative example |
| 015 | " | 0.5 | 1.83 | 1.54 | 73% | " |
| 016 | " | 0.3 | 1.75 | 1.49 | 74% | This invention |
| 017 | " | 0.1 | 1.66 | 1.42 | 76% | " |
| 018 | " | 0.0 | 1.60 | 1.37 | 74% | " |
| 019 | Y-54 | 0.3 | 1.62 | 1.41 | 75% | This invention |
| 020 | " | 0.0 | 1.57 | 0.38 | 73% | " |
| 021 | Y-57 | 0.3 | 1.66 | 1.43 | 75% | " |
| 022 | " | 0.0 | 1.61 | 1.40 | 74% | " |
| 023 | Y-6 | 0.3 | 1.75 | 1.51 | 71% | " |
| 024 | " | 0.0 | 1.79 | 1.55 | 70% | " |
| 025 | Y-8 | 0.3 | 1.57 | 1.37 | 73% | " |
| 026 | " | 0.0 | 1.49 | 1.29 | 71% | " |
| 027 | Y-44 | 0.3 | 1.57 | 1.32 | 82% | " |
| 028 | " | 0.0 | 1.48 | 1.27 | 84% | " |
| 029 | Y-11 | 0.3 | 1.55 | 1.29 | 89% | " |
| 030 | " | 0.1 | 1.49 | 1.26 | 87% | " |
| 031 | YC-3 | 1.0 | 1.38 | 1.15 | 18% | Comparative example |
| 032 | " | 0.3 | 1.12 | 1.01 | 20% | " |
| 033 | " | 0.0 | 0.75 | 0.57 | 21% | " |
| 034 | YC-4 | 1.0 | 1.02 | 0.72 | 91% | " |
| 035 | " | 0.3 | 0.84 | 0.61 | 90% | " |
| 036 | " | 0.0 | 0.31 | 0.20 | Note 1 | " |

Note 1: Exact evaluation could not be done because of low Dm value.

As is apparent from Table 1, with respect to Comparative Coupler YC-1, the activity lowers greatly and the fading resistance is poor when the high-boiling organic solvent is decreased. On the other hand, with respect to Comparative Coupler YC-2, when the high-boiling organic solvent is decreased, the activity lowers a little, but since the molecular extinction coefficient is small, the color density is inadequate.

In contrast, with respect to the couplers Y-9, Y-53, Y-54, Y-57, Y-6. Y-8, Y-44, and Y-11, when the weight ratio of the high-boiling organic solvent to the couplers is in the range of from 1 to 0.5, high Dm is obtained, and in addition, even when the weight ratio is 0.3 or below, which is in the range of the present invention, the activity lowers less and adequate color density (Dm) and gradation (γ) are secured.

The drop of the color image density at the time of storage under heat and humidity in the present invention is about ½ of that of the samples of Comparative Couplers, and this property is retained even when the high-boiling organic solvent is decreased.

On the other hand, in the case of the samples of the known Comparative Coupler YC-3, the coupler of which has a structure similar to that of the present coupler, fastness at the time of storage under heat and humidity is extremely poor. Further, the absorption spectrum of the dye produced from the sample is broad, and it cannot be said that the performance of the samples is comparable with that of the samples of the present invention.

Although the samples that include Comparative Coupler YC-4 are excellent against fading under heat and humidity, the drop of the color-forming properties is extremely great when the high-boiling organic solvent is decreased.

From the above, it can be said that the samples of the present invention are excellent in that they show high color-forming properties even when a high-boiling organic solvent is decreased and fading at the time of storage under heat and humidity is less.

EXAMPLE 2

A multilayer color photographic material sample 100 was prepared by multi-coating each layer having a composition shown below on a prime-coated triacetate cellulose film base.

Composition of photosensitive layer

Figure corresponding each component is indicated in a coating amount of g/m$^2$, but the coating amount of silver halide emulsion is indicated in terms of silver. For sensitizing dye, the coating amount is indicated in mol per mol of silver halide in the same layer.

| (Sample 101) | |
|---|---|
| First layer (Halation preventing layer) | |
| Black colloidal silver | 0.18 |
| Gelatin | 1.40 |
| Second layer (Intermediate layer) | |
| 2,5-Di-t-pentadecylhydroquinone | 0.18 |
| EX-1 | 0.070 |
| EX-3 | 0.020 |
| EX-11 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Third layer (First red-sensitive emulsion layer) | |
| Emulsion A | silver 0.25 |
| Emulsion B | silver 0.25 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.34 |
| EX-9 | 0.020 |
| U-1 | 0.070 |
| U-2 | 0.050 |
| U-3 | 0.070 |
| HBS-1 | 0.060 |
| Gelatin | 0.87 |
| Fourth layer (Second red-sensitive emulsion layer) | |
| Emulsion G | silver 1.00 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.40 |

-continued

| (Sample 101) | |
|---|---|
| EX-3 | 0.050 |
| EX-9 | 0.015 |
| U-1 | 0.070 |
| U-2 | 0.050 |
| U-3 | 0.070 |
| Gelatin | 1.30 |
| Fifth layer (Third red-sensitive emulsion layer) | |
| Emulsion D | silver 1.60 |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-2 | 0.097 |
| EX-3 | 0.010 |
| EX-4 | 0.080 |
| HBS-1 | 0.22 |
| HBS-2 | 0.10 |
| Gelatin | 1.63 |
| Sixth layer (Intermediate layer) | |
| EX-5 | 0.040 |
| HBS-1 | 0.020 |
| Gelatin | 0.80 |
| Seventh layer (First green-sensitive emulsion layer) | |
| Emulsion A | silver 0.15 |
| Emulsion B | silver 0.15 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.26 |
| EX-7 | 0.030 |
| EX-8 | 0.025 |
| HBS-1 | 0.10 |
| HBS-3 | 0.010 |
| Gelatin | 0.63 |
| Eighth layer (Second green-sensitive emulsion layer) | |
| Emulsion C | silver 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| EX-7 | 0.026 |
| EX-8 | 0.018 |
| HBS-1 | 0.16 |
| HBS-3 | $8.0 \times 10^{-3}$ |
| Gelatin | 0.50 |
| Ninth layer (Third green-sensitive emulsion layer) | |
| Emulsion E | silver 1.20 |
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.025 |
| EX-10 | 0.10 |
| EX-12 | 0.015 |
| HBS-1 | 0.25 |
| HBS-2 | 0.10 |
| Gelatin | 1.54 |
| Tenth layer (Yellow filter layer) | |
| Yellow colloidal silver | silver 0.050 |
| EX-5 | 0.080 |
| HBS-1 | 0.030 |
| Gelatin | 0.95 |
| Eleventh layer (First blue-sensitive emulsion layer) | |
| Emulsion A | silver 0.080 |
| Emulsion B | silver 0.070 |
| Emulsion F | silver 0.070 |
| Sensitizing dye VII | $3.5 \times 10^{-4}$ |
| EX-8 | 0.042 |
| YC-1 | 0.71 |
| HBS-1 | 0.28 |
| Gelatin | 1.10 |
| Twelfth layer (Second blue-sensitive emulsion layer) | |
| Emulsion G | silver 0.45 |
| Sensitizing dye VII | $2.1 \times 10^{-4}$ |
| YC-1 | 0.16 |
| EX-9 | $7.0 \times 10^{-3}$ |
| HBS-1 | 0.050 |
| Gelatin | 0.78 |
| Thirteenth layer (Third blue-sensitive emulsion layer) | |

-continued (Sample 101)

| | |
|---|---|
| Emulsion H | silver 0.77 |
| Sensitizing dye VII | $2.2 \times 10^{-4}$ |
| YC-1 | 0.22 |
| HBS-1 | 0.070 |
| Gelatin | 0.69 |
| Fourteenth layer (First protective layer) | |
| Emulsion I | silver 0.20 |
| U-4 | 0.11 |
| U-5 | 0.17 |
| HBS-1 | $5.0 \times 10^{-2}$ |
| Gelatin | 1.00 |
| Fifteenth layer (Second protective layer) | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, in order to improve preservability, processability, pressure-resistance, antifungal and antibacterial property, antistatic property, and coating property, W-1, W-2, W-3, B-4, B-5, F-1, F-2, F-3, F-4, F-5, F-6, F-7, F-8, F-9, F-10, F-11, F-12, F-13, and salts of iron, lead, gold, platinum, iridium and rhodium were included in all layers.

| | Average AgI content (%) | Grain Size Average Diameter (μm) | Grain Size Deviation coefficient (%) | Ratio of Diameter/Thickness | Ratio of silver amount (AgI content %) | |
|---|---|---|---|---|---|---|
| Emulsion A | 4.1 | 0.45 | 27 | 1 | Core/Shell = 1/3(13/1) | Double Structure Grains |
| Emulsion B | 8.9 | 0.70 | 14 | 1 | Core/Shell = 3/7(25/2) | Double Structure Grains |
| Emulsion C | 10 | 0.75 | 30 | 2 | Core/Shell = 1/2(24/3) | Double Structure Grains |
| Emulsion D | 16 | 1.05 | 35 | 2 | Core/Shell = 4/6(40/0) | Double Structure Grains |
| Emulsion E | 10 | 1.05 | 35 | 3 | Core/Shell = 1/2(24/3) | Double Structure Grains |
| Emulsion F | 4.0 | 0.25 | 28 | 1 | Core/Shell = 1/3(13/1) | Double Structure Grains |
| Emulsion G | 14.0 | 0.75 | 25 | 2 | Core/Shell = 1/2(40/0) | Double Structure Grains |
| Emulsion H | 14.5 | 1.30 | 25 | 3 | Core/Shell = 37/63(34/3) | Double Structure Grains |
| Emulsion I | 1 | 0.07 | 15 | 1 | Uniform Grains | |

EX-1

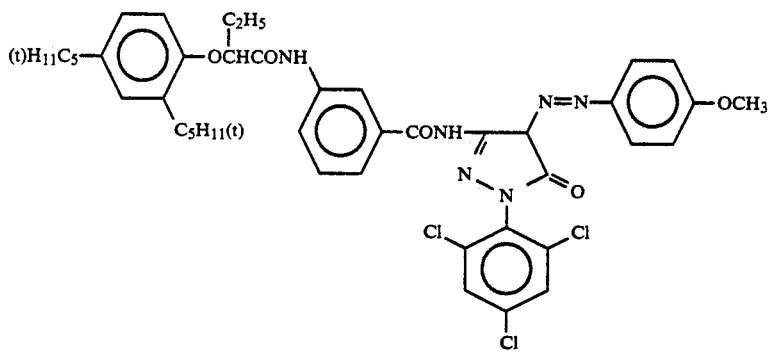

EX-2

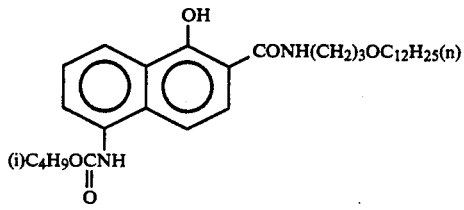

EX-3

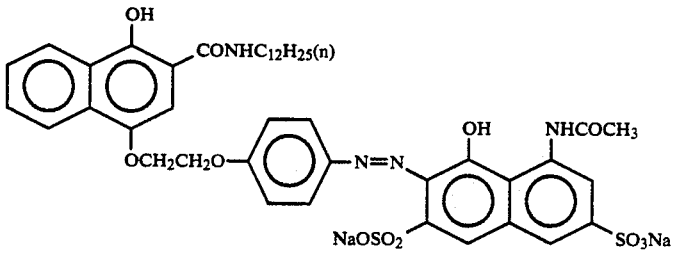

-continued
EX-4
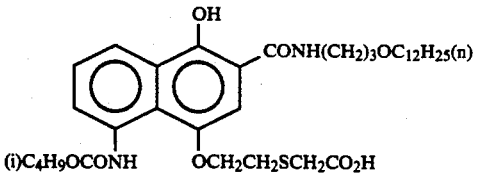
EX-5
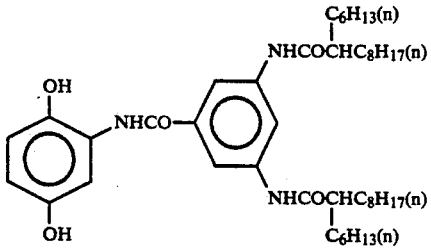
EX-6
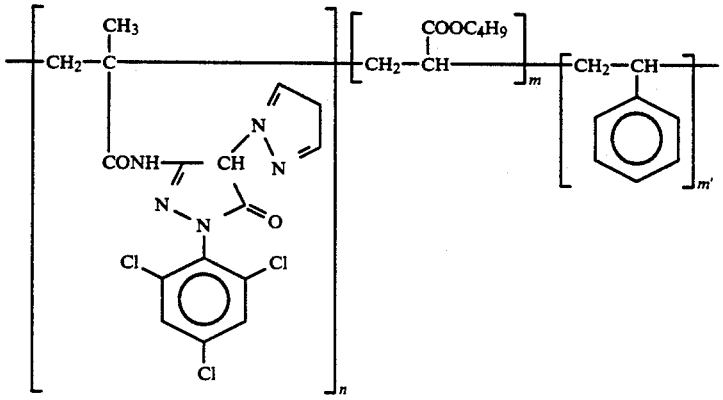
n = 50
m = 25
m' = 25
mol. wt. ca. 20,000
EX-7
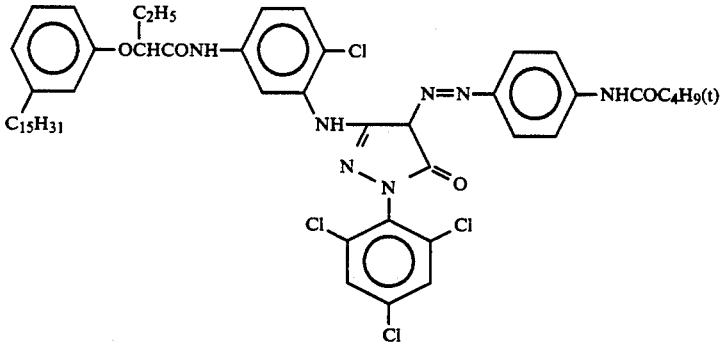
EX-8
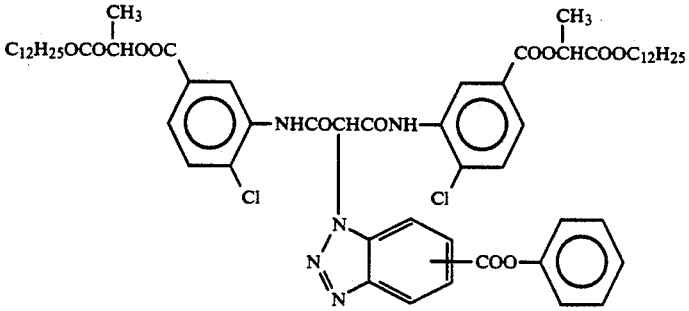
EX-9

-continued
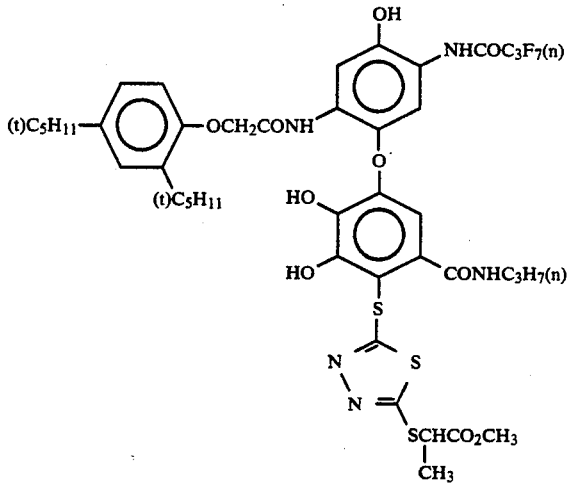
EX-10
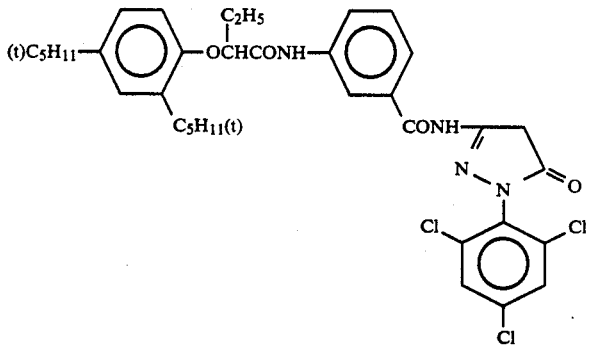
EX-11
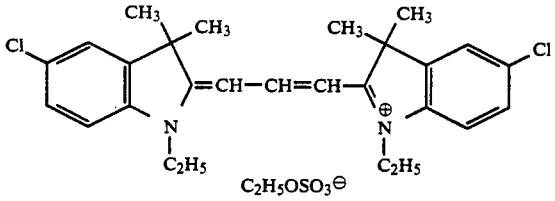
EX-12
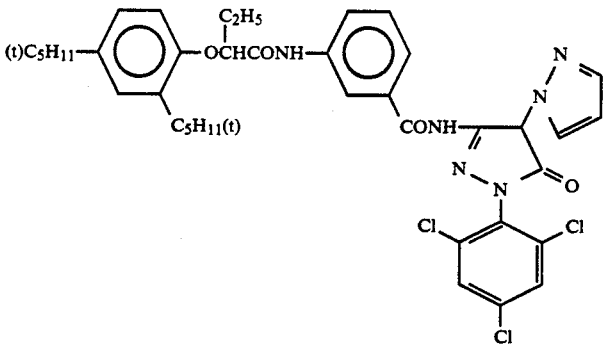
U-1
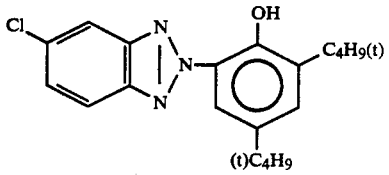
U-2
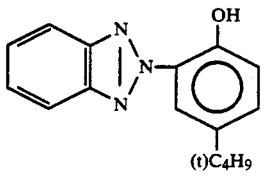

-continued
U-3
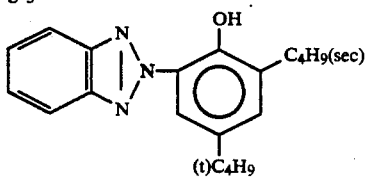
U-4
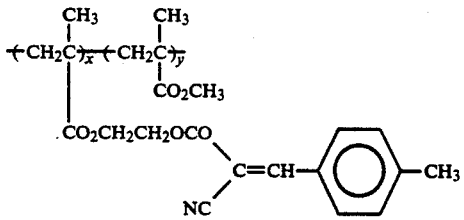
x:y = 70:30 (wt %)
U-5
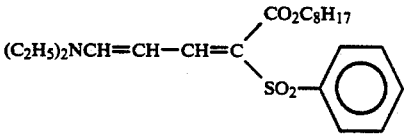
HBS-1
Tricrezyl phosphate
HBS-2
Di-n-butyl phthalate
HBS-3
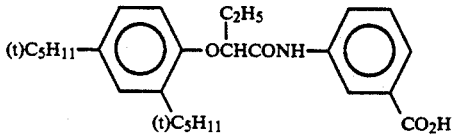
Sensitizing Dye I
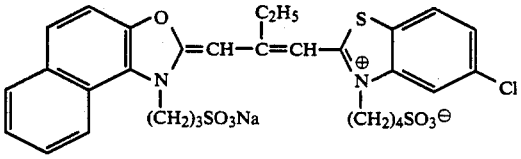
Sensitizing Dye II
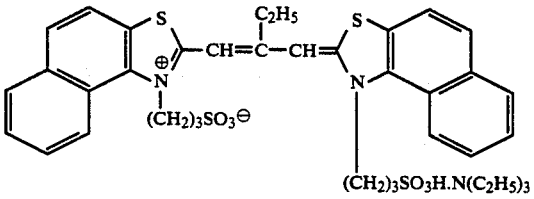
Sensitizing Dye III
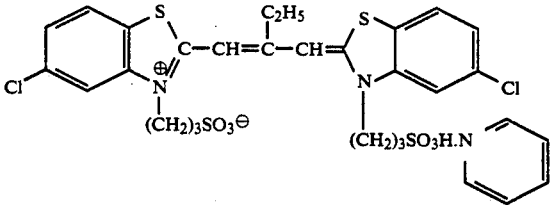
Sensitizing Dye IV
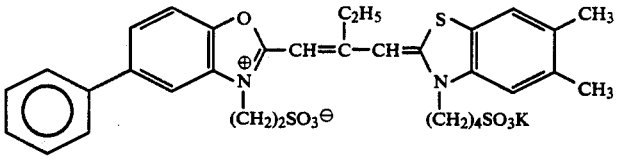
Sensitizing Dye V
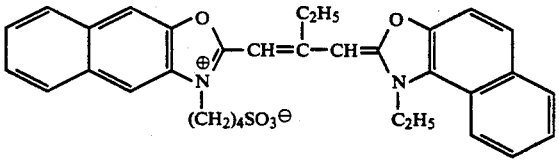
Sensitizing Dye VI
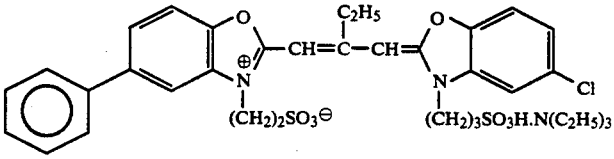

-continued
Sensitizing Dye VII
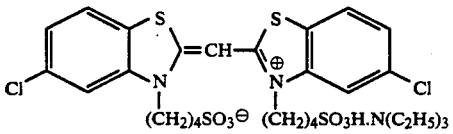
S-1
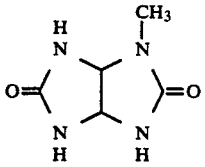
H-1
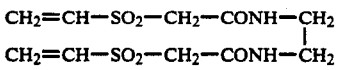
B-1
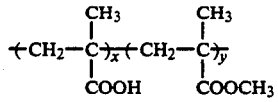
x/y = 10/90
B-2
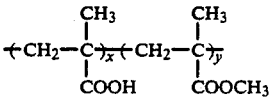
x/y = 40/60
B-3
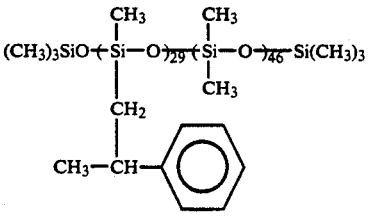
B-4
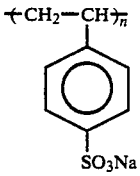
B-5
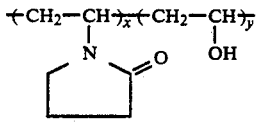
x/y = 70/30
W-1
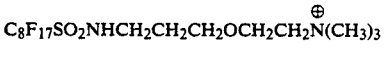
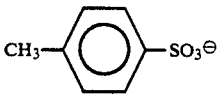
W-2
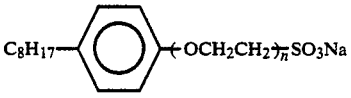
n = 2~4
W-3
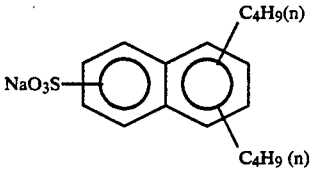
F-1
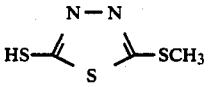
F-2
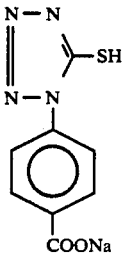
F-3
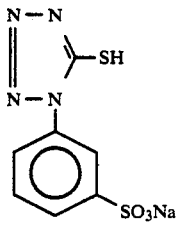
F-4
F-5

-continued

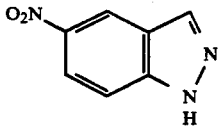

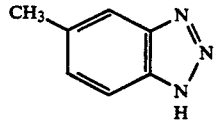

F-6

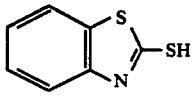

F-7

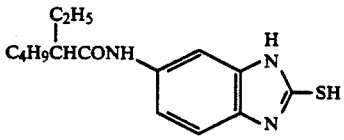

F-8

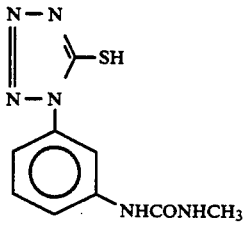

F-9

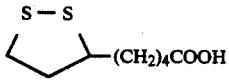

F-10

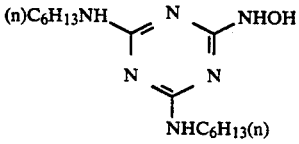

F-11

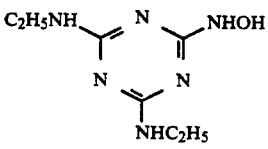

F-12

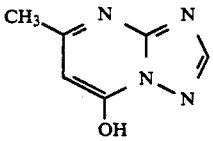

F-13

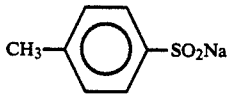

Samples 101 to 120 were prepared in the same manner as Sample 100, except that comparative coupler YC-1 and the amount of high-boiling organic solvent in the 11th, 12th, and 13th layers were changed as shown in Table 2, respectively, and providing that HBS-2 was used as a high-boiling organic solvent in Samples 117 to 120.

These samples were processed after an exposure to light in the same manner as described in Example 1. After processing samples were determined a density through a blue filter. Results are shown in Table 2.

In Table 2, the amount of coupler calculating a ratio of high boiling organic solvent/coupler is excluded from the amount of DIR coupler.

TABLE 2

| Sample No. | Coupler | High-boiling organic solvent/ coupler ratio | Fog*1) | Color*2) density | R %*3) | Remarks |
|---|---|---|---|---|---|---|
| 101 | YC-1 | 1.0 | ±0 | 2.00 | 72% | Comparative example |
| 102 | " | 0.3 | −0.02 | 1.85 | 69% | " |
| 103 | " | 0.1 | −0.03 | 1.59 | 66% | " |
| 104 | " | 0.0 | −0.03 | 1.47 | 68% | " |
| 105 | YC-2 | 1.0 | 0.01 | 1.48 | 77% | " |
| 106 | " | 0.3 | 0.02 | 1.46 | 76% | " |
| 107 | " | 0.1 | 0.03 | 1.42 | 74% | " |
| 108 | " | 0.0 | 0.02 | 1.38 | 73% | " |
| 109 | Y-53 | 1.0 | 0.01 | 2.18 | 84% | " |
| 110 | " | 0.3 | −0.01 | 2.07 | 85% | This invention |
| 111 | " | 0.1 | −0.01 | 2.01 | 86% | " |
| 112 | " | 0.0 | −0.02 | 1.92 | 83% | " |
| 113 | Y-57 | 1.0 | 0.00 | 2.12 | 79% | Comparative example |
| 114 | " | 0.3 | −0.01 | 2.06 | 82% | This invention |
| 115 | " | 0.1 | −0.01 | 1.98 | 81% | " |
| 116 | " | 0.0 | −0.01 | 1.90 | 84% | " |
| 117 | Y-64 | 1.0 | −0.01 | 2.07 | 81% | Comparative example |
| 118 | " | 0.3 | −0.02 | 2.00 | 84% | This invention |
| 119 | " | 0.1 | −0.01 | 1.92 | 83% | " |

TABLE 2-continued

| Sample No. | Coupler | High-boiling organic solvent/ coupler ratio | Fog*1) | Color*2) density | R %*3) | Remarks |
|---|---|---|---|---|---|---|
| 120 | " | 0.0 | −0.03 | 1.89 | 84% | " |

Note:

*1)The difference of the density of the unexposed part from the reference set by Sample 101.

*2)The color density obtained by using, as a reference, the minimum density of each sample at the time when an exposure amount was given which gave a density 2.0 higher than the density at the unexposed part in Sample 101.

*3)The color image remaining ratio at the density of 2.0 at the time when the sample was stored for 2 months at 60° C./70%.

From Table 2, it can be understood that in the case of samples that include Comparative Coupler YC-1, when the high-boiling organic solvent is decreased, the color density drops, and in the case of YC-2, irrespective of the amount of the high-boiling organic solvent, a high density cannot be obtained, while in the case of the samples of the present invention, even when the amount of the high-boiling organic solvent is decreased, the drop of the color density is very slight and an adequate color density is obtained.

In contrast to the samples of the Comparative Couplers, the samples of the present invention are also excellent in color image storage stability, which property remains even if the amount of the used high-boiling solvent is decreased.

EXAMPLE 3

Samples 210, 202, and 209 to 216 were prepared in the same way as Samples 101, 102, and 109 to 116 of Example 2, except that the amounts of gelatin in the eleventh to the thirteenth layers were adjusted such that the ratio of the total weight of the used coupler and the high-boiling organic solvent to the weight of the gelatin used in the same layer might be constant, and the coating amount of the coupler of each Sample was adjusted to give approximately the same gradation.

The obtained Samples were exposed to white light through a pattern for the measurement of MTF and were developed in accordance with Example 2. After the development processing, to evaluate the sharpness of each Sample, the MTF value at a spatial frequency of 25 cycles/mm was measured using red light. The results are shown in Table 3.

As is apparent from Table 3, the yellow coupler in the samples of the present invention enables improving the sharpness when the amount of high-boiling organic solvent to be added is reduced and also the amount of gelatin corresponding to that amount is reduced. Of course, remarkable lowering of film property does not occur In the results in Table 3 the MTF-value difference of 0.01 is one that can be identified by one's eyes as an apparent difference of image quality. Further, since the scattering of MTF measured value is ±0.01 or less, the difference of 0.05 in this example is considered as an extremely large difference.

EXAMPLE 4

Samples 301, 302, and 309 to 312 were prepared in the same way as Samples 201, 202, and 209 to 212, except that Comparative Couplers EX-10 and EX-12 in the ninth layer were respectively changed to EX-13 (in an amount of 0.07) and EX-14 (in an amount of 0.015), and the amounts of the high-boiling organic solvents HBS-1 and HBS-2 were respectively changed to 0.14 and 0.06. The amount of gelatin was adjusted so that, in each Sample, the ratio of the total weight of the coupler and the high-boiling organic solvent in the ninth layer to the weight of the gelatin would be constant.

The resulting Samples were exposed to white light through a pattern for the measurement of MTF and were developed in accordance with Example 2. After the development processing, to evaluate the sharpness of each Sample, the MTF value at a spatial frequency of 25 cycles/mm was measured using red light. The results are shown in Table 4.

TABLE 3

| Sample No. | Coupler | High-boiling organic solvent/ coupler ratio | Color density | MTF value | Remarks |
|---|---|---|---|---|---|
| 201 | YC-1 | 1.0 | 2.00 | 0.39 | Comparative example |
| 202 | " | 0.3 | 1.98 | 0.42 | " |
| 209 | Y-53 | 1.0 | 2.01 | 0.40 | " |
| 210 | " | 0.3 | 2.00 | 0.45 | This invention |
| 211 | " | 0.1 | 1.98 | 0.46 | " |
| 212 | " | 0.0 | 2.01 | 0.45 | " |
| 213 | Y-57 | 1.0 | 2.01 | 0.41 | Comparative example |
| 214 | " | 0.3 | 2.02 | 0.45 | This invention |
| 215 | " | 0.1 | 1.99 | 0.46 | " |
| 216 | " | 0.0 | 1.97 | 0.45 | " |

EX-13

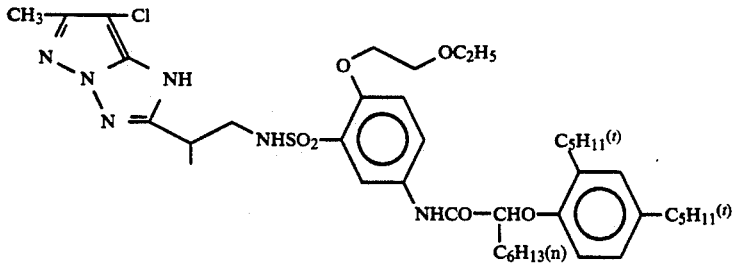

EX-14

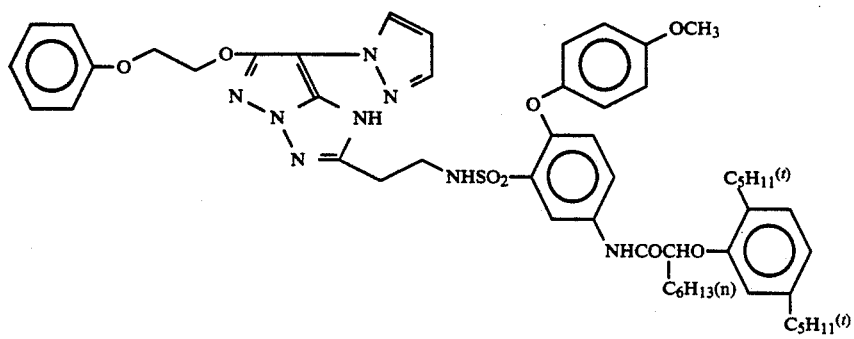

TABLE 4

| Sample No. | Yellow Coupler | Ratio of water soluble part/gelatin | Magenta coupler | Cyan color image MTF | Remarks |
|---|---|---|---|---|---|
| 201 | YC-1 | 1.0 | EX-10, EX-12 | 0.39 | Comparative example |
| 202 | " | 0.3 | " | 0.42 | " |
| 209 | Y-53 | 1.0 | " | 0.40 | " |
| 210 | " | 0.0 | " | 0.45 | This invention |
| 211 | YC-2 | 1.0 | " | 0.46 | " |
| 212 | " | 0.3 | " | 0.45 | " |
| 301 | " | 0.1 | EX-13, EX-14 | 0.40 | Comparative example |
| 302 | " | 0.0 | " | 0.44 | " |
| 309 | Y-53 | 1.0 | " | 0.42 | " |
| 310 | " | 0.3 | " | 0.45 | This invention |
| 311 | " | 0.1 | " | 0.47 | " |
| 312 | " | 0.0 | " | 0.47 | " |

As is apparent from the results in Table 4, in the present invention when the coupler is used in combination with a pyrazoloazole-series coupler that is represented by EX-13 and EX-14, sharpness can be greatly improved.

EXAMPLE 5

A multilayer color photographic paper was prepared by multi-coatings composed of the following layer composition on a prime-coated triacetate cellulose film base having a thickness of 127 μm, and it was designated as Sample 401. Figures shown in the composition represent coating amount (g/m²). The effects of the compound added are not restricted to the usage described.

| | |
|---|---|
| First layer: Halation-preventing layer | |
| Black colloidal silver | 0.25 g |
| Gelatin | 1.9 g |
| UV-absorbent U-1 | 0.04 g |
| UV-absorbent U-2 | 0.1 g |
| UV-absorbent U-3 | 0.1 g |
| UV-absorbent U-4 | 0.1 g |
| UV-absorbent U-6 | 0.1 g |
| High boiling organic solvent Oil-1 | 0.1 g |
| Second layer: Intermediate layer | |
| Gelatin | 0.40 g |
| Compound Cpd-D | 10 mg |

-continued

| | |
|---|---|
| High-boiling organic solvent Oil-3 | 0.1 g |
| Dye D-4 | 0.4 mg |
| Third layer: Intermediate layer | |
| Silver iodobromide emulsion of fine grains surface and inner part of which were fogged (av. grain diameter: 0.06 μm, deviation coefficient: 18%, AgI content: 1 mol %) | silver 0.05 g |
| Gelatin | 0.4 g |
| Fourth layer: | |
| Low sensitivity red-sensitive emulsion layer | |
| Emulsion A | silver 0.2 g |
| Emulsion B | silver 0.3 g |
| Gelatin | 0.8 g |
| Coupler C-1 | 0.15 g |
| Coupler C-2 | 0.05 g |
| Coupler C-7 | 0.05 g |
| Compound Cpd-D | 10 mg |
| High-boiling organic solvent Oil-2 | 0.1 g |
| Fifth layer: | |
| Medium sensitivity red-sensitive emulsion layer | |
| Emulsion B | silver 0.2 g |
| Emulsion C | silver 0.3 g |
| Gelatin | 0.8 g |
| Coupler C-1 | 0.2 g |
| Coupler C-2 | 0.05 g |
| Coupler C-3 | 0.2 g |
| High boiling organic solvent Oil-2 | 0.1 g |
| Sixth layer: | |

-continued

| | |
|---|---|
| High sensitivity red-sensitive emulsion layer | |
| Emulsion D | silver 0.4 g |
| Gelatin | 1.1 g |
| Coupler C-1 | 0.3 g |
| Coupler C-3 | 0.7 g |
| Additive P-1 | 0.1 g |
| Seventh layer: Intermediate layer | |
| Gelatin | 0.6 g |
| Additve M-1 | 0.3 g |
| Color-mix preventing agent Cpd-K | 2.6 mg |
| UV-absorbent U-1 | 0.1 g |
| UV-absorbent U-6 | 0.1 g |
| Dye D-1 | 0.02 g |
| Eighth layer: Intermediate layer | |
| Silver iodobromide emulsion of fine grains surface and inner part of which were fogged (av. grain diameter: 0.06 μm, deviation coefficient: 16%, AgI content: 0.3 mol %) | silver 0.02 g |
| Gelatin | 1.0 g. |
| Additive P-1 | 0.2 g |
| Color-mix preventing agent Cpd-J | 0.1 g |
| Color-mix preventing agent Cpd-A | 0.1 g |
| Ninth layer: | |
| Low sensitivity green-sensitive emulsion layer | |
| Emulsion E | silver 0.3 g |
| Emulsion F | silver 0.1 g |
| Emulsion G | silver 0.1 g |
| Gelatin | 0.5 g |
| Coupler C-5 | 0.05 g |
| Coupler C-6 | 0.20 g |
| Compound Cpd-B | 0.03 g |
| Compound Cpd-D | 10 mg |
| Compound Cpd-E | 0.02 g |
| Compound Cpd-F | 0.02 g |
| Compound Cpd-G | 0.02 g |
| Compound Cpd-H | 0.02 g |
| High-boiling organic solvent Oil-1 | 0.1 g |
| High-boiling organic solvent Oil-2 | 0.1 g |
| Tenth layer: | |
| Medium sensitivity green-sensitive emulsion layer | |
| Emulsion G | silver 0.3 g |
| Emulsion H | silver 0.1 g |
| Gelatin | 0.6 g |
| Coupler C-5 | 0.2 g |
| Coupler C-6 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High-boiling organic solvent Oil-2 | 0.01 g |
| Eleventh layer: | |
| High sensitivity green-sensitive emulsion layer | |
| Emulsion I | silver 0.5 g |
| Gelatin | 1.0 g |
| Coupler C-4 | 0.3 g |
| Coupler C-6 | 0.1 g |
| Compound Cpd-B | 0.08 g |
| Compound Cpd-E | 0.02 g |
| Conpound Cpd-F | 0.02 g |
| Compound Cpd-G | 0.02 g |
| Compound Cpd-H | 0.02 g |
| High-boiling organic solvent Oil-1 | 0.02 g |
| High-boiling organic solvent Oil-2 | 0.02 g |
| Twelfth layer: Intermediate layer | |
| Gelatin | 0.6 g |
| Dye D-1 | 0.1 g |

-continued

| | |
|---|---|
| Dye D-2 | 0.05 g |
| Dye D-3 | 0.07 g |
| Thirteenth layer: Yellow filter layer | |
| Yellow colloidal slver | silver 0.1 g |
| Gelatin | 1.1 g |
| Color-mix preventing agent Cpd-A | 0.01 g |
| High-boiling organic solvent Oil-1 | 0.01 g |
| Fourteenth layer: Intermediate layer | 0.6 g |
| Gelatin | |
| Fifteenth layer: | |
| Low sensitivity blue-sensitive emulsion layer | |
| Emulsion J | silver 0.4 g |
| Emulsion K | silver 0.15 g |
| Emulsion L | silver 0.05 g |
| Gelatin | 0.8 g |
| Coupler YC-5 | 0.55 g |
| Sixteen layer: | |
| Medium sensitivity blue-sensitive emulsion layer | |
| Emulsion L | silver 0.15 g |
| Emulsion M | silver 0.35 g |
| Gelatin | 0.9 g |
| Coupler YC-5 | 0.35 g |
| Coupler YC-6 | 0.35 g |
| Seventeenth layer: | |
| High sensitivity blue-sensitivity emulsion layer | |
| Emulsion N | silver 0.4 g |
| Gelatin 1.2 | g |
| Coupler YC-6 | 0.65 g |
| Eighteenth layer: First protective layer | |
| Gelatin | 0.7 g |
| UV-absorbent U-1 | 0.04 g |
| UV-absorbent U-2 | 0.01 g |
| UV-absoebent U-3 | 0.03 g |
| UV-absorbent U-4 | 0.03 g |
| UV-absorbent U-5 | 0.05 g |
| UV-absorbent U-6 | 0.05 g |
| High-boiling organic solvent Oil-1 | 0.02 g |
| Formalin scavenger | |
| Cpd-C | 0.2 g |
| Cpd-I | 0.4 g |
| Dye D-3 | 0.05 g |
| Ninteenth layer: Second protective layer | |
| Colloidal silver | silver 0.1 mg |
| Silver iodobromide emulsion of fine grain (av. grain diameter: 0.06 μm, AgI content: 1 mol %) | silver 0.1 g |
| Gelatin | 0.4 g |
| Twentieth layer: Third protective layer | |
| Gelatin | 0.4 g |
| Poly(methylmethacrylate) (av. grain diameter: 1.5 μm) | 0.1 g |
| Copolymer of metylmethacrylate and acrylic acid (4:6), av. grain diameter 1.5 μm) | 0.1 g |
| Silicone oil | 0.03 g |
| Surface-active agent W-1 | 3.0 mg |
| Surface-active agent W-2 | 0.03 g |

Further, to all emulsion layers, in addition to the above-described components, additives F-1 to F-8 were added. Further, to each layer, in addition to the above-described components, gelatin hardener H-1 and surface-active agents W-3 and W-4 for coating and emulsifying were added.

Further, as antifungal and antibacterial agents, phenol, 1,2-benzisothiazoline-3-one, 2-phenoxyethanol and phenetylalcol were added.

Silver iodobromide emulsions used are as follows:

| Emulsion | Feature of grain | Average grain-diameter (μm) | Deviation coefficient (%) | AgI content (%) |
|---|---|---|---|---|
| A | Monodisperse tetradecahedral grain | 0.25 | 16 | 3.7 |
| B | Monodisperse cubic internal latent image-type grain | 0.30 | 10 | 3.3 |
| C | Monodisperse tetradecahedral grain | 0.30 | 18 | 5.0 |
| D | Polydisperse twin crystal grain | 0.60 | 25 | 2.0 |
| E | Monodisperse cubic grain | 0.17 | 17 | 4.0 |
| F | Monodisperse cubic grain | 0.20 | 16 | 4.0 |

-continued

| Emulsion | Feature of grain | Average grain-diameter (μm) | Deviation coefficient (%) | AgI content (%) |
|---|---|---|---|---|
| G | Monodisperse cubic internal latent image-type grain | 0.25 | 11 | 3.5 |
| H | Monodisperse cubic internal latent image-type grain | 0.30 | 9 | 3.5 |
| I | Polydisperse tabular grain, average aspect ratio: 4.0 | 0.80 | 28 | 1.5 |
| J | Monodisperse tetradecahedral grain | 0.30 | 18 | 4.0 |
| K | Monodisperse tetradecahedral grain | 0.37 | 17 | 4.0 |
| L | Monodisperse cubic internal latent image-type grain | 0.46 | 14 | 3.5 |
| M | Monodisperse cubic grain | 0.55 | 13 | 4.0 |
| N | Polydisperse tabular grain, average aspect ratio: 7.0 | 1.00 | 33 | 1.3 |

Spectral-sensitizing of Emulsions A to N

| Emulsion | Spectral-sensitizing dye added | Amount of Added g per 1 mol of Silver Halide | Time when spectral-sensitizing dye added |
|---|---|---|---|
| A | S-1 | 0.025 | Immediately after chemical sensitization |
| | S-2 | 0.25 | Immediately after chemical sensitization |
| B | S-1 | 0.01 | Immediately after grain formation ended |
| | S-2 | 0.25 | Immediately after grain formation ended |
| C | S-1 | 0.02 | Immediately after chemical sensitization |
| | S-2 | 0.25 | Immediately after chemical sensitization |
| D | S-1 | 0.01 | Immediately after chemical sensitization |
| | S-2 | 0.10 | Immediately after chemical sensitization |
| | S-7 | 0.01 | Immediately after chemical sensitization |
| E | S-3 | 0.5 | Immediately after chemical sensitization |
| | S-4 | 0.1 | Immediately after chemical sensitization |
| F | S-3 | 0.3 | Immediately after chemical sensitization |
| | S-4 | 0.1 | Immediately after chemical sensitization |
| G | S-3 | 0.25 | Immediately after grain formation ended |
| | S-4 | 0.08 | Immediately after grain formation ended |
| H | S-3 | 0.2 | During grain formation |
| | S-4 | 0.06 | During grain formation |
| I | S-3 | 0.3 | Immediately before chemical sensitization |
| | S-4 | 0.07 | Immediately before chemical sensitization |
| | S-8 | 0.1 | Immediately before chemical sensitization |
| J | S-6 | 0.2 | During grain formation |
| | S-5 | 0.05 | During grain formation |
| K | S-6 | 0.2 | During grain formation |
| | S-5 | 0.05 | During grain formation |
| L | S-6 | 0.22 | Immediately after grain formation ended |
| | S-5 | 0.06 | Immediately after grain formation ended |
| M | S-6 | 0.15 | Immediately after chemical sensitization |
| | S-5 | 0.04 | Immediately after chemical sensitization |
| N | S-6 | 0.22 | Immediately after grain formation ended |
| | S-5 | 0.06 | Immediately after grain formation ended |

C-1

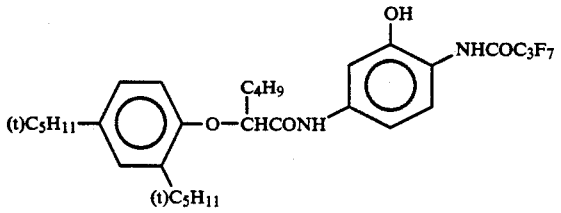

C-2

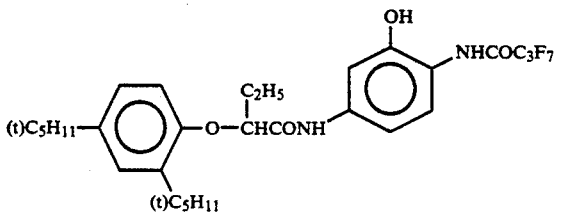

C-3

-continued
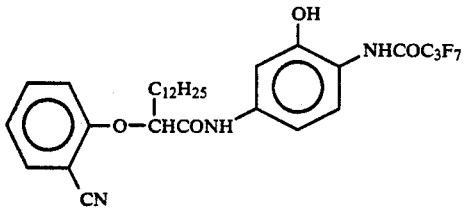
C-4
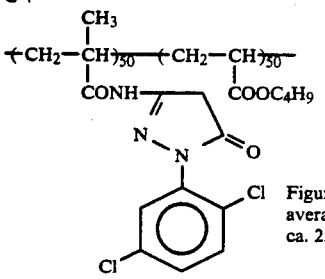
Figures represent wt.%
average mol. wt.:
ca. 25,000
C-5
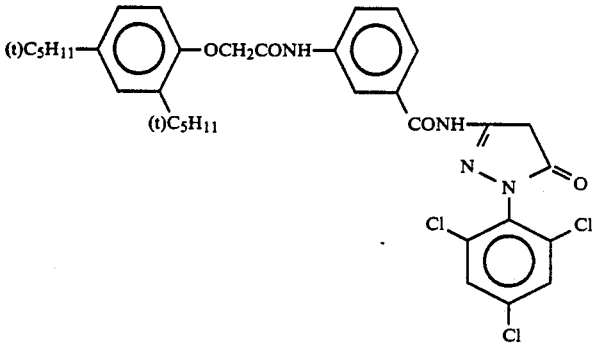
C-6
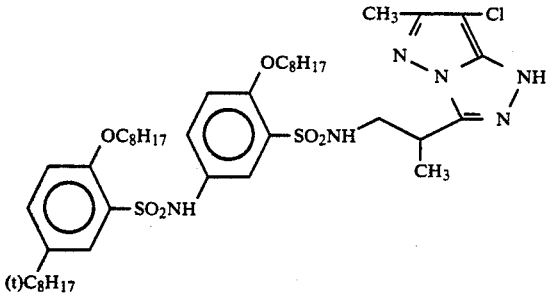
C-7
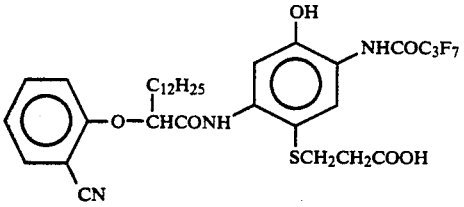
Oil-1 Dibutyl phthalate
Oil-2 Tricrezyl phosphate
Oil-3 $(C_2H_5)_2NCOC_{11}H_{23}$
Cpd-A -continued
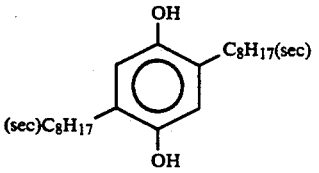
Cpd-B
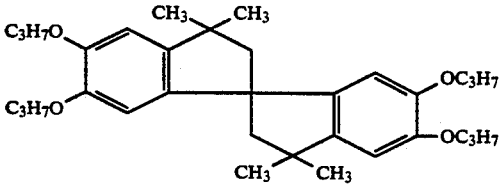
Cpd-C
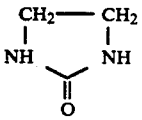
Cpd-D
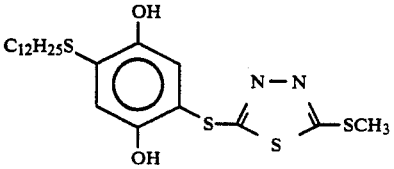
Cpd-E
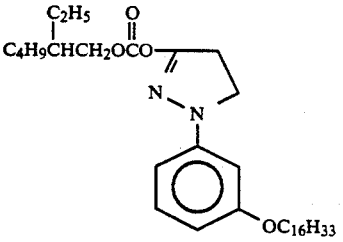
Cpd-F
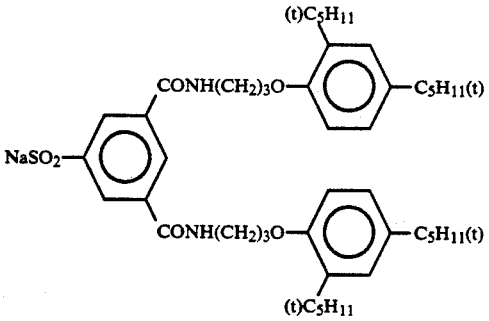
Cpd-G
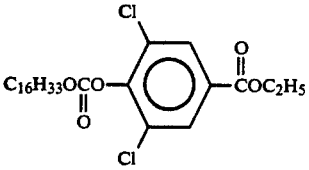
Cpd-H -continued
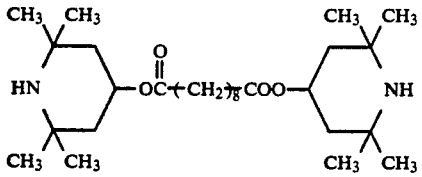
Cpd-I
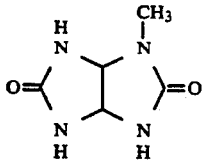
Cpd-J
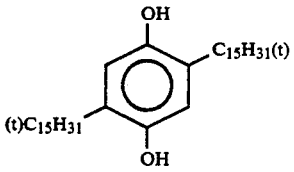
Cpd-K
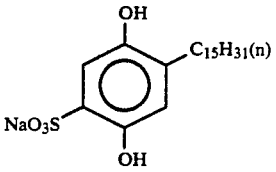
U-1
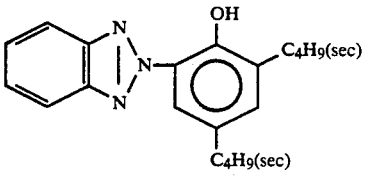
U-2
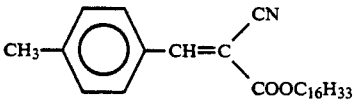
U-3
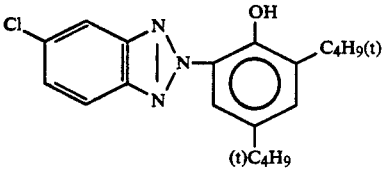
U-4
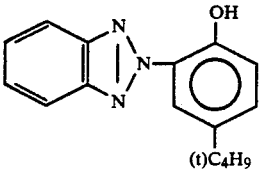
U-5

-continued
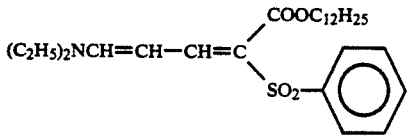
U-6
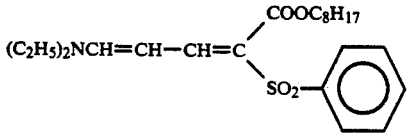
S-1
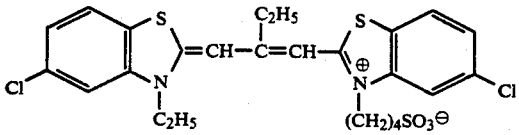
S-2
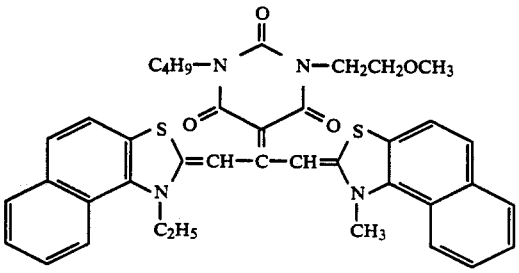
S-3
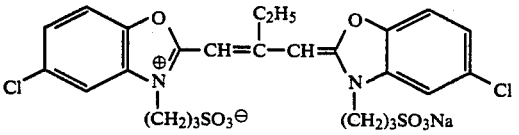
S-4
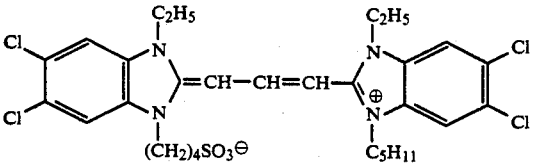
S-5
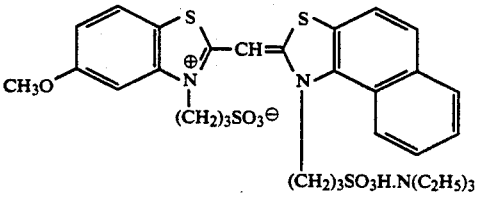
S-6
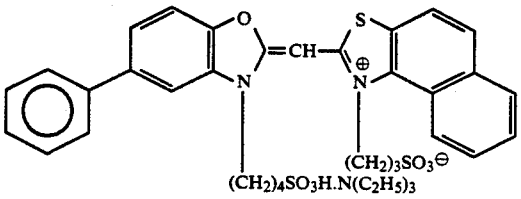
S-7

-continued
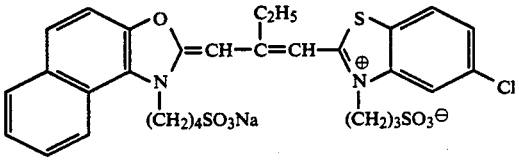
S-8
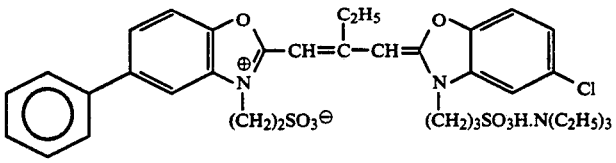
D-1
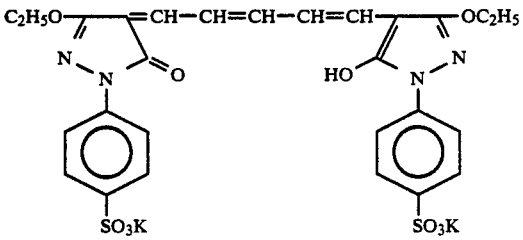
D-2
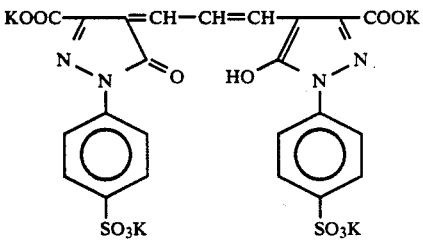
D-3
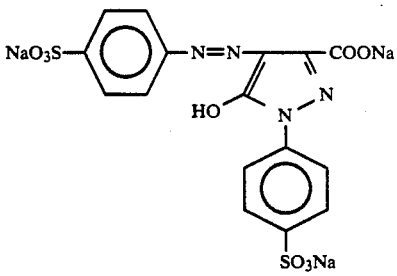
D-4
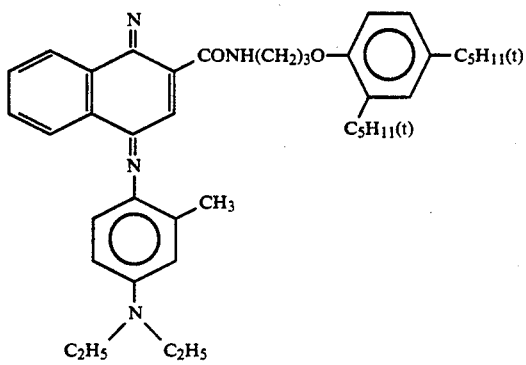
H-1

-continued
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2\overset{\oplus}{N}(CH_3)_3$
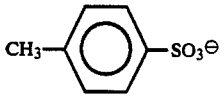
W-2
$C_8F_{17}SO_2N(C_3H_7)CH_2COOK$
W-3
$NaO_3S{-}CH(CH_2COOCH_2CH(C_2H_5)C_4H_9)COOCH_2CH(C_2H_5)C_4H_9$
W-4
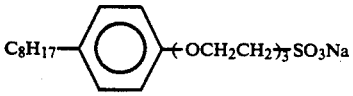
P-1
$\text{-}(CH_2{-}CH(CONHC_4H_9(t))\text{-})_n\text{-}$
M-1
$\text{-}(CH_2{-}CH(COOC_4H_9)\text{-})_n\text{-}$
F-1
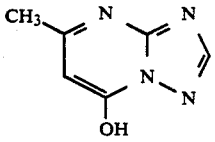
F-2
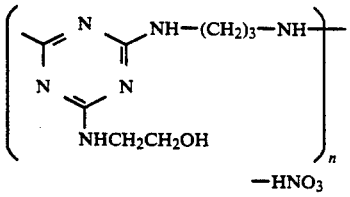
F-3
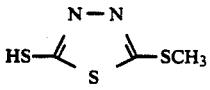
F-4
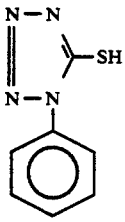
F-5

-continued

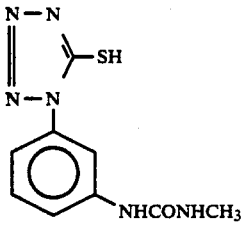

F-6

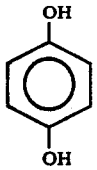

F-7

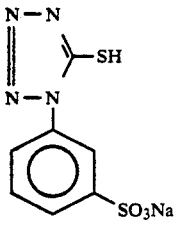

F-8

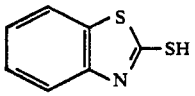

Samples were prepared by changing yellow couplers for comparison in the fifteenth to seventeenth layers to couplers Y-8, Y-53, and Y-57, respectively. The thus obtained samples were processed by the processing process shown below after an exposure to light in the same manner as in Example 2. In this experiment, as in Example 2, it was confirmed that the samples of the present invention give a high color density even when a small amount of high-boiling organic solvent was used.

| Processing process | | |
|---|---|---|
| Process | Time | Temperature |
| First development | 6 min | 38° C. |
| Water-washing | 2 min | " |
| Reversal | 2 min | " |
| Color development | 6 min | " |
| Conditioning | 2 min | " |
| Bleaching | 6 min | " |
| Fixing | 4 min | " |
| Water-washing | 4 min | " |
| Stabilizing | 1 min | Ordinary temperature |
| Drying | | |

| First developing solution | |
|---|---|
| Water | 700 ml |
| Heptasodium nitrilo-N,N,N-trimethylenephosphonate | 2 g |
| Sodium sulfite | 20 g |
| Hydroquinone monosulfonate | 30 g |
| Sodium carbonate (monohydrate) | 30 g |
| 1-Phenyl-4-methyl-4-hydroxymethyl-3-pyrazolydone | 2 g |

-continued

| | |
|---|---|
| Potassium bromide | 2.5 g |
| Potassium thiocyanate | 1.2 g |
| Potassium iodide (0.1% aqueous solution) | 2 ml |
| Water to make | 1,000 ml |
| Reversal solution | |
| Water | 700 ml |
| Heptasodium nitrilo-N,N,N-trimethylenephosphonate | 3 g |
| Stannous chloride (dihydrate) | 1 g |
| p-Amylphenol | 0.1 g |
| Sodium hydoxide | 8 g |
| Glacial acetic acid | 15 ml |
| Water to make | 1,000 ml |
| Color developer | |
| Water | 700 ml |
| Heptasodium nitrilo-N,N,N-trimethylenephosphonate | 3 g |
| Sodium sulfite | 7 g |
| Sodium tertiary phosphate (12-hydrate) | 36 g |
| Potassium bromide | 1 g |
| Potassium iodide (0.1% solution | 90 ml |
| Sodium hydroxide | 3 g |
| Cytrazinic acid | 1.5 g |
| N-Ethyl-N-( -methanesulfonamidoethyl)-3-methyl-4-aminoaniline sulfate | 11 g |
| 3,6-Dithiaoctane-1,8-diol | 1 g |
| Water to make | 1,000 ml |
| Conditioning solution | |
| Water | 700 ml |
| Sodium sulfite | 12 g |
| Sodium ethylenetetraacatate (dihydrate) | 8 g |
| Thioglycerol | 0.4 ml |
| Glacial acetic acid | 3 ml |
| Water to make | 1,000 ml |
| Bleaching solution | |
| Water | 800 ml |
| Dodium ethylenediaminetetraacetate (dihydrate) | 8 g |

-continued

| | |
|---|---|
| Iron (III) ammonium ethylenediamine-tetraacetate (dihydrate) | 120 g |
| Potassium bromide | 100 g |
| Water to make | 1,000 ml |
| Fixing solution | |
| Water | 800 ml |
| Sodium thiosulfate | 80.0 g |
| Sodium sulfite | 5.0 g |
| Sodium bisulfite | 5.0 g |
| Water to make | 1,000 ml |
| Stabilizing solution | |
| Water | 800 ml |
| Formalin (37 wt. %) | 5.0 ml |
| Fuji Driwell (surface-active agent, manufactured by Fuji Photo Film Co., Ltd.) | 5.0 ml |
| Water to make | 1,000 ml |

EXAMPLE 6

A monolayer color photographic material was prepared in the same procedure as Sample 001 in Example 1, except that the yellow coupler YC-1 was changed to yellow coupler YC-65. This color photographic material was designated as Sample 601.

Samples 602 to 640 were prepared in the same procedure as Sample 601, except that yellow coupler and the ratio of high-boiling organic solvent (HBS-1) to coupler were changed as shown in Table 5 below, respectively.

Each of Samples 601 to 640 was subjected to the same exposure to light and processing as in Example 1, and then evaluated for the color forming property of coupler by a sensitometry measurement.

Further, the above prepared samples were stored for 3 months in an atmosphere kept at 60° C. and 70% RH. After the storage, each sample was again subjected to a sensitometry measurement to evaluate the fastness of color image.

Results are shown in Table 5.

In Table 5, the maximum color density (Dm) represents the difference between a color density that reached a plateau in relation to the exposure amount and a color density at a fogged area. It can be said that the higher the maximum density is, the less the coating amount is practically required, and such coupler is an excellent coupler.

Further, in Table 5, in order to show the oil amount dependence for color forming property of a coupler, a ratio of color density (%) based on the maximum color density when the ratio of high-boiling organic solvent to coupler being 1.0, is also described. It can be said that such a coupler that the ratio of color density does not drop greatly even after reducing the amount of high-boiling organic solvent is an excellent coupler because of the oil amount dependence being little. By using such coupler, it becomes possible to make photographic material thin and to improve the sharpness of a color image.

TABLE 5

| Sample No. | Coupler | Ratio of high-boiling solvent/coupler | Maximum color density (Dm) | Ratio of color density (%) | Fading ratio 60° C. 70% 3 months (%) | Remarks |
|---|---|---|---|---|---|---|
| 601 | Y-65 | 1.0 | 1.78 | Basis | 88 | Comparative example |
| 602 | " | 0.5 | 1.72 | 96.6 | 89 | " |
| 603 | " | 0.3 | 1.68 | 94.4 | 89 | This invention |
| 604 | " | 0.1 | 1.65 | 92.7 | 88 | " |
| 605 | " | 0.0 | 1.59 | 89.3 | 87 | " |
| 606 | Y-68 | 1.0 | 1.93 | Basis | 79 | Comparative example |
| 607 | " | 0.5 | 1.88 | 97.4 | 80 | " |
| 608 | " | 0.3 | 1.81 | 93.8 | 78 | This invention |
| 609 | " | 0.1 | 1.75 | 90.7 | 78 | " |
| 610 | " | 0.0 | 1.66 | 86.0 | 79 | " |
| 611 | Y-69 | 1.0 | 1.87 | Basis | 92 | Comparative example |
| 612 | " | 0.5 | 1.81 | 96.8 | 91 | " |
| 613 | " | 0.3 | 1.73 | 92.5 | 92 | This invention |
| 614 | " | 0.1 | 1.68 | 89.8 | 92 | " |
| 615 | " | 0.0 | 1.62 | 86.6 | 91 | " |
| 616 | Y-70 | 1.0 | 1.91 | Basis | 93 | Comparative example |
| 617 | " | 0.5 | 1.83 | 95.8 | 94 | " |
| 618 | " | 0.3 | 1.77 | 92.7 | 94 | This invention |
| 619 | " | 0.1 | 1.72 | 90.1 | 93 | " |
| 620 | " | 0.0 | 1.65 | 86.4 | 92 | " |
| 621 | Y-66 | 1.0 | 1.79 | Basis | 88 | Comparative example |
| 622 | " | 0.5 | 1.73 | 96.6 | 89 | " |
| 623 | " | 0.3 | 1.70 | 95.0 | 88 | This invention |
| 624 | " | 0.1 | 1.67 | 93.3 | 88 | " |
| 625 | " | 0.0 | 1.61 | 89.9 | 87 | " |
| 626 | Y-67 | 1.0 | 1.82 | Basis | 91 | Comparative example |
| 627 | " | 0.5 | 1.79 | 98.4 | 91 | " |
| 628 | " | 0.3 | 1.76 | 96.7 | 90 | This invention |
| 629 | " | 0.1 | 1.72 | 94.5 | 90 | " |
| 630 | " | 0.0 | 1.68 | 92.3 | 89 | " |
| 631 | Y-73 | 1.0 | 1.85 | Basis | 90 | Comparative example |
| 632 | " | 0.5 | 1.81 | 97.8 | 89 | " |
| 633 | " | 0.3 | 1.74 | 94.1 | 90 | This invention |
| 634 | " | 0.1 | 1.69 | 91.4 | 90 | " |
| 635 | " | 0.0 | 1.62 | 87.6 | 88 | " |
| 636 | Y-75 | 1.0 | 1.88 | Basis | 91 | Comparative example |
| 637 | " | 0.5 | 1.83 | 97.3 | 90 | " |
| 638 | " | 0.3 | 1.78 | 94.7 | 91 | This invention |
| 639 | " | 0.1 | 1.72 | 91.5 | 91 | " |
| 640 | " | 0.0 | 1.67 | 88.8 | 90 | " |

As is apparent from the results in Table 5, maximum color densities of samples according to the present invention which used couplers Y-53, Y-65, Y-68, Y-69, Y-70, Y-66, Y-67, Y-73, and Y-75 are high. In particular, although the color densities of samples which used comparative coupler YC-1 decrease remarkably when the ratio of high-boiling organic solvent to coupler lowers to 0.3 or below, samples which used above mentioned couplers enumerated above show only little decrease of color density.

As is apparent from the results in Table 5, samples of the present invention are also excellent in the fastness of image dye. The fastness of image dye was evaluated by a residual ratio of image dye at Dm part after storage for 3 months in a condition of 60° C. and 70% RH.

As is apparent from the results in Table 5, samples of the present invention is less liable to fading than samples which used comparative couplers YC-1 and YC-2. In particular, samples used couplers that are substituted by an ethyl group or a propyl group at 1 position of cycloalkanecarbonyl group, for example, couplers Y-65, Y-69, Y-70, Y-66, Y-67, Y-73, and Y-75 have excellent fastnesses.

EXAMPLE 7

A multilayer color photographic material (Sample 701) having layer-compositions described below was prepared by coating on a triacetate cellulose film base.

Composition of layers

Figures represent coating amounts, in g/m$^2$ of Ag as regards silver halide and colloidal silver, in g/m$^2$ as regards coupler, additive, and casein, and in mol per mol of silver halide in same layer as regards sensitizing dye. The abbreviations representing additives have each meaning shown below. But, for multiple functions were represented by one of them. UV: Ultraviolet ray absorber, Solv: High boiling organic solvent, ExF: Dye, ExS: Sensitizing dye, ExC: Cyan coupler, ExM: Magenta coupler, ExY: Yellow coupler, Cpd: Additive.

| | |
|---|---|
| First layer (Halation preventing layer) | |
| Black colloidal silver | 0.15 |
| Gelatin | 2.33 |
| ExM-2 | 0.11 |
| UV-1 | $3.0 \times 10^{-2}$ |
| UV-2 | $6.0 \times 10^{-2}$ |
| UV-3 | $7.0 \times 10^{-2}$ |
| Solv-1 | 0.16 |
| Solv-2 | 0.10 |
| ExF-1 | $1.0 \times 10^{-2}$ |
| ExF-2 | $4.0 \times 10^{-2}$ |
| ExF-3 | $5.0 \times 10^{-3}$ |
| Cpd-6 | $1.0 \times 10^{-3}$ |
| Second layer (Low sensitivity red-sensitive emulsion layer) | |
| Silver iodobromide emulsion (AgI: 4.0 mol %, uniform AgI-type, diameter corresponding to a sphere: 0.4 μm, deviation coefficient of diameter corresponding to a sphere: 30%, tabular grains, diameter/thickness ratio: 3.0) silver | 0.35 |
| Silver iodobromide emulsion (AgI: 6.0 mol %, inner-higher AgI-type (core/shell ratio: 1/2), diameter corresponding to a sphere: 0.45 μm, deviation coefficient of diameter corresponding to a sphere: 23%, tabular grains, diameter/thickness ratio: 2.0) silver | 0.18 |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | $9.0 \times 10^{-2}$ |

-continued

| | |
|---|---|
| ExC-2 | $2.0 \times 10^{-2}$ |
| ExC-3 | $4.0 \times 10^{-2}$ |
| ExC-4 | $2.0 \times 10^{-2}$ |
| ExC-5 | $8.0 \times 10^{-2}$ |
| ExC-6 | $2.0 \times 10^{-2}$ |
| ExC-9 | $1.0 \times 10^{-2}$ |
| Third layer (Medium sensitivity red-sensitive emulsion layer) | |
| Silver iodobromide emulsion (AgI: 6.0 mol %, inner-higher AgI-type (core/shell ratio: 1/2), diameter corresponding to a sphere: 0.65 μm, deviation coefficient of diameter corresponding to a sphere: 23%, tabular grains, diameter/thickness ratio: 2.0) silver | 0.80 |
| Gelatin | 1.48 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $2.5 \times 10^{-2}$ |
| ExC-4 | $1.6 \times 10^{-2}$ |
| ExC-5 | 0.19 |
| ExC-6 | $2.0 \times 10^{-2}$ |
| ExC-7 | $3.0 \times 10^{-2}$ |
| ExC-8 | $1.0 \times 10^{-2}$ |
| ExC-9 | $3.0 \times 10^{-2}$ |
| Fourth layer (High sensitivity red-sensitive emulsion layer) | |
| Silver iodobromide emulsion (AgI: 9.3 mol %, multi-structure grains of silver ratio of 3:4:2, AgI content: from inner 24, 0, 0.6 mol %, diameter corresponding to a sphere: 0.75 μm, deviation coefficient of diameter corresponding to a sphere: 23%, tabular grains, diameter/thickness ratio: 2.5) silver | 1.05 |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $8.0 \times 10^{-2}$ |
| ExC-4 | $9.0 \times 10^{-2}$ |
| ExC-6 | $2.0 \times 10^{-2}$ |
| ExC-9 | $1.0 \times 10^{-2}$ |
| Solv-1 | 0.20 |
| Solv-2 | 0.53 |
| Fifth layer (Intermediate layer) | |
| Gelatin | 0.62 |
| Cpd-1 | 0.13 |
| Polyethylacrylate latex | $8.0 \times 10^{-2}$ |
| Solv-1 | $8.0 \times 10^{-2}$ |
| ExC-9 | $3.0 \times 10^{-2}$ |
| Sixth layer (Low sensitivity green-sensitive emulsion layer) | |
| Silver iodobromide emulsion (AgI: 4.0 mol %, uniform AgI-type, diameter corresponding to a sphere: 0.45 μm, deviation coefficient of diameter corresponding to a sphere: 15%, tabular grains, diameter/thickness ratio: 4.0) silver | 0.13 |
| Gelatin | 0.31 |
| ExS-3 | $1.0 \times 10^{-4}$ |
| ExS-4 | $3.1 \times 10^{-4}$ |
| ExS-5 | $6.4 \times 10^{-4}$ |
| ExM-1 | 0.12 |
| ExM-3 | $2.1 \times 10^{-2}$ |
| Solv-1 | 0.09 |
| Solv-4 | $7.0 \times 10^{-3}$ |
| Seventh layer (Medium sensitivity green-sensitive emulsion layer) | |
| Silver iodobromide emulsion (AgI: 4.0 mol %, uniform AgI-type, diameter corresponding to a sphere: 0.65 μm, deviation coefficient of diameter corresponding to a sphere: 23%, tabular grains, diameter/thickness ratio: 4.0) silver | 0.31 |
| Gelatin | 0.54 |

-continued

| | |
|---|---|
| ExS-3 | $2.7 \times 10^{-4}$ |
| ExS-4 | $8.2 \times 10^{-4}$ |
| ExS-5 | $1.7 \times 10^{-4}$ |
| ExM-1 | 0.27 |
| ExM-3 | $7.2 \times 10^{-2}$ |
| ExY-1 | $5.4 \times 10^{-2}$ |
| Solv-1 | 0.23 |
| Solv-4 | $1.8 \times 10^{-2}$ |
| Eighth layer (High sensitivity green-sensitive emulsion layer) | |
| Silver iodobromide emulsion (AgI: 9.8 mol %, multi-structure grains of silver ratio of 3:4:2, AgI content: from inner 24, 0, 3 mol %, diameter corresponding to a sphere: 0.81 μm, deviation coefficient of diameter corresponding to a sphere: 23%, multi twins crystal tabular grains, diameter/thickness ratio: 2.5) silver | 0.49 |
| Gelatin | 0.81 |
| ExS-4 | $4.3 \times 10^{-4}$ |
| ExS-5 | $8.6 \times 10^{-5}$ |
| ExS-8 | $2.8 \times 10^{-5}$ |
| ExM-2 | $1.0 \times 10^{-2}$ |
| ExM-5 | $1.0 \times 10^{-2}$ |
| ExM-6 | $3.0 \times 10^{-2}$ |
| ExY-1 | $1.5 \times 10^{-2}$ |
| ExC-1 | $0.4 \times 10^{-2}$ |
| ExC-4 | $2.5 \times 10^{-3}$ |
| ExC-6 | $0.5 \times 10^{-2}$ |
| Solv-1 | 0.12 |
| Cpd-8 | $1.0 \times 10^{-2}$ |
| Ninth layer (Intermediate layer) | |
| Gelatin | 0.56 |
| Cpd-1 | $4.0 \times 10^{-2}$ |
| Poly(ethyl acrylate) latex | $5.0 \times 10^{-2}$ |
| Solv-1 | $3.0 \times 10^{-2}$ |
| UV-4 | $3.0 \times 10^{-2}$ |
| UV-5 | $4.0 \times 10^{-2}$ |
| Tenth layer (Donor layer of double layer effect for red-sensitive emulsion layer) | |
| Silver iodobromide emulsion (AgI: 8.0 mol %, inner-higher AgI-type (core/shell ratio: 1/2), diameter corresponding to a sphere: 0.72 μm, deviation coefficient of diameter corresponding to a sphere: 28%, multilayer twins tabular grains, diameter/thickness ratio: 2.0) silver | 0.67 |
| Silver iodobromide emulsion (AgI: 10.0 mol %, inner-higher AgI-type (core/shell ratio: 1/3), diameter corresponding to a sphere: 0.40 μm, deviation coefficient of diameter corresponding to a sphere: 15%, regular crystal grains) silver | 0.20 |
| Gelatin | 0.87 |
| ExS-3 | $8.7 \times 10^{-4}$ |
| ExM-4 | 0.06 |
| ExM-8 | 0.10 |
| Solv-1 | 0.30 |
| Solv-6 | $3.0 \times 10^{-2}$ |
| Eleventh layer (Yellow filter layer) | |
| Yellow colloidal silver | $9.0 \times 10^{-2}$ |
| Gelatin | 0.84 |
| Cpd-2 | 0.13 |
| Solv-1 | 0.13 |
| Cpd-1 | $5.0 \times 10^{-2}$ |
| Cpd-6 | $2.0 \times 10^{-3}$ |
| H-1 | 0.25 |
| Twelfth layer (Low sensitivity blue-sensitive emulsion layer) | |
| Silver iodobromide emulsion (AgI: 9.0 mol %, multilayer structure grains, diameter corresponding to a sphere: 0.70 μm, deviation coefficient of diameter corresponding to a sphere: 15%, tabular grains, diameter/thickness ratio: 7.0, grains having rearrangement lines of 10 or more observed by 200 kv transmission electron microscope were contained 50% or more of total grains) silver | 0.50 |
| Silver iodobromide emulsion (AgI: 2.5 mol %, uniform AgI-type, diameter corresponding to a sphere: 0.50 μm, deviation coefficient of diameter corresponding to a sphere: 30%, tabular grains, diameter/thickness ratio: 6.0) silver | 0.30 |
| Gelatin | 2.18 |
| ExS-6 | $9.0 \times 10^{-4}$ |
| ExC-1 | 0.05 |
| ExC-2 | 0.10 |
| ExY-2 | 0.05 |
| ExY-3 | 1.09 |
| Solv-1 | 0.55 |
| Thirteenth layer (Intermediate layer) | |
| Gelatin | 0.30 |
| ExY-4 | 0.14 |
| Solv-1 | 0.14 |
| Fourteenth layer (High sensitivity blue-sensitive emulsion layer) | |
| Silver iodobromide emulsion (AgI: 10.0 mol %, inner-higher AgI-type, diameter corresponding to a sphere: 1.2 μm, deviation coefficient of diameter corresponding to a sphere: 25%, multilayer twins tabular grains, diameter/thickness ratio: 2.0) silver | 0.40 |
| Gelatin | 0.59 |
| ExS-6 | $2.6 \times 10^{-4}$ |
| ExY-2 | $1.0 \times 10^{-2}$ |
| ExY-3 | 0.20 |
| ExC-1 | $1.0 \times 10^{-2}$ |
| Solv-1 | 0.10 |
| Fifteenth layer (First protective layer) | |
| Fine grain silver iodobromide emulsion (AgI: 2.0 mol %, uniform AgI-type, diameter corresponding to a sphere: 0.07 μm) silver | 0.12 |
| Gelatin | 0.63 |
| UV-4 | 0.11 |
| UV-5 | 0.18 |
| Solv-5 | $2.0 \times 10^{-2}$ |
| Cpd-5 | 0.10 |
| Sixteenth layer (Second protective layer) | |
| Fine grain silver iodobromide emulsion (AgI: 2.0 mol %, uniform AgI-type, diameter corresponding to a sphere: 0.07 μm) silver | 0.36 |
| Gelatin | 0.85 |
| B-1 (diameter: 2.0 μm) | $8.0 \times 10^{-2}$ |
| B-2 (diameter: 2.0 μm | $8.0 \times 10^{-2}$ |
| B-3 | $2.0 \times 10^{-2}$ |
| W-4 | $2.0 \times 10^{-2}$ |
| H-1 | 0.18 |

In the thus prepared samples, besides above-described components, 1,2-benzisothiazoline-3-one (average amounts of 200 ppm to gelatin), n-butyl-p-hydroxybenzoate (average amounts of ca. 1,000 ppm), and 2-phenoxy ethanol (average amounts of ca. 10,000 ppm) were added. Further, B-4, B-5, F-1, F-2, F-3, F-4, F-5, F-6, F-7, F-8, F-9, F-10, F-11, F-12, and salts of iron, lead, gold, platinum, iridium, and rhodium were contained.

In each layer, surface-active agents W-1, W-2, and W-3 were added as coating aids or emulsion dispersing agent.

UV-1
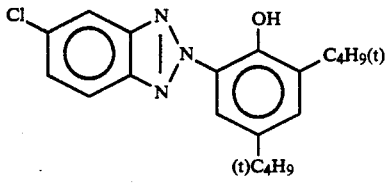
UV-2
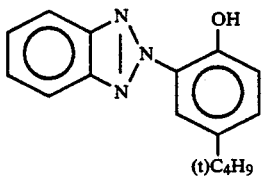
UV-3
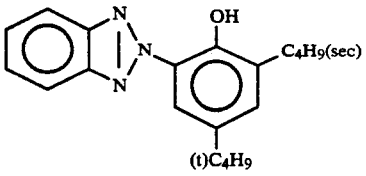
UV-4
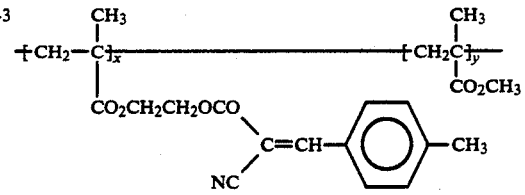
x:y = 70:30 (wt %)
UV-5
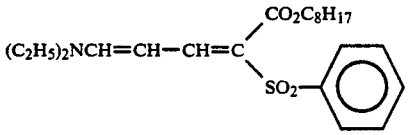
Solv-1
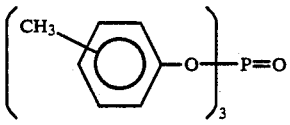
Solv-2
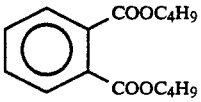
Solv-4
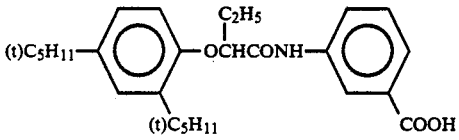
Solv-5
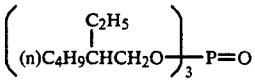
Solv-6
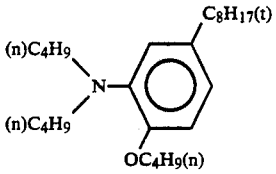
ExF-1
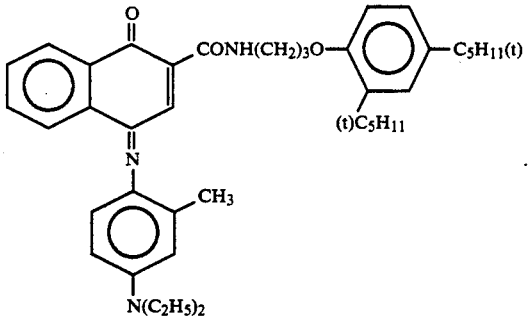
ExF-2
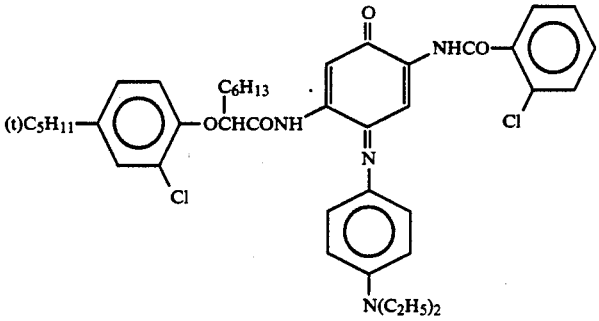

-continued
ExF-3
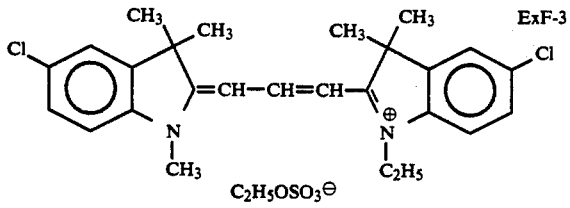
ExC-1
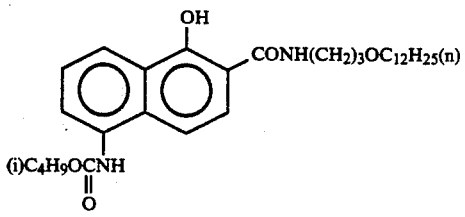
ExC-2
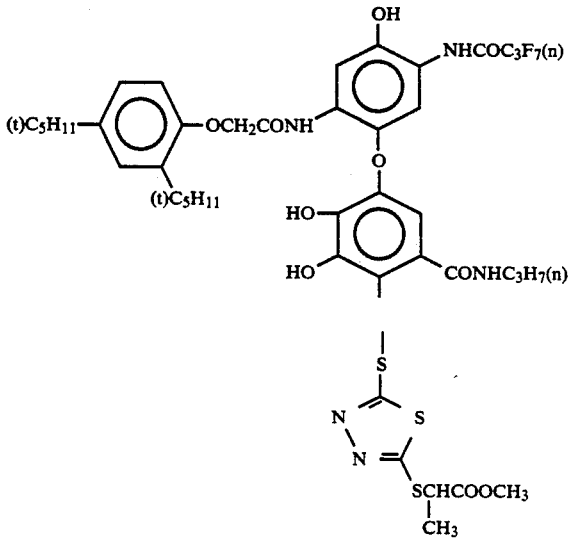
ExC-3
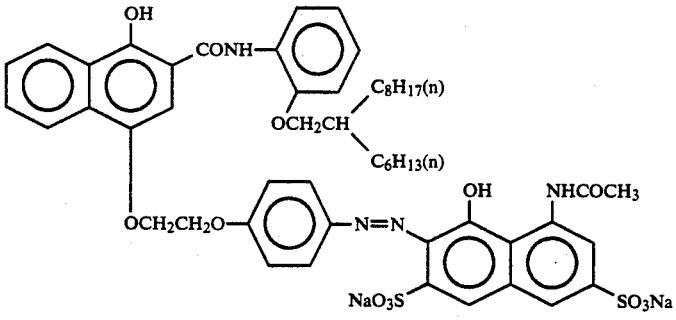
ExC-4
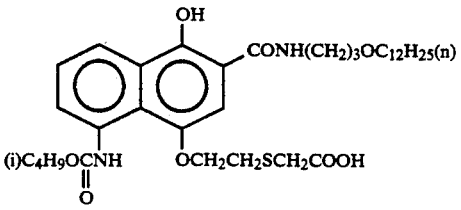
ExC-5
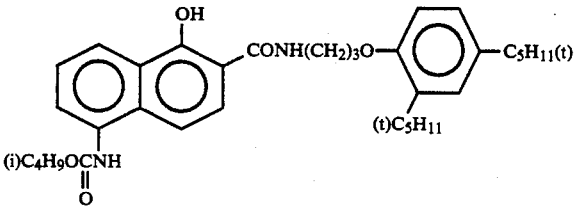

-continued
ExC-6
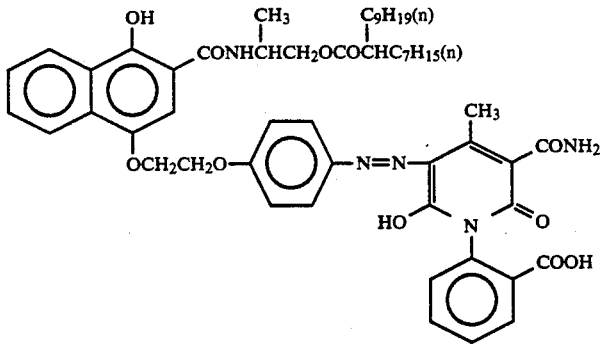
ExC-7
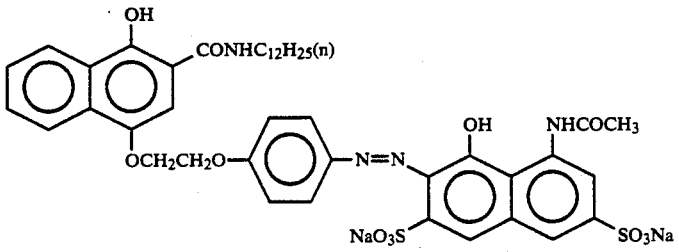
ExC-8
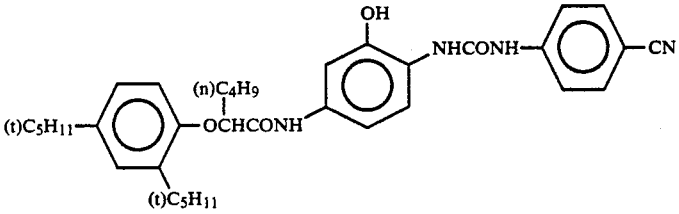
ExC-9
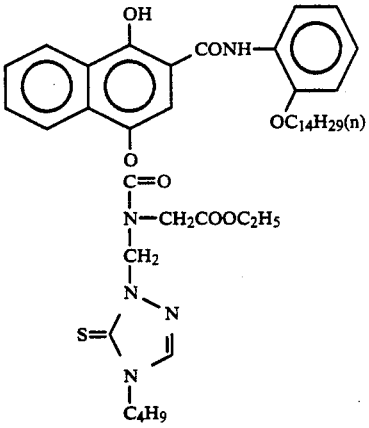
ExM-1
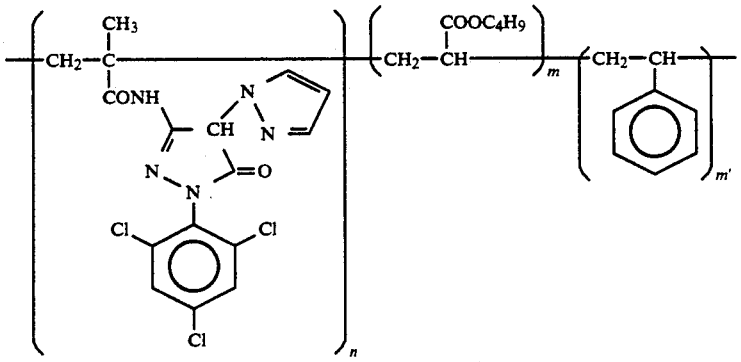

-continued
n = 50
m = 25
m' = 25
mol. wt. ca. 20,000
ExM-2
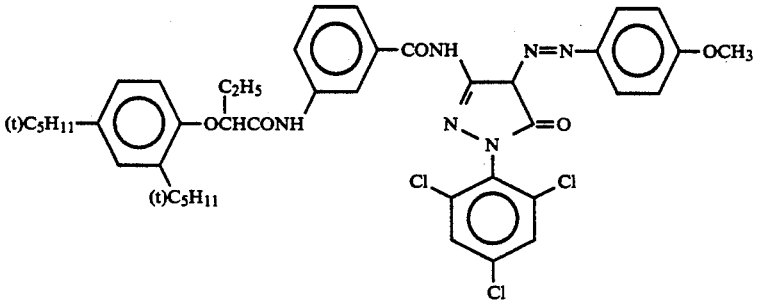
ExM-3
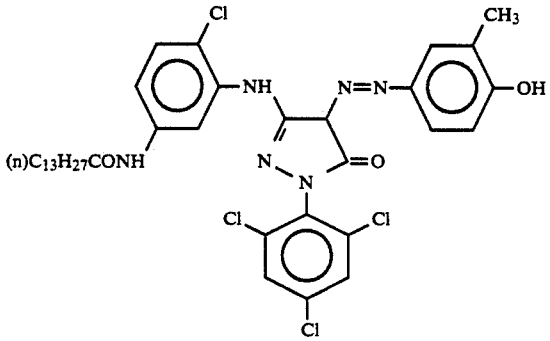
ExM-4
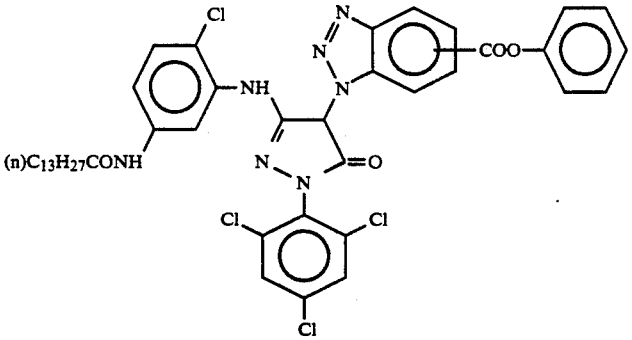
ExM-5
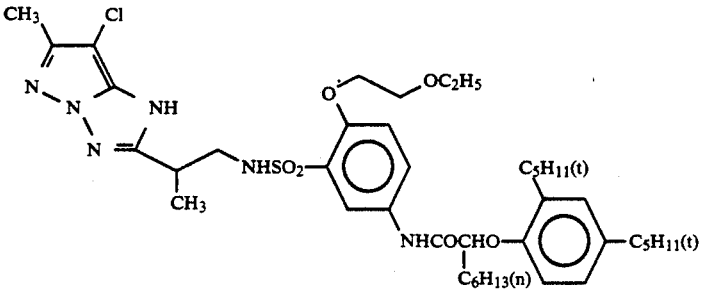

-continued
ExM-6
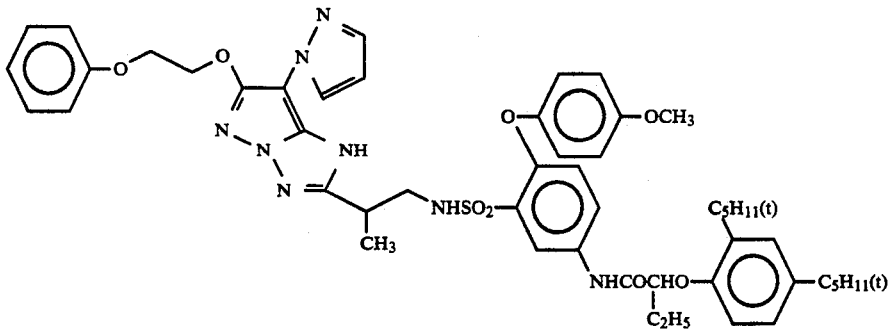
ExM-7
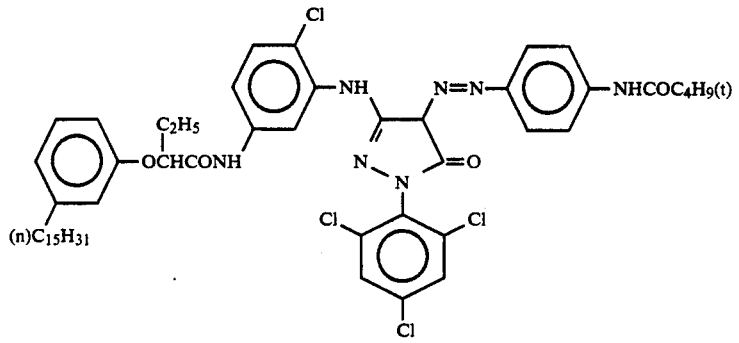
ExM-8
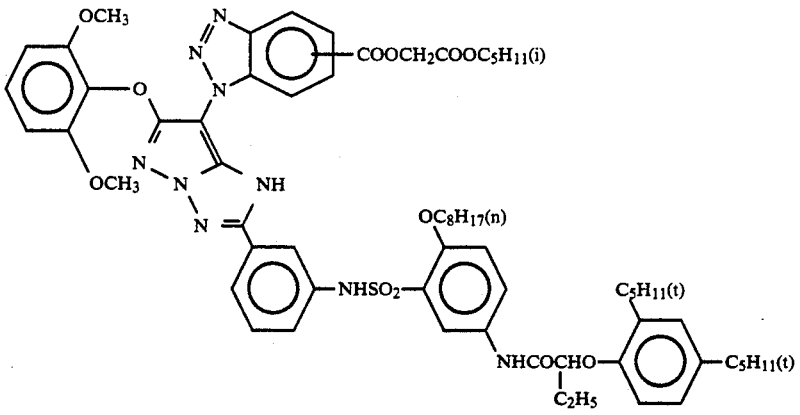
ExY-1
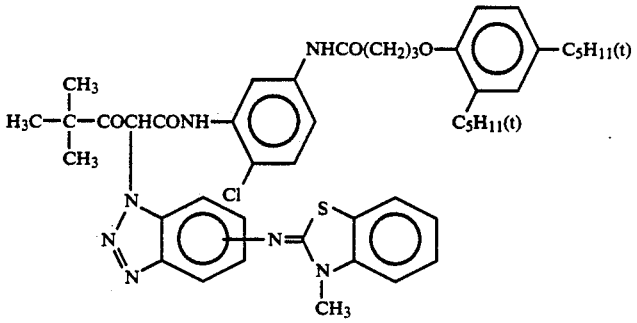

-continued
ExY-2
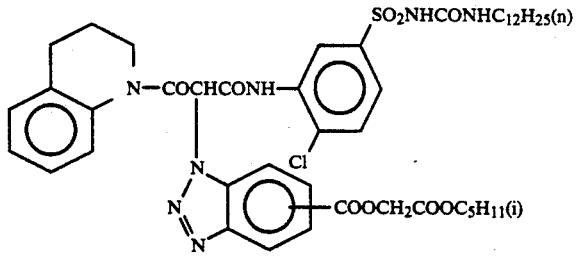
ExY-3
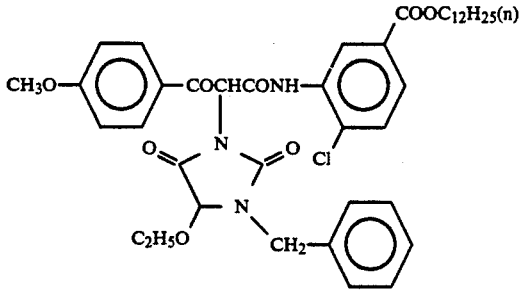
ExY-4
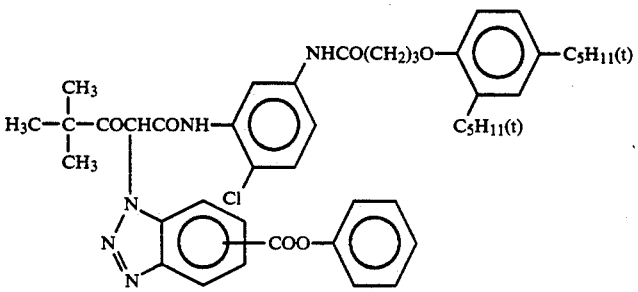
Cpd-1
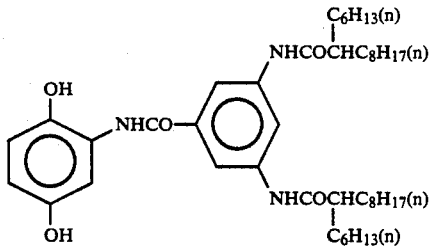
Cpd-2
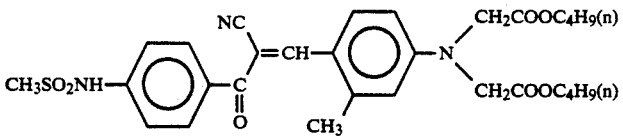
Cpd-5
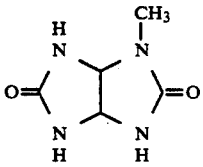
Cpd-6
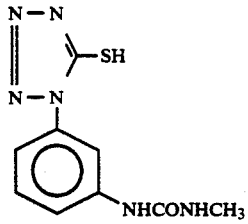
Cpd-8
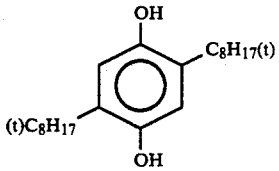
H-1
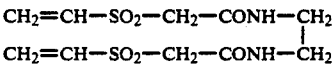

-continued
W-1
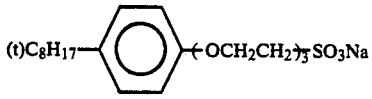
W-2
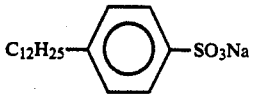
W-3
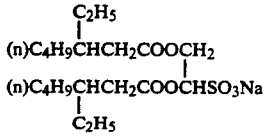
W-4
$C_8F_{17}SO_2N(C_3H_7)CH_2COOK$
ExS-1
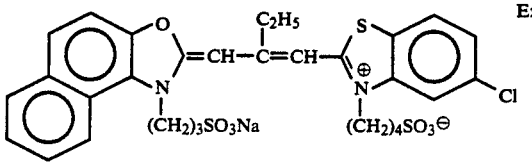
ExS-2
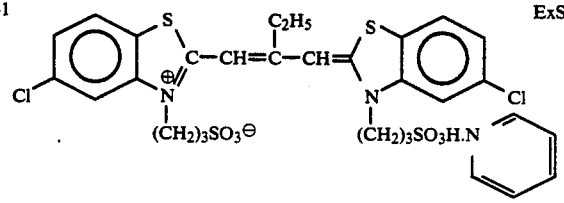
ExS-3
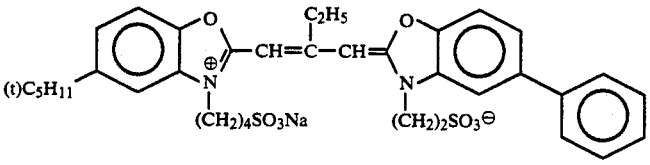
ExS-4
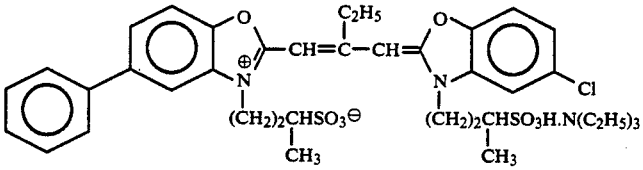
ExS-5
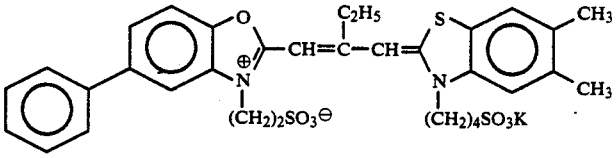
ExS-6
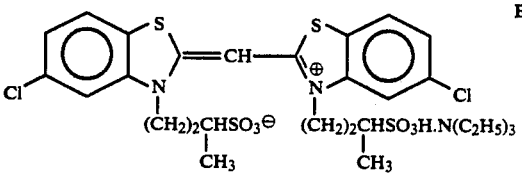
ExS-7
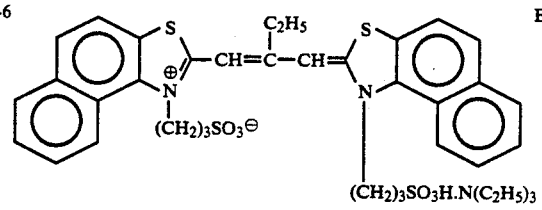
ExS-8
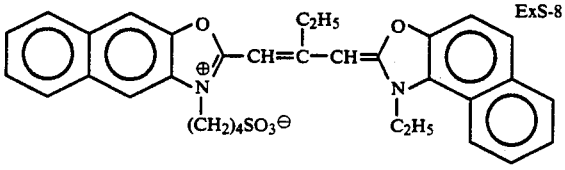
F-1
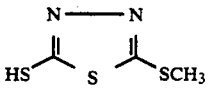

-continued

F-2

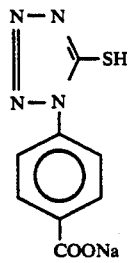

F-3

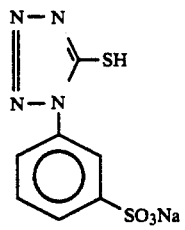

F-4

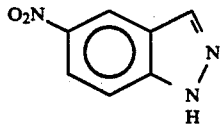

F-5

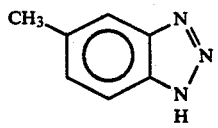

F-6

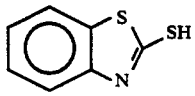

F-7

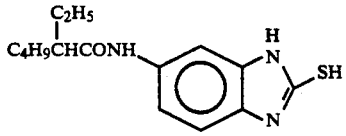

F-8

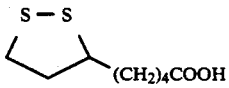

F-9

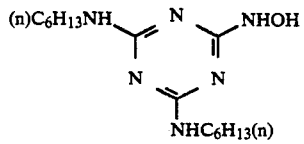

F-10

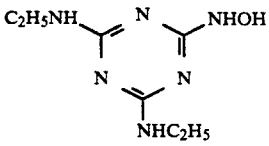

F-11

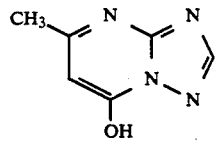

F-12

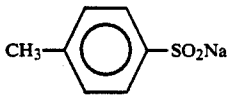

B-1

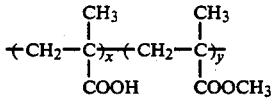

x/y = 10/90

B-2

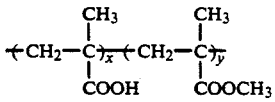

x/y = 40/60

B-3

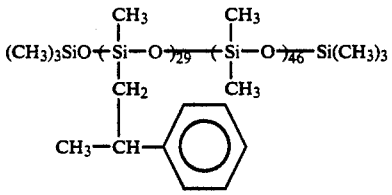

B-4

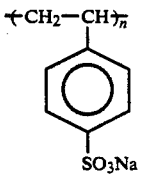

B-5

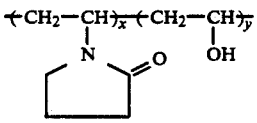

x/y = 70/30

Samples 702 to 735 were prepared by changing the yellow couplers in twelfth layer and fourteenth layer were changed to equimolar couplers of the present invention, as shown in Table 6, respectively. Amounts of high-boiling organic solvent used were also shown in Table 6. In practice, however, since gradations of green-sensitive layer and red-sensitive layer would change if the yellow coupler is changed as it is, the amount to be added of DIR coupler ExY-2 was changed, as shown in Table 6, so as to keep the gradations of green-sensitive layer and red-sensitive layer approximately unchanged, respectively.

Further, with respect to the case where the high-boiling organic solvent/coupler ratio is 0.30, a sample not changed with respect to the amount of DIR coupler was also prepared for reference.

The above prepared samples were processed according to the processing process shown below, after exposed imagewise to light through an optical wedge.

| Processing step | Processing process Time | Temperature | Replenisher* | Tank Volume |
|---|---|---|---|---|
| Color developing | 3 min 15 sec | 37.8° C. | 25 ml | 10 liter |
| Bleaching | 45 sec | 38.0° C. | 5 ml | 5 liter |
| Fixing (1) | 45 sec | 38.0° C. | — | 5 liter |
| Fixing (2) | 45 sec | 38.0° C. | 30 ml | 5 liter |
| Stabilizing (1) | 20 sec | 38.0° C. | — | 5 liter |
| Stabilizing (2) | 20 sec | 38.0° C. | — | 5 liter |
| Stabilizing (3) | 20 sec | 38.0° C. | 40 ml | 5 liter |
| Drying | 1 min | 55° C. | | |

Note:
*Replenisher amount: ml per $m^2$ of photographic material.
(Fixing steps: counter-current flow system from the tank (2) to the tank (1), Stabilizing steps: counter-current flow system from the tank of (3) towards the tank of (1))

The amount of color developer carried over into the bleaching process and the amount of fixing solution carried over into the stabilizing process are 2.5 ml and 2.0 ml, per meter of length and 35 mm of width of photographic material, respectively.

The compositions of each processing solution were as follows:

| | Mother Solution | Replenisher |
|---|---|---|
| (Color developer) | | |
| Diethylenetriaminepentaacetate | 5.0 g | 6.0 g |
| Sodium sulfite | 4.0 g | 5.0 g |
| Potassium carbonate | 30.0 g | 37.0 g |
| Potassium bromide | 1.3 g | 0.5 g |
| Potassium iodide | 1.2 mg | — |
| Hydroxylamine sulfate | 2.0 g | 3.6 g |
| 4-(N-ethyl-N-β-hydroxyethylamino)-2-methylaniline sulfonate | 4.7 g | 6.2 g |
| Water to make | 1000 ml | 1000 ml |
| pH | 10.00 | 10.15 |
| (Bleaching solution) | | |
| Fe(III) ammonium 1,3-diaminopropanetraacetate monohydrate | 144.0 g | 206.0 g |
| 1,3-Diaminopropanetetraacetic acid | 2.8 g | 4.0 g |
| Ammonium bromide | 84.0 g | 120.0 g |
| Ammonium nitrate | 17.5 g | 25.0 g |
| Aqueous ammonia (27%) | 10.0 g | 1.8 g |
| Acetic acid (98%) | 51.1 g | 73.0 g |
| Water to make | 1000 ml | 1000 ml |
| pH | 4.3 | 3.4 |
| (Fixing solution) | | |
| (Both mother solution and replenisher) | | |
| Disodium ethylenediaminetetraacetate | 1.7 g | |
| Sodium sulfite | 14.0 g | |
| Sodium bisulfite | 10.0 g | |
| Ammonium thiosulfate (70% w/v) | 210.0 ml | |
| Ammonium thiocyanate | 163.0 g | |
| Thiourea | 1.8 g | |
| Water to make | 1000 ml | |
| pH | 6.5 | |
| (Stabilizing solution) | | |
| (Both tank solution and replenisher) | | |
| Surface-active agent | 0.5 g | |

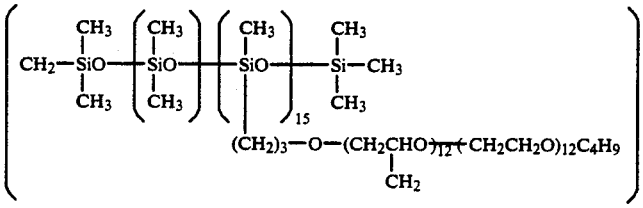

| | | |
|---|---|---|
| Surface-active agent $[C_{10}H_{21}-O-(CH_2CH_2O)_{10}-H]$ | 0.4 g | |
| Triethanolamine | 2.0 g | |
| 1,2-Benzisothiazoline-3-one methanol | 0.3 g | |
| Formalin (37%) | 1.5 g | |
| Water to make | 1000 ml | |
| pH | 6.5 | |

Results are shown in Table 6.

TABLE 6

| Sample No. | Yellow Coupler | Ratio of high-boiling solvent/ coupler[1)] | Amount of DIR coupler (ExY-2)[2)] (%) | G color density[3)] (%) | B color density[4)] (%) | Color image remaining (%) 60° C., 70%[5)] 3 months | Remarks |
|---|---|---|---|---|---|---|---|
| 701 | ExY-3 | 0.50 | 100 | 1.50 | 1.50 | 61 | Comparative example |
| 702 | " | 0.30 | " | 1.55 | 1.36 | 59 | " |
| 703 | " | 0.10 | " | 1.64 | 1.28 | 58 | " |
| 704 | " | 0.00 | " | 1.72 | 1.16 | 59 | " |
| 705 | " | 0.30 | 110 | 1.50 | 1.31 | 57 | " |
| 706 | " | " | 90 | 1.62 | 1.45 | 60 | " |
| 707 | " | " | 80 | 1.68 | 1.52 | 62 | " |
| 708 | Y-53 | 0.50 | 85 | 1.51 | 1.68 | 76 | " |
| 709 | " | 0.30 | 85 | 1.50 | 1.63 | 75 | This invention |
| 710 | " | 0.10 | 85 | 1.49 | 1.60 | 75 | " |
| 711 | " | 0.00 | 90 | 1.50 | 1.56 | 74 | " |
| 712 | " | 0.30 | 100 | 1.41 | 1.45 | 75 | " |
| 713 | Y-65 | 0.50 | 80 | 1.52 | 1.57 | 86 | Comparative example |
| 714 | " | 0.30 | 80 | 1.51 | 1.54 | 88 | This invention |
| 715 | " | 0.10 | 80 | 1.50 | 1.50 | 87 | " |
| 716 | " | 0.00 | 90 | 1.51 | 1.47 | 88 | " |
| 717 | " | 0.30 | 100 | 1.35 | 1.36 | 87 | " |
| 718 | Y-69 | 0.50 | 90 | 1.51 | 1.59 | 90 | Comparative example |
| 719 | " | 0.30 | 90 | 1.50 | 1.56 | 91 | This invention |
| 720 | " | 0.10 | 90 | 1.49 | 1.51 | 90 | " |
| 721 | Y-69 | 0.00 | 95 | 1.51 | 1.47 | 89 | This invention |
| 722 | " | 0.30 | 100 | 1.37 | 1.35 | 90 | " |
| 723 | Y-70 | 0.50 | 80 | 1.50 | 1.58 | 92 | Comparative example |
| 724 | " | 0.30 | 80 | 1.50 | 1.56 | 93 | This invention |
| 725 | " | 0.10 | 85 | 1.51 | 1.54 | 92 | " |
| 726 | " | 0.00 | 90 | 1.50 | 1.50 | 91 | " |
| 727 | " | 0.30 | 100 | 1.33 | 1.34 | 90 | " |
| 728 | Y-66 | 0.30 | 80 | 1.50 | 1.57 | 89 | " |
| 729 | " | 0.10 | 85 | 1.49 | 1.51 | 88 | " |
| 730 | Y-67 | 0.30 | 95 | 1.51 | 1.49 | 94 | " |
| 731 | " | 0.10 | 100 | 1.50 | 1.43 | 93 | " |
| 732 | Y-68 | 0.30 | 85 | 1.49 | 1.75 | 78 | " |
| 733 | " | 0.10 | 90 | 1.51 | 1.67 | 77 | " |
| 734 | Y-75 | 0.30 | 90 | 1.50 | 1.64 | 85 | This invention |
| 735 | " | 0.10 | 95 | 1.48 | 1.53 | 85 | " |

Note:
1)Weight ratio of high-boiling organic solvent to yellow coupler (excluding DIR coupler)
2)Added amount as assumed the added amount of DIR coupler (ExY-2) in Sample 701 being 100%
3)Magenta color density of each Sample when an exposure was conducted at an exposure amount that the magenta color density of Sample 701 reached 1.50.
4)Yellow color density of each Sample when an exposure was conducted at an exposure amount that the magenta color density of Sample 701 reached 1.50.
5)Remaining ratio of yellow color image of initial density 1.50 after storage for 3 months in an atmosphere at 60° C. and 70% RH.

As is apparent from Table 6, samples using the comparative coupler ExY-3 show that the B color density drops remarkably by decreasing the amount of high-boiling solvent. On the other hand, the G color density rather increases indicating that interlayer effect to green-sensitive layer is reduced. This means that the graininess is deteriorated remarkably. (Samples 701 to 704)

It is considered that, by reducing the amount of DIR coupler to be used, the yellow color density can be recovered but at the same time the interlayer effect is reduced, and thus the graininess is deteriorated. (Samples 702 and 705 to 707)

For the couplers of the present invention, for example, a sample using coupler Y-53 can give enough color density with extremely less lowering of yellow color density even when the amount of a high-boiling organic solvent is lessened, while, of course, it gives a high yellow color density when the ratio of high-boiling organic solvent to coupler is 0.50 (outside the scope of the present invention). (Samples 708 to 711, in which the amount of DIR coupler was changed so as to obtain a similar degree of magenta color density)

For reference, a sample not being changed DIR coupler amount was tested (Sample 712), and from the results of this sample it can be understood that an excess interlayer effect was obtained from the fact that yellow color density decreased and magenta color density decreased also.

Samples using coupler Y-55, Y-69, Y-70, Y-66, Y-67, Y-68, and Y-75 show almost same results as the above.

In Table 6, fading data of yellow coupler are shown also. From the results it can be noticed that samples of the present invention using couplers represented by formula (Y) are excellent also in view of image dye fastness. And it can be said that, among these couplers, Y-65, Y-69, Y-70, Y-66, Y-67, and Y-75 are excellent couplers.

Having described our invention as related to the embodiment, it is our intention that the invention is not limited by any of the details of the description, unless otherwise specified, but rather is construed broadly within its spirit and scope as set out in the accompanying claims.

What we claim is:

1. A silver halide color photographic material having at least one -photosensitive silver halide emulsion layer on a base, which comprises at least one of said photosensitive silver halide emulsion layers that contains at least one acylacetamide yellow dye-forming coupler whose acyl group is represented by the following formula (I):

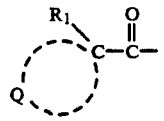

Formula (I)

wherein $R_1$ represents a monovalent group, Q represents a group of non-metallic atoms required to form together with the C a substituted or unsubstituted 3- to 5-membered membered cyclic hydrocarbon group or a substituted or unsubstututed 3- to 5-membered heterocyclic group having in the group at least one hetero atom selected from the group consisting of N, O, S, and P, provided that $R_1$ is not a hydrogen atom and it does not bond to Q to form a ring, and that contains a high-boiling organic solvent of which weight ratio to the dye-forming coupler contained in said layer is 0 to 0.3.

2. The silver halide color photographic material as claimed in claim 1, wherein the acylacetamide yellow coupler is represented by the following formula (Y):

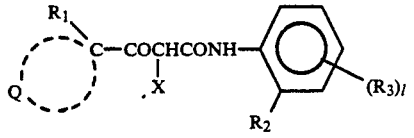

Formula (Y)

wherein $R_1$ represents a monovalent substituent other than hydrogen; Q represents a group of non-metallic atoms which form together with the C a substituted or unsubstituted 3- to 5-membered cyclic hydrocarbon group or a substituted or unsubstituted 3- to 5-membered heterocyclic group having in the group at least one hetero atom selected from a group consisting of N, O, S, and P; $R_2$ represents a hydrogen atom, a halogen atom, a substituted or unsubstituted alkoxy group, a substituted or unsubstituted aryloxy group, a substituted or unsubstituted alkyl group, or an amino group; $R_3$ represents a group capable of substitution onto a benzene ring; X represents a hydrogen atom or a group capable of being released upon a coupling reaction thereof with an oxidized product of an aromatic primary amine developing agent; l is an integer of 0 to 4, and when l is 2 or more, the $R_3$ groups may be the same or different.

3. The silver halide color photographic material as claimed in claim 2, wherein $R_3$ in formula (Y) is selected from the group consisting of a halogen atom, an alkyl group having 1 to 30 carbon atoms, an aryl group having 6 to 30 carbon atoms, an alkoxy group having 1 to 30 carbon atoms, an aryloxy group having 6 to 30 carbon atoms, an alkoxycarbonyl group having 2 to 30 carbon atoms, an aryloxycarbonyl group having 7 to 30 carbon atoms, a carbonamido group having 1 to 30 carbon atoms, a sulfonamido group having 1 to 30 carbon atoms, a carbamoyl group having 1 to 30 carbon atoms, a sulfamoyl group having 1 to 30 carbon atoms, an alkylsulfonyl group having 1 to 30 carbon atoms, an ureido group having 1 to 30 carbon atoms, a sulfamoylamino group having 0 to 30 carbon atoms, an alkoxycarbonylamino group having 2 to 30 carbon atoms, an alkoxysulfonyl group having 1 to 30 carbon atoms, a nitro group, a heterocyclic group having 1 to 30 carbon atoms, a cyano group, an acyl group having 1 to 30 carbon atoms, an acyloxy group having 2 to 30 carbon atoms, an alkylsulfonyloxy group having 1 to 30 carbon atoms, and an arysulfonyloxy group having 6 to 30 carbon atoms.

4. The silver halide color photographic material as claimed in claim 2, wherein X is selected from the group that bonds to the coupling active site through a nitrogen atom consisting of a heterocyclic group, an aryloxy group, an arylthio group, an acyloxy group, an alkylsulfonyloxy group, an arylsulfonyloxy group, a heterocyclic oxy group, and a halogen atom.

5. The silver halide color photographic material as claimed in claim 2, wherein $R_1$ in formula (Y) represents a halogen atom, a cyano group, an alkyl group having 1 to 30 carbon atoms, an alkoxy group having 1 to 30 carbon atoms, an aryl group having 6 to 30 carbon atoms or an aryloxy group having 6 to 30 carbon atoms.

6. The silver halide color photographic material as claimed in claim 2, wherein the ring formed by Q together with C is selected from the group consisting of a cyclopropene ring, a cyclobutane ring, a cyclopropene ring, a cyclobutene ring, a cyclopentene ring, an oxetane ring, an oxolane ring, a 1,3-dioxolane ring, a thiethane ring, a thiolane ring, and a pyrrolidine ring.

7. The silver halide color photographic material as claimed in claim 2, wherein $R_1$ in formula (Y) represents a halogen atom or an alkyl group.

8. The silver halide color photographic material as claimed in claim 2, wherein Q in formula (Y) represents a group of non-metallic atoms that forms together with C a 3- to 5-membered cyclic hydrocarbon ring.

9. The silver halide color photographic material as claimed in claim 2, wherein $R_2$ in formula (Y) represents a chlorine atom, a fluorine atom, an alkyl group, an alkoxy group, or an aryloxy group.

10. The silver halide color photographic material as claimed in claim 2, wherein $R_3$ in formula (Y) represents a halogen atom, an alkoxy group, an alkoxycarbonyl group, an aryloxycarbonyl group, a carbonamido group, a sulfonamido group, a carbamoyl group, or a sulfamoyl group.

11. The silver halide color photographic material as claimed in claim 10, wherein $R_3$ in formula (Y) represents an alkoxy group, an alkoxycarbonyl group, a carbonamido group, or a sulfonamido group.

12. The silver halide color photographic material as claimed in claim 2, wherein X in formula (Y) represents a group represented by the formula (Y-1), (Y-2), or (Y-3) given below:

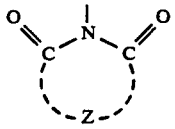

Formula (Y-1)

wherein Z represents

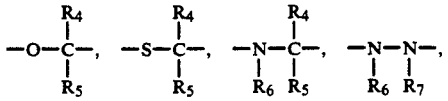

-continued

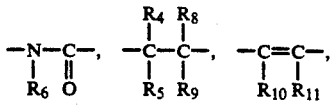

in which $R_4$, $R_5$, $R_8$, and $R_9$ each represent a hydrogen atom, an alkyl group, an aryl group, an alkoxy group, an aryloxy group, an alkylthio group, an arylthio group, an alkylsulfonyl group, an arylsulfonyl group, or an amino group, $R_6$ and $R_7$ each represent a hydrogen atom, an alkyl group, an aryl group, an alkylsulfonyl group, an arylsulfonyl group, or an alkoxycarbonyl group, $R_{10}$ and $R_{11}$ each represent a hydrogen atom, an alkyl group, or an aryl group, or $R_{10}$ and $R_{11}$ may bond together to form a benzene ring, and $R_4$ and $R_5$, $R_5$ and $R_6$, $R_6$ and $R_7$, or $R_4$ and $R_8$ may bond together to form a ring, Formula (Y-2)

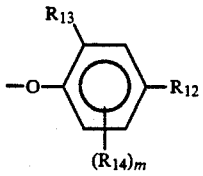

wherein at least one of $R_{12}$ and $R_{13}$ represents a group selected from the group consisting of a halogen atom, a cyano group, a nitro group, a trifluoromethyl group, a carboxyl group, an alkoxycarbonyl group, a carbonamido group, a sulfonamido group, a carbamoyl group, a sulfamoyl group, an alkylsulfonyl group, an arylsulfonyl group, and an acyl group and the other may represent a hydrogen atom, an alkyl group, or an alkoxy group, $R_{14}$ has the same meaning as that of $R_{12}$ or $R_{13}$, and m is an integer of 0 to 2, Formula (Y-3)

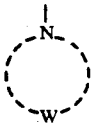

wherein W represents a group of nonmetallic atoms required to form together with N a pyrrole ring, a pyrazole ring, an imidazole ring, or a triazole ring.

13. The silver halide color photographic material as claimed in claim 12, wherein said ring is selected from the group consisting of cyclobutane, cyclohexane, cycloheptane, cyclohexene, pyrrolidine, and piperidine.

14. The silver halide color photographic material as claimed in claim 1, wherein the amount of acylacetamide yellow dye-forming coupler to be used is $1\times10^{-3}$ mol to 2 mol, per mol of silver halide in the photosensitive layer in which the coupler is added.

15. The silver halide color photographic material as claimed in claim 1, wherein the high-boiling organic solvent is selected from the group consisting of compounds represented by the following formulae (S-1) to (S-9):

Formula (S-1)

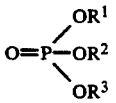

wherein $R^1$, $R^2$, and $R^3$ each independently represent an alkyl group, a cycloalkyl group, or an aryl group, Formula (S-2)

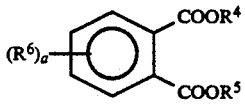

wherein $R^4$ and $R^5$ each independently represents an alkyl group, a cycloalkyl group, or an aryl group, $R^6$ represents a halogen atom, an alkyl group, an alkoxy an integer of 0 to 3, and if a is 2 or 3, the $R^6$ group $R^6$ may be the same or different, Formula (S-3)

$$(Ar-COO\rangle_b R^7$$

wherein Ar represents an aryl group, b is an integer of 1 to 6, and $R^7$ represents a b-valent hydrocarbon group or hydrocarbon groups bonded together through an ether linkage, Formula (S-4)

$$(R^8-COO\rangle_c R^9$$

wherein $R^8$ represents an alkyl group or a cycloalkyl group, c is an integer of 1 to 6, and $R^9$ represents a c-valent hydrocarbon group or hydrocarbon groups bonded together through an ether linkage, Formula (S-5)

$$R^{10}\langle COO-R^{11})_d$$

wherein d is an integer of 2 to 6, and $R^{10}$ represents a d-valent hydrocarbon group excluding aromatic groups, and $R^{11}$ represents an alkyl group, a cycloalkyl group, or an aryl group, Formula (S-6)

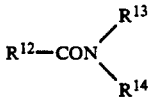

wherein $R^{12}$, $R^{13}$, and $R^{14}$ each independently represents an alkyl group, a cycloalkyl group, or an aryl group and $R^{12}$ and $R^{13}$ or $R^{13}$ and $R^{14}$ may bond together to form a ring, Formula (S-7)

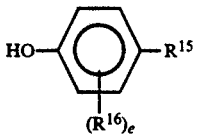

wherein $R^{15}$ represents an alkyl group, a cycloalkyl group, an alkoxycarbonyl group, an alkylsufonyl group, an arylsulfonyl group, an aryl group, or a cyano group, $R^{16}$ represent a halogen atom, an alkyl group, a cycloalkyl group, an aryl group, an alkoxy group, or an aryloxy group, e is an integer of 0 to 3, and if e is 2 or 3, the $R^{16}$ groups may be the same or different,

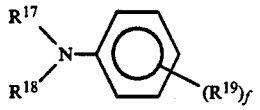

Formula (S-8)

wherein $R^{17}$ and $R^{18}$ each independently represent an alkyl group, a cycloalkyl group, or an aryl group, $R^{19}$ represents a halogen atom, an alkyl group, a cycloalkyl group, an aryl group, an alkoxy group, or an aryloxy group, f is an integer of 0 to 4, and if f is an integer of 2 to 4, the $R^{19}$ groups may be the same or different, $$-(A_1)_{a1}-(A_2)_{a2}- \ldots -(A_n)_{an}-$$ Formula (S-9)

wherein $A_1$, $A_2$, . . . , and $A_n$ each represent a polymerization unit given by a non-color-forming ethylenically-unsaturated monomer, a1, a2, . . . , and an each represent the weight percentage of the polymerization unit, and n is an integer of 1 to 30.

16. The silver halide color photographic material as claimed in claim 1, wherein the weight ratio of the high-boiling organic solvent to the dye forming coupler contained in same layer is 0.1 or below.

17. The silver halide color photographic material as claimed in claim 1, wherein the coating amount of silver in the photographic material is 6.0 g/m$^2$ or below.

18. The silver halide color photographic material as claimed in claim 2, wherein the alkyl group contains 1 to 30 carbon atoms.

19. The silver halide color photographic material as claimed in claim 2, wherein $R_2$ in formula (Y) represents a halogen atom, an alkoxy group that may be substituted and has a total of 1 to 30 carbon atoms, an aryloxy group that may be substituted and has a total of 6 to 30 carbon atoms, an alkyl group that may be substituted and has a total of 1 to 30 carbon atoms, or an amino group that may be substituted and has a total of 0 to 30 carbon atoms.

20. The silver halide color photographic material as claimed in claim 2, wherein in formula (Y), l is an integer of 1 or 2 and the position of the substitution of $R_3$ is meta or ortho relative to

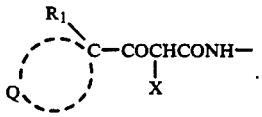

* * * * *